US008116458B2

(12) United States Patent
Mizuno et al.

(10) Patent No.: US 8,116,458 B2
(45) Date of Patent: Feb. 14, 2012

(54) ACOUSTIC IMAGE LOCALIZATION APPARATUS, ACOUSTIC IMAGE LOCALIZATION SYSTEM, AND ACOUSTIC IMAGE LOCALIZATION METHOD, PROGRAM AND INTEGRATED CIRCUIT

(75) Inventors: Ko Mizuno, Osaka (JP); Kazuhiro Iida, Kanagawa (JP); Gempo Ito, Kanagawa (JP)

(73) Assignee: Panasonic Corporation, Osaka (JP)

( * ) Notice: Subject to any disclaimer, the term of this patent is extended or adjusted under 35 U.S.C. 154(b) by 533 days.

(21) Appl. No.: 12/445,167

(22) PCT Filed: Oct. 17, 2007

(86) PCT No.: PCT/JP2007/070249

§ 371 (c)(1),
(2), (4) Date: Apr. 10, 2009

(87) PCT Pub. No.: WO2008/047833

PCT Pub. Date: Apr. 24, 2008

(65) Prior Publication Data

US 2010/0054483 A1 Mar. 4, 2010

(30) Foreign Application Priority Data

Oct. 19, 2006 (JP) ..... 2006-285471

(51) Int. Cl.
*H04R 5/00* (2006.01)

(52) U.S. Cl. ..... 381/18; 381/80

(58) Field of Classification Search ..... 381/18, 381/80

See application file for complete search history.

(56) References Cited

U.S. PATENT DOCUMENTS 5,799,094 A 8/1998 Mouri (Continued)

FOREIGN PATENT DOCUMENTS

JP 64-018400 1/1989

(Continued)

OTHER PUBLICATIONS

International Search Report issued Jan. 8, 2008 in the International (PCT) Application of which the present application is the U.S. National Stage.

*Primary Examiner* — Samuel Gebremariam

(74) *Attorney, Agent, or Firm* — Wenderoth, Lind & Ponack, L.L.P.

(57) ABSTRACT

An acoustic image localization apparatus according to the present invention that outputs sound from a plurality of speakers so as to localize an acoustic image at a predetermined position on a space as viewed from a listener, the acoustic image localization apparatus comprising: amplitude characteristic adjusting means for adjusting an amplitude frequency characteristic of an inputted acoustic signal such that the acoustic image is localized at a position rotated by a first angle about a position of a listener toward an upper direction from a facing position of the listener; and a plurality of level adjusting means, provided so as to respectively correspond to the plurality of speakers, for adjusting a level of the acoustic signal outputted from the amplitude characteristic adjusting means and for outputting, to a corresponding speaker, the acoustic signal whose level has been adjusted, wherein each of the level adjusting means adjusts the level of the acoustic signal, which is outputted from the amplitude characteristic adjusting means, to a level of the corresponding speaker such that the acoustic image is localized at the predetermined position rotated by a second angle about the position of the listener toward one of directions orthogonal to the rotated directions from the position rotated by the first angle.

22 Claims, 34 Drawing Sheets

U.S. PATENT DOCUMENTS 6,381,333 B1 4/2002 Suzuki

FOREIGN PATENT DOCUMENTS

| | | |
|---|---|---|
| JP | 08-051698 | 2/1996 |
| JP | 08-182100 | 7/1996 |
| JP | 08-256400 | 10/1996 |
| JP | 8-265899 | 10/1996 |
| JP | 09-009398 | 1/1997 |
| JP | 9-200897 | 7/1997 |
| JP | 09-233600 | 9/1997 |
| JP | 09-327100 | 12/1997 |
| JP | 10-210600 | 8/1998 |
| JP | 11-205892 | 7/1999 |
| JP | 2000-506691 | 5/2000 |
| JP | 2003-009297 | 1/2003 |
| JP | 2003-153398 | 5/2003 |

FIG. 10

| θ \ X | +15 | +12 | +9 | +6 | +3 | 0 | -3 | -6 | -9 | -12 |
|---|---|---|---|---|---|---|---|---|---|---|
| 0 | -43 | -32 | -28 | -18 | 10 | 0 | 10 | 18 | 28 | 32 |
| -0.2π | -40 | -38 | -35 | -20 | -7 | 7 | 14 | 22 | 28 | 30 |
| -0.4π | -45 | -47 | -47 | -40 | — | 18 | 25 | 30 | 35 | 40 |
| -0.6π | -45 | -50 | -50 | -50 | 40 | 38 | 39 | 40 | 41 | 45 |
| -0.8π | -45 | -50 | -75 | -78 | -90 | -60 | 54 | 55 | 53 | 45 |
| -π | -45 | -50 | -80 | -90 | — | — | — | 90 | 80 | 50 |

(a) WHEN CONVENTIONAL METHOD IS USED (b) WHEN METHOD OF PRESENT EMBODIMENT IS USED

PRIOR ART

ACOUSTIC IMAGE LOCALIZATION APPARATUS, ACOUSTIC IMAGE LOCALIZATION SYSTEM, AND ACOUSTIC IMAGE LOCALIZATION METHOD, PROGRAM AND INTEGRATED CIRCUIT

TECHNICAL FIELD

The present invention relates to an acoustic image localization apparatus, an acoustic image localization system, and acoustic image localization method, program and integrated circuit, and more particularly to an acoustic image localization apparatus, an acoustic image localization system, and acoustic image localization method, program and integrated circuit, all of which are capable of localizing an acoustic image at a predetermined position.

BACKGROUND ART

Conventionally, in an acoustic content such as music or broadcasting, two-channel content is mainly used. The two-channel content is configured of a left-channel acoustic signal FL which is reproduced from a speaker located at a position diagonally to the left-front of a user and a right-channel acoustic signal FR which is reproduced from a speaker located at a position diagonally to the right-front of the user.

In the 1990s, various 5.1 channel sound formats typified by Dolby Digital System have been proposed, and the 5.1 channel sound contents which comply with such a format are recorded on DVDs and the like and have become widely available as goods. The 5.1 channel sound content is configured of, in addition to the channels FL and FR, a center channel FC which is reproduced from a speaker located at a position directly in front of the user, a left surround channel RL which is reproduced from a speaker located at a position diagonally to the left-rear of the user, a right surround channel RR which is reproduced from a speaker located at a position diagonally to the right-rear of the user, and an acoustic signal of a channel LFE which is reproduced from a speaker exclusively used for low frequency components of approximately 120 Hz or less. By listening to reproduction sound of acoustic signals of respective channels of the six speakers located so as to surround the user, he or she is able to enjoy higher presence.

Furthermore, in recent years, along with digitalization of television broadcasting wave, the 5.1 channel sound content is adopted in some broadcasting. Thus, the user has more opportunities to enjoy the 5.1 channel sound content. Whereas, it is generally difficult to set six speakers in a limited living space, and there has been an increased demand for more easily enjoying the higher presence obtained from the 5.1 channel sound content.

As a technique for satisfying this demand, a technique referred to as Virtual Surround has been widely used. In this technique, a predetermined head acoustic transfer function is previously embedded with an acoustic signal of each of the channels, so as to reproduce the acoustic signal of each of the channels by a headphone, thereby localizing an acoustic image in a direction in which each of the six speakers are disposed. However, this technique has problems in that the user may feel tired when he or she wears a headphone for a long period of time or the user may feel that acoustic images are so close that they are localized in the vicinity of the head of the user. Thus, the technique has not yet widely spread.

In order to solve this problem, proposed has been a technique for realizing a virtual surround technique, using a head acoustic transfer function, which utilizes a head acoustic transfer function by means of two speakers located at positions diagonally to the right-front and left-front of the user (patent document 1, for example). Hereinafter, a conventional acoustic image localization system 10 which realizes the virtual surround technique by using two speakers will be described with reference to FIG. 32. FIG. 32 is a diagram describing a configuration of the conventional acoustic image localization system 10. Note that in an example of FIG. 32, an acoustic signal of 0.1 channel (channel LFE) is not shown and will not be described. Also, FIG. 32 is a diagram as viewed from above the head of a user 3 who is a listener, and the user 3 faces leftward in the diagram.

In FIG. 32, a multi-speaker system 1 outputs acoustic signals of 5 channels to an acoustic image localization system 10. Specifically, the multi-speaker system 1 outputs, as acoustic signals, a left front channel signal FL, a center channel signal FC, a right front channel signal FR, a left surround channel signal RL and a right surround channel signal RR. Under normal circumstances, these acoustic signals are radiated as acoustic waves outputted from the left front speaker FL, the center speaker FC, the right front speaker FR, the left surround speaker RL and the right surround speaker RR, all of which are shown by dashed lines, i.e., from the five speakers disposed so as to surround the user 3.

The acoustic image localization system 10 causes effect imparting sections 111*a* to 111*e* to perform a predetermined effect imparting process on the acoustic signals of 5 channels, and also causes adders 112*a* to 112*h* to combine the results of the effect imparting processes. Furthermore, the acoustic image localization system 10 causes a crosstalk canceller 113 to perform a crosstalk cancellation process and output the obtained results via the two speakers which are a left speaker 2*a* and a right speaker 2*b*. By executing such processes, the acoustic image localization system 10 provides the user with presence effect as if he or she feels that acoustic waves are radiated from the five speakers.

Each of the effect imparting sections 111*a* to 111*e* localizes an acoustic image at a position at which each of the five speakers shown in dotted lines are disposed, and adjusts an amplitude frequency characteristic of an inputted acoustic signal so as to impart an acoustic transfer function corresponding to a position of each of the five speakers. Hereinafter, a process executed by the effect imparting section 111*a* will be described, for example. The effect imparting section 111*a* localizes an acoustic image at a position of the right surround speaker RR, and adjusts an amplitude frequency characteristic of an inputted acoustic signal so as to impart an acoustic transfer function corresponding to the position of the right surround speaker RR. More specifically, the effect imparting section 111*a* is designed as a filter for reproducing an acoustic transfer function $H_L$ from the position of the right surround speaker RR to a left ear of the user 3 and an acoustic transfer function $H_R$ from the position of the right surround speaker RR to a right ear of the user 3. With the effect imparting process executed by the effect imparting section 111*a*, the effect imparting section 111*a* outputs an acoustic signal having an amplitude frequency characteristic of the acoustic transfer function $H_L$ as a left-ear acoustic signal. Also, the effect imparting section 111*a* outputs an acoustic signal having an amplitude frequency characteristic of the acoustic transfer function $H_R$ as a right-ear acoustic signal.

FIG. 33 shows time-axis responses (impulse responses) of the acoustic transfer functions $H_L$ and $H_R$, and amplitude frequency characteristics of the acoustic transfer functions $H_L$ and $H_R$. The right surround speaker RR is located at a position 120 degrees diagonally to the right-rear of the user 3. FIG. 33(*a*) is a diagram showing the time-axis responses of the acoustic transfer functions $H_L$ and $H_R$. FIG. 33(*b*) is a diagram showing the amplitude frequency characteristics of the acoustic transfer functions $H_L$ and $H_R$. As is clear from FIG. 33(*a*), in the speaker located at a position diagonally to the right-rear of the user 3, an acoustic pressure response value of the time-axis response of the acoustic transfer function $H_R$ is different from that of the time-axis response of the acoustic transfer function $H_L$. Also, as is clear from FIG. 33(*b*), in the speaker located at a position diagonally to the right-rear of the user 3, the amplitude frequency characteristic of the acoustic transfer function $H_R$ is different from that of the acoustic transfer function $H_L$. Due to these differences, in the prior art, an amplitude frequency characteristic of an acoustic transfer function from a position at which an acoustic image should be localized to each ear has been a significant factor to localize an acoustic image. The conventional acoustic image localization system 10 adopts a control method in which the acoustic transfer functions $H_L$ and $H_R$ from a position at which an acoustic image should be localized (the right surround speaker RR) to both ears of the user 3 are faithfully reproduced at the positions of both ears. Specifically, the conventional acoustic image localization system 10 causes the effect imparting sections 111*a* to 111*e* to perform the effect imparting process and causes the crosstalk canceller 113 to perform the crosstalk cancellation process, thereby faithfully reproducing the acoustic transfer functions $H_L$ and $H_R$ at the positions of both ears of the user 3.

The effect imparting section 111*a* is designed by an FIR-type filter using a filter coefficient which is a discrete value of a time-axis response value for each of the right and left ears. Thus, the left-ear acoustic signal outputted from the effect imparting section 111*a* becomes an acoustic signal having a faithful amplitude frequency characteristic of the acoustic transfer function $H_L$, and the right-ear acoustic signal becomes an acoustic signal having a faithful amplitude frequency characteristic of the acoustic transfer function $H_R$.

It is assumed that the left speaker 2*a* radiates left-ear reproduction sound reproduced based on the left-ear acoustic signal, and the right speaker 2*b* radiates right-ear reproduction sound reproduced based on the right-ear acoustic signal. In this case, not only the left-ear reproduction sound radiated from the left speaker 2*a* but also the right-ear reproduction sound radiated from the right speaker 2*b* arrive at the left ear of the user 3. Similarly, not only the right-ear reproduction sound radiated from the right speaker 2*b* but also the left-ear reproduction sound radiated from the left speaker 2*a* arrive at the right ear of the user 3. As such, reproduction sound is leaked to an ear different from an ear to which the reproduction sound should be conveyed (crosstalk occurs). Due to the crosstalk, it is impossible to obtain an amplitude frequency characteristic of a faithful acoustic transfer function corresponding to a position of the right surround speaker RR at which an acoustic image is localized at each ear of the user 3.

The crosstalk canceller 113 adjusts a phase frequency characteristic of an inputted acoustic signal in order to cancel the crosstalk. Specifically, cancel sound having a phase opposite to the left-ear reproduction sound radiated from the left speaker 2*a* is radiated from the right speaker 2*b* at the same time when the reproduction sound is radiated from the left speaker 2*a*. Similarly, cancel sound having a phase opposite to the right-ear reproduction sound radiated from the right speaker 2*b* is radiated from the left speaker 2*a* at the same time when the reproduction sound is radiated from the right speaker 2*b*. By executing the above process, the crosstalk is cancelled. As a result, the acoustic transfer functions $H_R$ and $H_L$ from the position of the right surround speaker RR at which an acoustic image should be localized to right and left ears are faithfully reproduced, and therefore the user 3 is able to listen to sound represented by the acoustic transfer function $H_L$ shown in FIG. 33 with the left ear, and is also able to listen to sound represented by the acoustic transfer function $H_R$ shown in FIG. 33 with the right ear. Thus, the user 3 is able to feel as if sound is radiated from the right surround speaker RR (hereinafter, referred to as acoustic image localization effect).

Note that the aforementioned processes are executed in the similar manner in the effect imparting sections 111*b* to 111*e*. As a result, the conventional acoustic image localization system 10 shown in FIG. 32 provides the user 3 with an acoustic image localization effect that he or she can feel as if sound is radiated from the five speakers disposed to surround the user 3.

As described above, in the conventional acoustic image localization system 10, an acoustic transfer function from a position at which an acoustic image should be localized to each ear is faithfully realized by means of the effect imparting processes executed by the effect imparting sections 111*a* to 111*e* and the crosstalk cancellation process executed by the crosstalk canceller 113, in order to provide the user 3 with the acoustic image localization effect.

In the conventional acoustic image localization system 10, however, a control parameter of the crosstalk canceller 113 needs to be set based on a listening position of the user 3 which has been previously simulated. Furthermore, in the case where the user 3 moves his or her head and the listening position changes, the phase frequency characteristics represented by the acoustic transfer functions from the left speaker 2*a* to the left and right ears of the user 3 and from the right speaker 2*b* to the left and right ears of the user 3 accordingly change. As described above, when a listening position is shifted from a position which has been previously simulated, a phase of the cancel sound is not completely opposite to a phase of the reproduction sound, thereby deteriorating the crosstalk cancellation effect. Furthermore, a wavelength of an acoustic wave is short in a high frequency band. Therefore, in the high frequency band, the range in which a phase of cancel sound is completely opposite to a phase of the reproduction sound is extremely narrow. Thus, the cross cancellation effect is heavily deteriorated.

As shown in FIG. 33, an amplitude level of the amplitude frequency characteristic of the acoustic transfer function $H_L$ from the right surround speaker RR to the left ear greatly fluctuates in the high frequency band. The same is also true of an amplitude level of the amplitude frequency characteristic of the acoustic transfer function $H_R$. From this result, it is apparent that the amplitude frequency characteristics in the high frequency band exerts a great influence upon the acoustic image localization effect. Therefore, in the conventional acoustic image localization system 10, even if a listening position slightly changes, the crosstalk cancellation effect heavily deteriorates in the high frequency band. Thus, the acoustic transfer function from a position at which an acoustic image should be localized to each ear of the user 3 cannot be faithfully reproduced. What is worse, the acoustic image localization effect cannot be significantly obtained.

In practical use, the user 3 never always keeps the same posture when listening to sound, and the user 3 hardly listens to sound at a listening position which has been simulated when the crosstalk canceller 113 is designed. Thus, in practical, a listening position which has been previously simulated hardly coincides with a position of each ear of the user 3, whereby the acoustic image localization effect is hardly obtained.

As described above, in the conventional acoustic image localization system 10, since the crosstalk canceller 113 executes the crosstalk cancellation process, the listening position range in which the acoustic image localization effect can be obtained is extremely narrow. Furthermore, in practical, the acoustic image localization effect is hardly obtained.

For solving these problems, an acoustic reproduction system capable of suppressing deterioration of the crosstalk cancellation effect in the high frequency band and capable of producing the acoustic image localization effect within a wide listing range (patent document 2, for example). Hereinafter, a conventional acoustic reproduction system capable of producing the acoustic image localization effect within a wide listening range will be described with reference to FIG. 34. The acoustic image reproduction system includes an acoustic localization system 11, the left speaker 2*a*, the right speaker 2*b*, and a cabinet 12. The acoustic localization system 11 is connected to the left speaker 2*a* and the right speaker 2*b*. Note that the left speaker 2*a*, the right speaker 2*b* and the user 3 shown in FIG. 34 are the same as those shown in FIG. 32, and the above components are denoted by the same reference numerals. FIG. 34 is a diagram as viewed from above of the head of the user 3 and the user 3 faces upward in the diagram.

In FIG. 34, the left speaker 2*a* and the right speaker 2*b* are attached to the cabinet 12 and are disposed so as to be adjacent to each other. The left speaker 2*a* and the right speaker 2*b* are positioned such that a forward angle θ from the position of the user 3 is within a range from 6 to 20 degrees.

The acoustic localization system 11 includes digital filters 121*a* to 121*d*, and adders 122*a* and 122*b*. The acoustic localization system 11 processes a plurality of acoustic signals u1 and u2, and outputs output signals v1 and v2 for running the left speaker 2*a* and the right speaker 2*b*. Note that the acoustic signals u1 and u2 represent normal stereo signals (acoustic signals of channels FL and FR). The digital filters 121*a* to 121*d* are designed so as to perform the crosstalk cancellation process. More specifically, the digital filters 121*a* to 121*d* are designed so as to have a processing characteristic for causing an acoustic transfer function of a position of each ear of the user 3 to coincide with a head acoustic transfer function which localizes the acoustic signal u1 or u2 in a predetermined direction. The detailed design method has been disclosed in European Patent Publication No. 0434691, Patent Specification No. WO 94/01981 and the like.

In the acoustic reproduction system shown in FIG. 34, the left speaker 2*a* and the right speaker 2*b* are disposed so as to adjacent to each other, thereby suppressing the deterioration of cancellation effect in the high frequency band and thus providing the user with the acoustic image localization effect within the wide listing range. Hereinafter, the reasons therefor will be described with reference to FIG. 35. FIG. 35 is a diagram schematically showing wavefronts of reproduction sound and cancel sound.

In FIG. 35, a plurality of arc-shaped dotted lines extending forward from the right speaker 2*b* show wavefronts having phases of 180 degrees with respect to wavefronts of reproduction sound arrived from the right speaker 2*b* to the left ear of the user 3. Also, a plurality of arc-shaped solid lines extending forward from the left speaker 2*a* show wavefronts having phases of 0 degrees with respect to wavefronts of cancel sound reproduced by the left speaker 2*a*. In areas in which the dotted lines of the right speaker 2*b* overlap the solid lines of the left speaker 2*a*, a phase of the cancel sound reproduced by the left speaker 2*a* is opposite to that of the reproduction sound arrived from the right speaker 2*b* to the user 3. Note that in FIG. 35, the left speaker 2*a* and the right speaker 2*b* are disposed so as to be adjacent to each other. Therefore, as shown in FIG. 35, the ark-shaped dotted lines of the right speaker 2*b* and the ark-shaped solid lines of the left speaker 2*a* greatly overlap with each other. That is, a range in which a phase of cancel sound from the left speaker 2*a* is opposite to that of reproduction sound from the right speaker 2*b* becomes wider. As such, in the acoustic reproduction system shown in FIG. 34, the left speaker 2*a* and the right speaker 2*b* are disposed so as to be adjacent to each other, thereby suppressing the deterioration of crosstalk cancellation effect in the high frequency band and thus providing the acoustic image localization effect within the wide listing range.

[Patent document 1] Japanese Laid-Open Patent Publication No. 9-200897

[Patent document 2] Japanese Unexamined Patent Publication No. 2000-506691

DISCLOSURE OF THE INVENTION

Problems to be Solved by the Invention

However, in the conventional acoustic reproduction system shown in FIG. 34, the left speaker 2*a* and the right speaker 2*b* must be positioned such that a forward angle θ from the position of the user 3 needs to be within in a range from 6 to 20 degrees. For example, in television receivers, the recent tendency has been toward a rapid increase in size, and thus speakers disposed at both sides of a display are positioned within a wider forward angle, accordingly. For example, in case of a 50-inch television receiver, a space between the speakers (ΔS) is approximately 110 cm. On the other hand, it is said that an appropriate viewing distance of the user ($r_0$) is three times as long as the height of the display, and when the 50-inch television receiver is used, the appropriate viewing distance is 180 cm. When the user view the screen 180 cm apart from the television receiver, an forward angle between the speakers will be approximately 34 degrees. That is, in the case where the speakers are mounted in apparatuses such as television receivers in which a forward angle becomes wider, it is not possible to dispose speakers so as to be adjacent to each other. Thus, it will be more difficult to suppress the deterioration of the crosstalk cancellation effect, and a desired acoustic image localization effect cannot be obtained.

Therefore, an object of the present invention is to provide an acoustic image localization apparatus, an acoustic image localization system, an acoustic image localization method, program and integrated circuit capable of providing the user with an acoustic image localization effect within a wide listening range without limiting an arrangement position of a speaker.

Solution to the Problems

In order to solve the above problem, an acoustic image localization apparatus of the present invention that outputs sound from a plurality of speakers so as to localize an acoustic image at a predetermined position on a space as viewed from a listener comprises: amplitude characteristic adjusting means for adjusting an amplitude frequency characteristic of an inputted acoustic signal such that the acoustic image is localized at a position rotated by a first angle about a position of a listener toward an upper direction from a facing position of the listener; and a plurality of level adjusting means, provided so as to respectively correspond to the plurality of speakers, for adjusting a level of the acoustic signal outputted from the amplitude characteristic adjusting means and for outputting, to a corresponding speaker, the acoustic signal whose level has been adjusted, wherein each of the level adjusting means adjusts the level of the acoustic signal, which is outputted from the amplitude characteristic adjusting means, to a level of the corresponding speaker such that the acoustic image is localized at the predetermined position rotated by a second angle about the position of the listener toward one of directions orthogonal to the rotated directions from the position rotated by the first angle.

As described in the above configuration, the amplitude characteristic adjusting means adjusts a position in the front-rear direction of the predetermined position, and the level adjusting means adjusts a position in the left-right direction of the predetermined position, thereby making it possible to localize an acoustic image at the predetermined position. As described above, in the acoustic image localization apparatus according to the present invention, when the acoustic image is localized at the predetermined position, the crosstalk cancellation process is not performed in the high frequency band by adjusting the phase frequency characteristic. Thus, in the acoustic image localization apparatus according to the present invention, it becomes possible to produce an acoustic image localization effect within a wide listening range without limiting an arrangement position of a speaker.

In the acoustic image localization apparatus, it is preferable that the amplitude characteristic adjusting means may adjust the amplitude frequency characteristic such that sound arrived at left and right ears of the listener has an amplitude frequency characteristic obtained based on an acoustic transfer function from the position rotated by the first angle to either of the left or right ear of the listener.

Preferably, the amplitude characteristic adjusting means may adjust the amplitude frequency characteristic such that sound arrived at the left and right ears of the listener has a notch characteristic obtained based on an acoustic transfer function from the position rotated by the first angle to either of the left or right ear of the listener. In this case, it is more preferable that at least two notch characteristics obtained based on the acoustic transfer function from the position rotated by the first angle to either of the left or right ear of the listener may exist within a frequency band higher than 4 kHz. Alternatively, in this case, it is more preferable that the acoustic image localization apparatus may further comprise a storage section for storing, for each listener, information regarding the notch characteristic of the acoustic transfer function from the position rotated by the first angle to either of the left or right ear of the listener, and corresponding information associated with identification information of the listener, wherein the amplitude characteristic adjusting means adjusts the amplitude frequency characteristic based on the corresponding information stored in the storage section such that the sound arrived at the left and right ears of the listener has the notch characteristic corresponding to the listener.

Preferably, the amplitude characteristic adjusting means may adjust the amplitude frequency characteristic such that sound arrived at left and right ears of the listener has a peak characteristic obtained based on the acoustic transfer function from the position rotated by the first angle to the either of the left or right ear of the listener.

Preferably, each of the level adjusting means may adjust the level of the acoustic signal outputted from the amplitude characteristic adjusting means by using the same adjustment value regardless of frequency or by using an adjustment value which is different for each predetermined frequency band.

Preferably, the acoustic image localization apparatus may further comprise a plurality of phase characteristic adjusting means, provided so as to respectively correspond to the plurality of level adjusting means, for adjusting a phase frequency characteristic of the acoustic signal outputted from corresponding level adjusting means, and outputs, to the corresponding speaker, the acoustic signal whose phase frequency characteristic has been adjusted, wherein each of the phase characteristic adjusting means may adjust the phase frequency characteristic of the acoustic signal, which is outputted from the corresponding level adjusting means, to a characteristic of the corresponding speaker such that the acoustic image is localized at the predetermined position rotated by the second angle from the position rotated by the first angle within a range in which the amplitude frequency characteristic of sound arrived to the left and right ears of the listener remains unchanged.

Preferably, the acoustic image localization apparatus may further comprise high-pass means for passing, only when the inputted acoustic signal has a frequency higher than or equal to a predetermined frequency, the acoustic signal so as to be outputted to the amplitude characteristic adjusting means. In this case, it is more preferable that the acoustic image localization apparatus may further comprise: low-pass means for passing, only when the inputted acoustic signal has a frequency lower than the predetermined frequency, the acoustic signal; and adjustment means for adjusting an amplitude frequency characteristic and a phase frequency characteristic of the acoustic signal which has been passed through the low-pass means such that the acoustic image is localized at the predetermined position, and for outputting the acoustic signal, to the corresponding speaker, whose amplitude frequency characteristic and the phase frequency characteristic have been adjusted. Note that the adjustment means corresponds to a left amplitude phase characteristic adjusting section 413*a*, a right amplitude phase characteristic adjusting section 413*b*, and a center amplitude phase characteristic adjusting section 413*c*, all of which are to be described later. Furthermore, it is more preferable that the adjustment means may be provided so as to respectively correspond to the plurality of speakers, and may have a plurality of amplitude phase characteristic adjusting means for adjusting the amplitude frequency characteristic and the phase frequency characteristic of the acoustic signal which has been passed through the low-pass means to a characteristic of the corresponding speaker such that the acoustic image is localized at the predetermined position, and for outputting the acoustic signal, to the corresponding speaker, whose amplitude frequency characteristic and the phase frequency characteristic have been adjusted. Alternatively, it is more preferable that the adjustment means may be provided so as to respectively correspond to the speakers except for a predetermined speaker which is one of the plurality of speakers, and has a plurality of amplitude phase characteristic adjusting means for adjusting the amplitude frequency characteristic and the phase frequency characteristic of the acoustic signal which has been passed through the low-pass means to a characteristic of the corresponding speaker such that the acoustic image is localized at the predetermined position, and for outputting the acoustic signal, to the corresponding speaker, whose amplitude frequency characteristic and the phase frequency characteristic have been adjusted. Furthermore, it is preferable that a transfer function of each of the amplitude phase characteristic adjusting means is calculated by dividing a transfer function set for each of the amplitude phase characteristic adjusting means which are provided so as to correspond to the speakers except for the predetermined speaker when it is assumed that the amplitude phase characteristic adjusting means are provided so as to correspond to all of the plurality of speakers, by a transfer function set for the amplitude phase characteristic adjusting means provided so as to correspond to the predetermined speaker under the above assumption. Still furthermore, it is preferable that the acoustic image localization apparatus may further comprise amplitude characteristic correcting means for correcting the amplitude frequency characteristic of the acoustic signal which has been passed through the low-pass means to an amplitude frequency characteristic indicated by the transfer function set for the amplitude phase characteristic adjusting means provided so as to correspond to the predetermined speaker under the above assumption, and for outputting the corrected amplitude frequency characteristic to each of the amplitude phase characteristic adjusting means.

Preferably, the acoustic image localization apparatus may further comprise: high-pass means for passing, only when the inputted acoustic signal has a frequency higher than or equal to a first predetermined frequency, the acoustic signal so as to be outputted to the amplitude characteristic adjusting means; middle-pass means for passing, only when the inputted acoustic signal has a frequency lower than the first predetermined frequency and higher than or equal to a second predetermined frequency, the acoustic signal so as to be outputted to an auxiliary speaker disposed at the predetermined position; low-pass means for passing, only when the inputted acoustic signal has a frequency lower than the second predetermined frequency, the acoustic signal; and adjustment means for adjusting the amplitude frequency characteristic and the phase frequency characteristic of the acoustic signal which has been passed through the low-pass means such that the acoustic image is localized at the predetermined position, and for outputting, to each of the speakers, the acoustic signal whose amplitude frequency characteristic and the phase frequency characteristic have been adjusted.

The present invention is also directed to an acoustic image localization system, and an acoustic image localization system of the present invention that outputs sound from a plurality of speakers so as to localize an acoustic image at a plurality of positions, on a space as viewed from a listener, respectively corresponding to a plurality of channels, comprises: a plurality of acoustic image localization apparatuses, provided so as to respectively correspond to the plurality of channels, for outputting sound from a plurality of speakers so as to localize the acoustic image at a position, on the space, corresponding to each of the channels, wherein each of the acoustic image localization apparatuses includes: amplitude characteristic adjusting means for adjusting an amplitude frequency characteristic of an inputted acoustic signal such that the acoustic image is localized at a position rotated by a first angle about a position of a listener toward an upper direction from a facing position of the listener; and a plurality of level adjusting means, provided so as to respectively correspond to the plurality of speakers, for adjusting the level of the acoustic signal, which is outputted from the amplitude characteristic adjusting means, to a level of the corresponding speaker such that the acoustic image is localized at the predetermined position rotated by a second angle about the position of the listener toward one of directions orthogonal to the rotated directions from the position rotated by the first angle, and for outputting, to the corresponding speaker, the acoustic signal whose level has been adjusted.

Preferably, in the acoustic image localization system, each of the acoustic image localization apparatuses may include: high-pass means for passing, only when the acoustic signal corresponding to each of the channels has a frequency higher than or equal to a predetermined frequency, the acoustic signal so as to be outputted to the amplitude characteristic adjusting means; low-pass means for passing, only when the acoustic signal corresponding to each of the channels has a frequency lower than the predetermined frequency, the acoustic signal; and a plurality of amplitude phase characteristic adjusting means, provided so as to respectively correspond to the plurality of speakers, for adjusting the amplitude frequency characteristic and the phase frequency characteristic of the acoustic signal which has been passed through the low-pass means to a characteristic of the corresponding speaker such that the acoustic image is localized at the corresponding position, and for outputting, to the corresponding speaker, the acoustic signal whose amplitude frequency characteristic and phase frequency characteristic have been adjusted. In this case, it is more preferable that each of the amplitude phase characteristic adjusting means may be constituted by an FIR type filter, and a tap length of the amplitude phase characteristic adjusting means of one of the acoustic image localization apparatuses having the shortest distance between the corresponding position and the speaker is shorter than tap lengths of the amplitude phase characteristic adjusting means of the other acoustic image localization apparatuses.

Preferably, about any two of the acoustic image localization apparatuses, one of the acoustic image localization apparatus may further include: high-pass means for passing, only when the acoustic signal corresponding to one of the channels has a frequency higher than or equal to a predetermined frequency, the acoustic signal so as to be outputted to the corresponding amplitude characteristic adjusting means, and the other acoustic image localization apparatus includes: high-pass means for passing, only when the acoustic signal corresponding to one of the channels has a frequency higher than or equal to the predetermined frequency, the acoustic signal so as to be outputted to the corresponding amplitude characteristic adjusting means; adding means for adding the acoustic signal corresponding to the one of the channels to the acoustic signal of the other acoustic image localization apparatus corresponding to the one of the channels; low-pass means for passing, only when the inputted acoustic signal outputted from the adding means has a frequency lower than the predetermined frequency, the acoustic signal; and the plurality of amplitude phase characteristic adjusting means for adjusting the amplitude frequency characteristic and the phase frequency characteristic of the acoustic signal which has been passed through the low-pass means to a characteristic of the corresponding speaker, and for outputting, to the corresponding speaker, the acoustic signal whose amplitude frequency characteristic and phase frequency characteristic have been adjusted.

Preferably, the acoustic image localization system may be connected to a plurality of speakers included in a video apparatus for displaying a video on a screen.

The present invention is also directed to an acoustic image localization method, and an acoustic image localization method of the present invention of outputting sound from a plurality of speakers so as to localize an acoustic image at a predetermined position on a space as viewed from a listener, comprises: an amplitude characteristic adjusting step of adjusting an amplitude frequency characteristic of an inputted acoustic signal such that the acoustic image is localized at a position rotated by a first angle about a position of a listener toward an upper direction from a facing position of the listener; and a level adjusting step of adjusting a level of the acoustic signal adjusted in the amplitude characteristic adjusting step to a level of each of the speakers such that the acoustic image is localized at the predetermined position rotated by a second angle about the position of the listener toward one of directions orthogonal to the rotated directions from the position rotated by the first angle, and of outputting, to a corresponding speaker, the acoustic signal whose level has been adjusted.

The present invention is also directed to an integrated circuit, and an integrated circuit of the present invention that outputs sound from a plurality of speakers so as to localize an acoustic image at a predetermined position on a space as viewed from a listener, comprises: amplitude characteristic adjusting means for adjusting an amplitude frequency characteristic of an inputted acoustic signal such that the acoustic image is localized at a position rotated by a first angle about a position of a listener toward an upper direction from a facing position of the listener; and a plurality of level adjusting means, provided so as to respectively correspond to the plurality of speakers, for adjusting a level of the acoustic signal outputted from the amplitude characteristic adjusting means and for outputting, to a corresponding speaker, the acoustic signal whose level has been adjusted, wherein each of the level adjusting means adjusts the level of the acoustic signal, which is outputted from the amplitude characteristic adjusting means, to a level of the corresponding speaker such that the acoustic image is localized at the predetermined position rotated by a second angle about the position of the listener toward one of directions orthogonal to the rotated directions from the position rotated by the first angle.

The present invention is also directed to a program, and a program of the present invention is a program to be executed by a computer of an acoustic image localization apparatus that outputs sound from a plurality of speakers so as to localize an acoustic image at a predetermined position on a space as viewed from a listener, the program causing the computer to execute: an amplitude characteristic adjusting step of adjusting an amplitude frequency characteristic of an inputted acoustic signal such that the acoustic image is localized at a position rotated by a first angle about a position of a listener toward an upper direction from a facing position of the listener; and a level adjusting step of adjusting a level of the acoustic signal adjusted in the amplitude characteristic adjusting step to a level of each of the speakers such that the acoustic image is localized at the predetermined position rotated by a second angle about the position of the listener toward one of directions orthogonal to the rotated directions from the position rotated by the first angle, and of outputting, to a corresponding speaker, the acoustic signal whose level has been adjusted. In this case, the program may be recorded in a computer readable recording medium.

Effect of the Invention

According to the present invention, it is possible to provide an acoustic image localization apparatus, an acoustic image localization system, and acoustic image localization method, program and integrated circuit capable of providing the user with an acoustic image localization effect within a wide listening range without limiting an arrangement position of a speaker.

BRIEF DESCRIPTION OF THE DRAWINGS

FIG. 10 is a diagram showing response results of the user 3.

DESCRIPTION OF THE REFERENCE CHARACTERS

Figure 1:
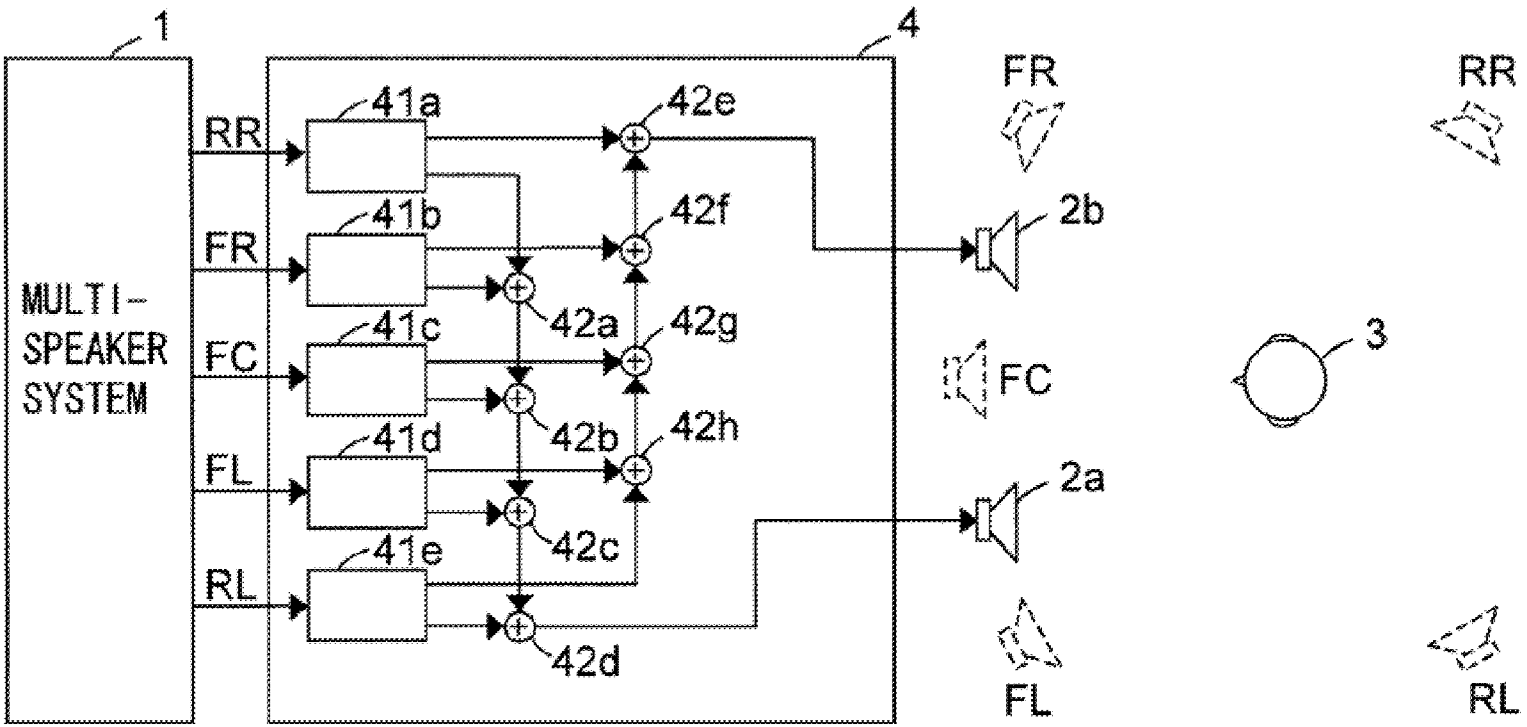
FIG. 1 is a diagram describing a configuration of an acoustic image localization system 4 of the present invention.

1 multi-speaker system
12 cabinet
111*a* to 111*e* effect imparting section
112*a* to 112*h*, 122*a*, 122*b*, 42*a* to 42*h*, 414*a* to 414*d* adder
113 crosstalk canceller
121*a* to 121*d* digital filter
2 speaker
2*a* left speaker
2*b* right speaker
2*c* center speaker
3 user
4, 10, 11 acoustic image localization system
41*a* to 41*e*, 51*a*, 61*a*, 71*a*, 81*a*, 91*a*, 101*a* acoustic image localization apparatus
410*a* low-pass section
410*b*, 410*c* high-pass section
410*d* middle-pass section
411, 411*a*, 415, 420 amplitude characteristic adjusting section
412*a*, 412*c* left-speaker-level adjusting section
412*b*, 412*d* right-speaker-level adjusting section
412*e* center-speaker-level adjusting section
4111 target characteristic correction processing section
4112 reproduction characteristic correction processing section
413*a*, 413*d* left amplitude phase characteristic adjusting section
413*b* right amplitude phase characteristic adjusting section
413*c* center amplitude phase characteristic adjusting section
415*a* left-speaker delay section
415*b* right-speaker delay section
416 amplitude characteristic correction section
421 storage section
4201 first notch correction processing section
4202 second notch correction processing section
5, 7, 7*a* target acoustic image

BEST MODE FOR CARRYING OUT THE INVENTION

A configuration of an acoustic image localization system 4 of the present invention will be described with reference to FIG. 1. FIG. 1 is a diagram describing a configuration of the acoustic image localization system 4 of the present invention. A multi-speaker system 1 shown in FIG. 1 is connected to the acoustic image localization system 4. The acoustic image localization system 4 is also connected to the left speaker 2*a* and the right speaker 2*b*. Note that the multi-speaker system 1, the left speaker 2*a*, the right speaker 2*b* and the user 3 shown in FIG. 1 are the same as those shown in FIG. 32, and the above components are denoted by the same reference numerals. FIG. 1 is a view as shown from above the head of the user 3. In FIG. 1, the user faces leftward in the diagram.

In FIG. 1, the multi-speaker system 1 outputs acoustic signals of five channels to the acoustic image localization system 4. Specifically, the multi-speaker system 1 outputs the left front channel signal FL, the center channel signal FC, the right front channel signal FR, the left surround channel signal RL and the right surround channel signal RR, as the acoustic signals. Under normal circumstances, these acoustic signals are radiated as acoustic waves outputted from the left front speaker FL, the center speaker FC, the right front speaker FR, the left surround speaker RL and the right surround speaker RR, all of which are shown by dashed lines, i.e., from the five speakers disposed so as to surround the user 3.

The acoustic image localization system 4 includes acoustic image localization apparatuses 41*a* to 41*e*, and adders 42*a* to 42*h*. The acoustic image localization apparatus 41*a*, to which the right surround channel signal RR is inputted, outputs a left-ear acoustic signal which has been processed for the left ear to the right speaker 2*b* via the adders 42*a* to 42*d*, and outputs a right-ear acoustic signal which has been processed for the right ear to the right speaker 2*b* via the adder 42*e*. The acoustic image localization apparatus 41*b*, to which the right front channel signal FR is inputted, outputs the left-ear acoustic signal which has been processed for the left ear to the left speaker 2*a* via the adders 42*a* to 42*d*, and outputs the right-ear acoustic signal which has been processed for the right ear to the right speaker 2*b* via the adders 42*f* to 42*e*. The acoustic image localization apparatus 41*c*, to which the center channel signal FC is inputted, outputs the left-ear acoustic signal which has been processed for the left ear to the left speaker 2*a* via the adders 42*b* to 42*d*, and outputs the right-ear acoustic signal which has been processed for the right ear to the right speaker via the adders 42*g* to 42*e*. The acoustic image localization apparatus 41*d*, to which the left front channel signal FL is inputted, outputs the left-ear acoustic signal which has been processed for the left ear to the left speaker 2*a* via the adders 42*c* to 42*d*, and outputs the right-ear acoustic signal which has been processed for the right ear to the right speaker 2*b* via the adders 42*h* to 42*d*. The acoustic image localization apparatus 41*e*, to which the left surround channel signal RL is inputted, outputs the left-ear acoustic signal which has been processed for the left ear via the adder 42*d*, and outputs the right-ear acoustic signal which has been processed for the right ear to the right speaker 2*b* via the adders 42*h* to 42*e*.

The left speaker 2*a*, to which the left-ear acoustic signal outputted from the acoustic image localization system 4 is inputted, outputs sound based on the left-ear acoustic signal having been inputted. The right speaker 2*a*, to which the right-ear acoustic signal outputted from the acoustic image localization system 4 is inputted, outputs sound based on the right-ear acoustic signal having been inputted. The left speaker 2*a* is disposed at a position diagonally to the left-front of the user 3. The right speaker 2*b* is disposed at a position diagonally to the right-front of the user 3. Note that the left speaker 2*a* and the right speaker 2*b* are arranged so as to be symmetrical to the left and right of the forward facing direction of the user.

First Embodiment

Figure 2:
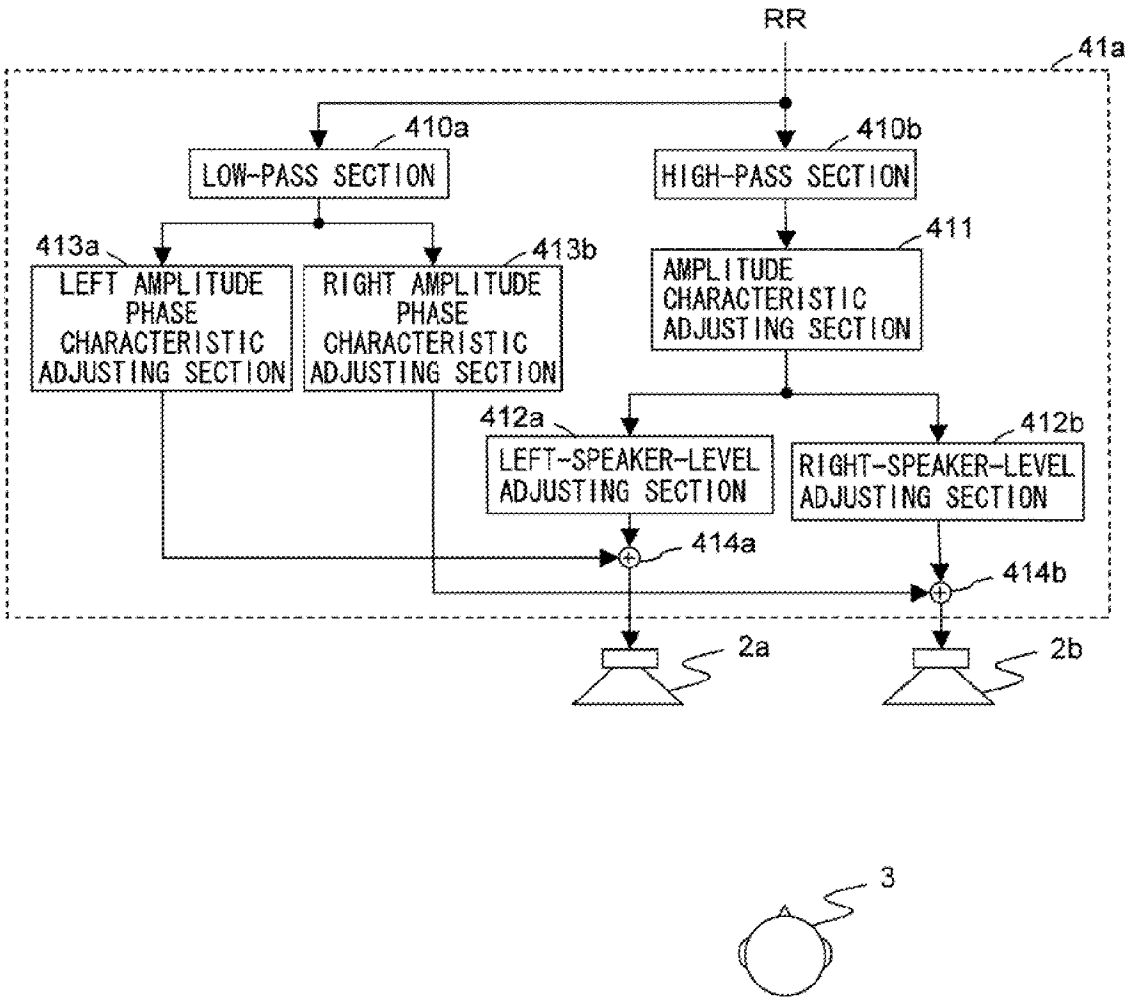
FIG. 2 is a diagram showing a configuration of the acoustic image localization apparatus according to a first embodiment.

Next, an acoustic image localization apparatus according to a first embodiment of the present invention will be described with reference to FIG. 2. FIG. 2 is a diagram showing a configuration of the acoustic image localization apparatus according to the first embodiment. As an example, FIG. 2 shows a configuration of the acoustic image localization apparatus 41*a*, for performing a process on the right surround channel signal RR, which is one of the components included in the acoustic image localization apparatus shown in FIG. 1. In FIG. 2, the adders 42*a* to 42*h* shown in FIG. 1 are not shown. Also, in FIG. 2, the user 3 faces upward. Furthermore, FIG. 2 is a diagram as viewed from above the head of the user 3.

In FIG. 2, the acoustic image localization apparatus 41*a* includes a low-pass section 410*a*, a high-pass section 410*b*, an amplitude characteristic adjusting section 411, a left-speaker-level adjusting section 412*a*, a right-speaker-level adjusting section 412*b*, a left amplitude phase characteristic adjusting section 413*a*, a right amplitude phase characteristic adjusting section 413*b*, and adders 414*a* and 414*b*. In FIG. 2, the low-pass section 410*a*, the high-pass section 410*b*, the amplitude characteristic adjusting section 411, the left-speaker-level adjusting section 412*a*, the right-speaker-level adjusting section 412*b*, the left amplitude phase characteristic adjusting section 413*a*, the right amplitude phase characteristic adjusting section 413*b*, and the adders 414*a* and 414*b* are included in a digital signal processing circuit, but a DA converter is not shown in FIG. 2. Furthermore, an amplifier for amplifying signals inputted to the left speaker 2*a* and the right speaker 2*b* is also not shown in FIG. 2.

Hereinafter, an operation of the acoustic image localization apparatus 41*a* shown in FIG. 2 will be described. The right surround channel signal RR is inputted to the low-pass section 410*a* and the high-pass section 410*b* as an acoustic signal. The low-pass section 410*a* performs a process on a signal so as to pass only an acoustic signal having a frequency lower than a predetermined frequency (crossover frequency) to be described later (hereinafter, referred to as a low-pass acoustic signal). The high-pass section 410*b* performs a process on a signal so as to pass only an acoustic signal having a frequency higher than or equal to the predetermined frequency (hereinafter, referred to as a high-pass acoustic signal).

A process to be performed on the high-pass acoustic signal outputted from the high-pass section 410*b* will be described. In FIG. 2, in the high-pass acoustic signal outputted from the high-pass section 410*b*, front-rear sensation of an acoustic image is controlled in the amplitude characteristic adjusting section 411, and left-right sensation of an acoustic image is controlled in the left-speaker-level adjusting section 412*a* and the right-speaker-level adjusting section 412*b*.

Figure 3:
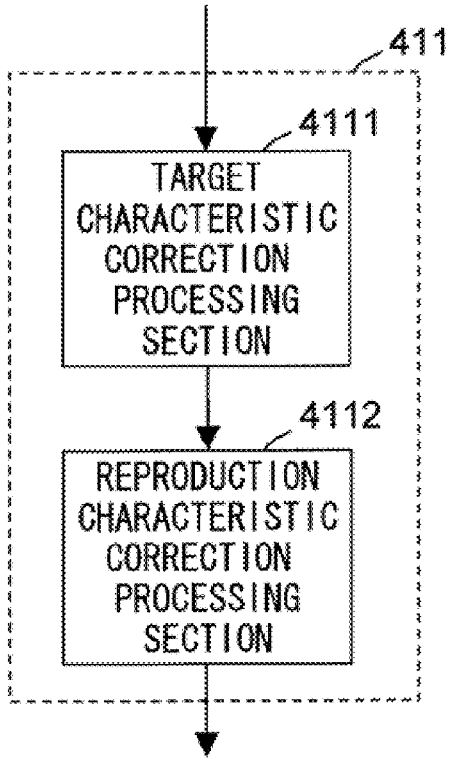
FIG. 3 is a diagram showing a configuration of an amplitude characteristic adjusting section 411.

The high-pass acoustic signal outputted from the high-pass section 410*b* is inputted to the amplitude characteristic adjusting section 411. FIG. 3 is a diagram illustrating a configuration of the amplitude characteristic adjusting section 411. The amplitude characteristic adjusting section 411 is designed by an IIR typed filter which processes an input signal in a target characteristic correction processing section 4111 and a reproduction characteristic correction processing section 4112 and outputs the input signal which has been processed. The amplitude characteristic adjusting section 411 adjusts the amplitude frequency characteristic of the input signal and controls the front-rear sensation of an acoustic image.

Figure 4:
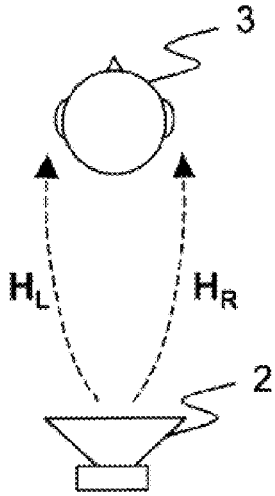
FIG. 4 is a diagram showing acoustic transfer functions $H_L$ and $H_R$ from a speaker 2 set directly behind a user 3 to both ears of the user 3.
Figure 5:
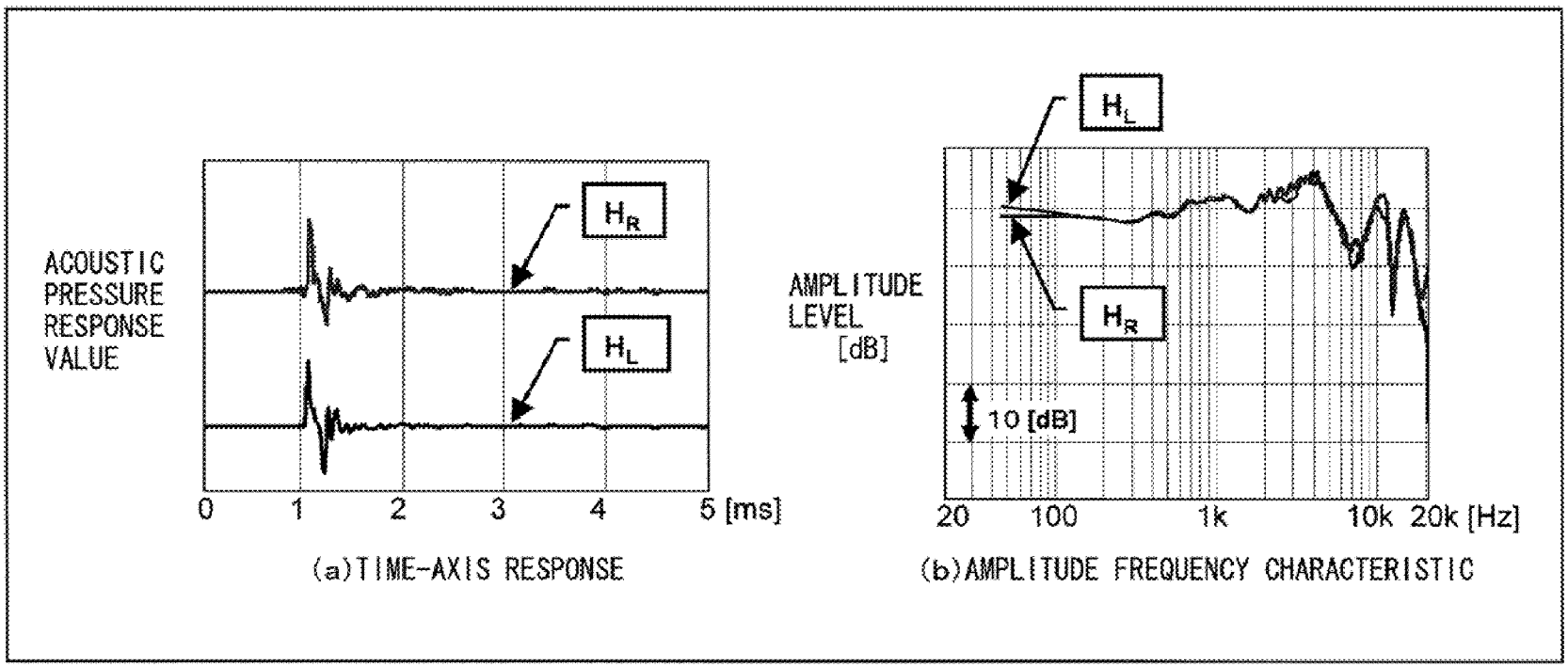
FIG. 5 is a diagram showing time-axis responses of the acoustic transfer function $H_L$ and $H_R$ and amplitude frequency characteristics of the acoustic transfer functions $H_L$ and $H_R$.

It is assumed that an amplitude frequency characteristic indicated by an acoustic transfer function obtained when an acoustic image is localized at a position directly behind the user 3 is a target characteristic. The target characteristic correction processing section 4111 corrects an amplitude frequency characteristic having the input acoustic signal to the target characteristic. The target characteristic correction processing section 4111 is designed by an IIR type filter. FIG. 4 shows the acoustic transfer functions $H_L$ and $H_R$ from the speaker 2, which is disposed directly behind the user 3, to both ears of the user 3. Also, FIG. 5 shows the time-axis responses and amplitude frequency characteristics of the acoustic transfer function $H_L$ and $H_R$ shown in FIG. 4. FIG. 5(*a*) shows the time-axis response of each of $H_L$ and $H_R$. FIG. 5 (*b*) shows the amplitude frequency characteristic of each of $H_L$ and $H_R$. As is clear from FIGS. 5(*a*) and (*b*), the positions of the both ears of the user 3 are symmetrical to each other with respect to the speaker 2, the acoustic transfer function $H_L$ is substantially the same as the acoustic transfer function $H_R$. As described above, when the speaker 2 is disposed along a plane formed by a group of positions where a distance between the left ear of the user 3 and the speaker 2 is equal to a distance between the right ear of the user 3 and the speaker 2 (hereinafter, referred to as a median plane), it is known that the user 3 determines a front-rear direction of an acoustic image based on the amplitude frequency characteristics of the acoustic transfer function $H_L$ and $H_R$ from the speaker 2 disposed on the median plane to the both ears. Furthermore, in the above case, the amplitude frequency characteristic of the acoustic transfer function $H_L$ is substantially the same as that of $H_R$, as shown in FIG. 5(*b*). Thus, in order to localize an acoustic image at a position directly behind the user 3, the target characteristic correction processing section 13*a* corrects an amplitude frequency characteristic of either of the acoustic transfer function $H_L$ or $H_R$ shown in FIG. 5(*b*) to a target characteristic.

When the reproduction sound is simultaneously outputted from the left speaker 2*a* and the right speaker 2*b*, the reproduction characteristic correction processing section 4112 corrects the amplitude frequency characteristic of the acoustic signal outputted from the target characteristic correction processing section 4111 such that an amplitude frequency characteristic of the reproduction sound arrived at each ear of the user 3 (hereinafter, referred to as reproduction characteristic) becomes equal to the target characteristic corrected by the target characteristic correction processing section 4111. Note that the target characteristic correction processing section 4111 is designed by an IIR type filter.

Now, it is assumed that an acoustic signal having the amplitude frequency characteristic corrected by the target characteristic correction processing section 4111 to the target characteristic is directly outputted from each of the left speaker 2*a* and the right speaker 2*b*. In this case, due to an acoustic transfer path from each ear of the user 3 to the left speaker 2*a* or the right speaker 2*b*, the reproduction characteristic of the reproduction sound arrived at each ear of the user 3 will be varied from the target characteristic corrected by the target characteristic correction processing section 4111. The experiment has confirmed that due to this variation, the user 3 senses an acoustic image at a position slightly upward from the facing direction of the user, instead of sensing that the image is directly behind the user. Thus, the reproduction characteristic correction processing section 4112 performs correction so as to suppress the variation caused by the acoustic transfer path.

Figure 6:
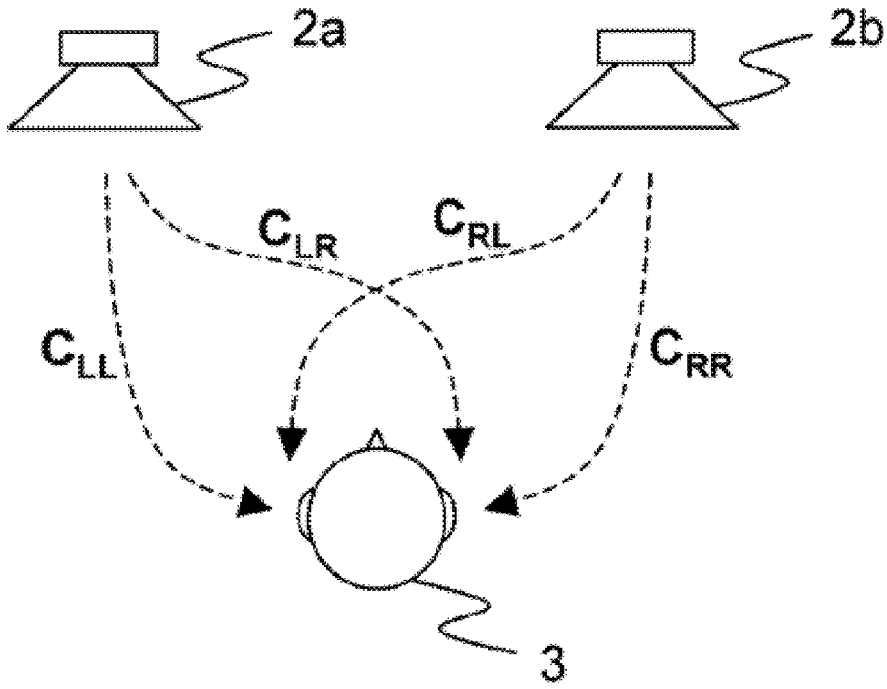
FIG. 6 is a diagram showing acoustic transfer paths from the left speaker 2*a* to each ear of the user 3 and from the right speaker 2*b* to each ear of the user 3.
Figure 7:
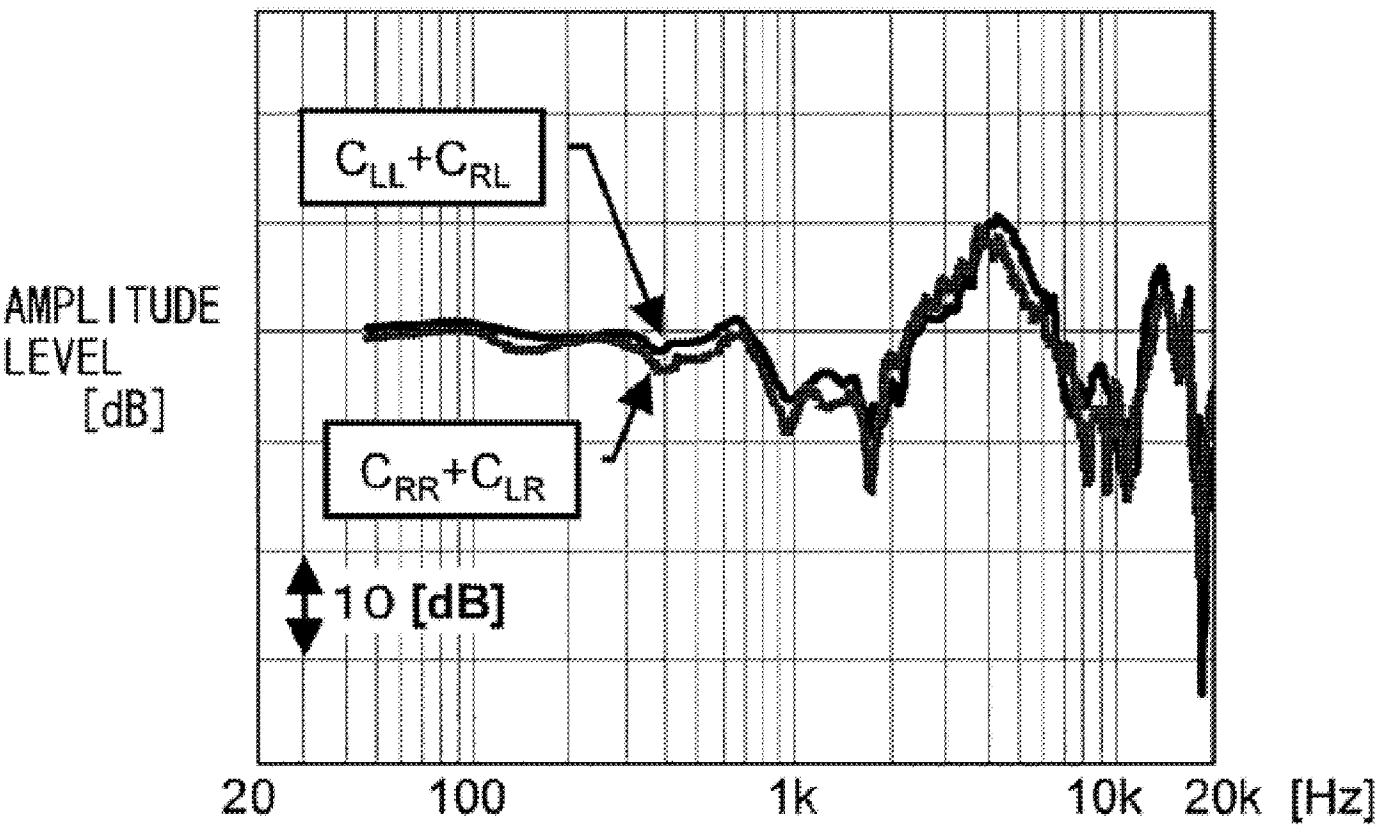
FIG. 7 is a diagram showing a characteristic ($C_{LL}$+$C_{RL}$) obtained by combining the amplitude frequency characteristics of the acoustic transfer path $C_{LL}$ and $C_{RL}$, shown in FIG. 6 and a characteristic ($C_{RR}$+$C_{LR}$) obtained by combining the amplitude frequency characteristics of the acoustic transfer path $C_{RR}$ and $C_{LR}$ shown in FIG. 6.

FIG. 6 is a diagram showing acoustic transfer paths from the left speaker 2*a* to each ear of the user 3 and from the right speaker 2*b* to each ear of the user 3. In FIG. 6, the left speaker 2*a* is arranged at a position rotated to the left by 30 degrees with respect to the facing direction the user 3, and the right speaker 2*b* is arranged at a position rotated to the right by 30 degrees from the facing direction of the user 3. In FIG. 6, an acoustic transfer path from the left speaker 2*a* to the left ear of the user 3 is denoted as $C_{LL}$, an acoustic transfer path from the left speaker 2*a* to the right ear of the user 3 is denoted as $C_{LR}$, an acoustic transfer path from the right speaker 2*b* to the right ear of the user 3 is denoted as $C_{RR}$, and an acoustic transfer path from the right speaker 2*b* to the left ear of the user 3 is denoted as $C_{RL}$. FIG. 7 is a diagram showing a characteristic ($C_{LL}$+$C_{RL}$) obtained by combining the amplitude frequency characteristics of the acoustic transfer paths $C_{LL}$ and $C_{RL}$ shown in FIG. 6 and showing a characteristic ($C_{RR}$+$C_{LR}$) obtained by combining the amplitude frequency characteristics of the acoustic transfer paths $C_{RR}$ and $C_{LR}$ shown in FIG. 6. As is clear from FIG. 7, the characteristic ($C_{LL}$+$C_{RL}$) is substantially the same as the characteristic ($C_{RR}$+$C_{LR}$).

The reproduction characteristic correction processing section 4112 corrects the amplitude frequency characteristic of an acoustic signal outputted from the target characteristic correction processing section 4111 so as to planarize the characteristic ($C_{LL}$+$C_{RL}$) and the characteristic ($C_{RR}$+$C_{LR}$) Note that as shown in FIG. 7, the characteristic ($C_{LL}$+$C_{RL}$) is substantially the same as the characteristic ($C_{RR}$+$C_{LR}$) Therefore, the reproduction characteristic correction processing section 4112 corrects an acoustic signal outputted from the target characteristic correction processing section 4111 based on either the characteristic ($C_{LL}$+$C_{RL}$) or the characteristic ($C_{RR}$+$C_{LR}$).

Figure 8:
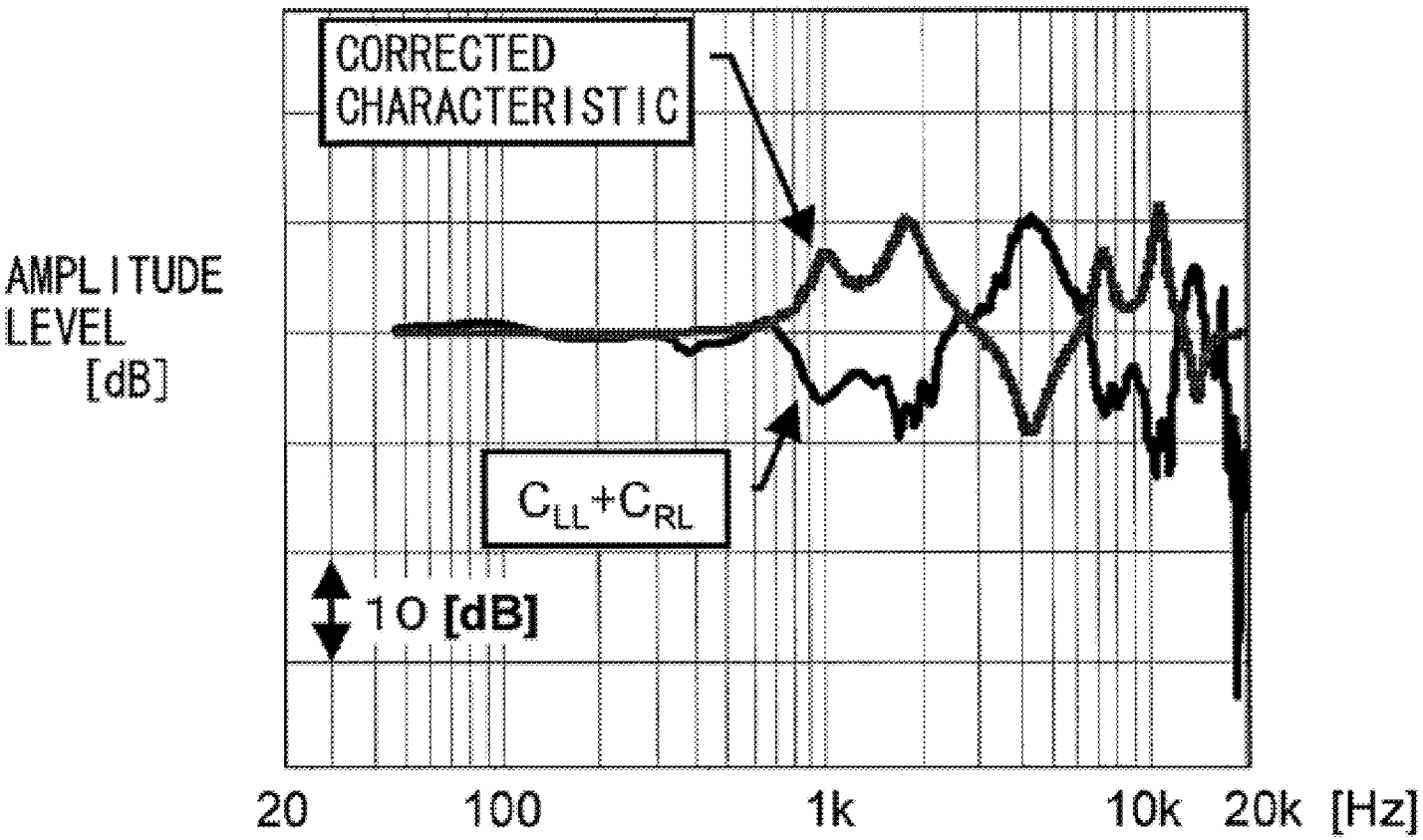
FIG. 8 is a diagram showing a corrected characteristic of the reproduction characteristic correction processing section 4112.

FIG. 8 is a diagram showing the corrected characteristic corrected by the reproduction characteristic correction processing section 4112. FIG. 8 illustrates an example where the reproduction characteristic correction processing section 4112 planarizes the characteristic ($C_{LL}$+$C_{RL}$). As is clear from the two characteristics in the vicinity of 1 to 2 kHz, 4 kHz and 7 to 10 kHz, the corrected characteristic shown in FIG. 8 is a reversed characteristic of the characteristic ($C_{LL}$+$C_{RL}$). The reproduction characteristic correction processing section 4112 corrects the amplitude frequency characteristic of the acoustic signal outputted from the target characteristic correction processing section 4111 by using the corrected characteristic. Thus, it becomes possible to cause the reproduction characteristic of the reproduction sound arrived at each ear of the user 3 to be a target characteristic corrected by the target characteristic correction processing section 4111.

As described above, the amplitude characteristic adjusting section 411 adjusts the amplitude frequency characteristic of a high-pass acoustic signal by means of correction processes executed by the target characteristic correction processing section 4111 and the reproduction characteristic correction processing section 4112. Thus, when the user 3 listens to sound having been processed by the amplitude characteristic adjusting section 411 in which the target characteristic correction processing section 4111 is connected in series with the reproduction characteristic correction processing section 4112, an acoustic image can be localized at a position directly behind the user 3, instead of at a position slightly upward from the facing direction of the user.

Note that the amplitude frequency characteristics, which are the target characteristics, of the acoustic transfer functions $H_L$ and $H_R$ shown in FIG. 5 are substantially the same as each other. Furthermore, the user 3 exists at a listening position where the characteristic ($C_{LL}$+$C_{RL}$) is substantially the same as the characteristic ($C_{RR}$+$C_{LR}$). Thus, the amplitude characteristic adjusting section 411 can faithfully reproduce the reproduction characteristic of each ear of the user 3 as a target characteristic without performing the crosstalk cancellation process. Note that the characteristic ($C_{LL}$+$C_{RL}$) and the characteristic ($C_{RR}$+$C_{LR}$), both of which are amplitude frequency characteristics, vary in accordance with the listening position of the user 3. However, the variation amount of the amplitude frequency characteristic is much smaller than that of the phase frequency characteristic. Therefore, a listening range in which the characteristic ($C_{LL}$+$C_{RL}$) is substantially the same as the characteristic ($C_{RR}$+$C_{LR}$) is much wider than a listening range limited by the crosstalk cancellation process (adjustment of the phase frequency characteristic). Therefore, even if the amplitude characteristic adjusting section 411 executes a process under the condition where the characteristic ($C_{LL}$+$C_{RL}$) is substantially the same as the characteristic ($C_{RR}$+$C_{LR}$), the object of the present invention is fully achieved. Also, as shown in FIG. 5(*b*), the fluctuation of the amplitude levels of the amplitude frequency characteristics of the acoustic transfer functions $H_L$ and $H_R$ are large in the high frequency band. From this result, it is apparent that the amplitude frequency characteristic in the high frequency band exerts a great influence on the acoustic image localization effect. In contrast, in the present invention, the reproduction characteristic of each ear of the user 3 is faithfully reproduced as a target characteristic (acoustic transfer functions $H_L$ and $H_R$) adjusted by the target characteristic correction processing section 4111 within a wide listening range, without performing the crosstalk cancellation process.

In FIG. 2, an output signal of the amplitude characteristic adjusting section 411, whose front-rear sensation has been controlled, is inputted to the left-speaker-level adjusting section 412*a* and the right-speaker-level adjusting section 412*b*. The left-speaker-level adjusting section 412*a* is provided so as to correspond to the left speaker 2*a*. The right-speaker-level adjusting section 412*b* is provided so as to correspond to the right speaker 2*b*. The left-speaker-level adjusting section 412*a* and the right-speaker-level adjusting section 412*b* are constituted by a gain apparatus which varies an amplitude level of an input signal to an uniform level regardless of the frequency. That is, the left-speaker-level adjusting section 412*a* and the right-speaker-level adjusting section 412*b* use the same adjustment value regardless of the frequency, so as to adjust a level of an output signal of the amplitude characteristic adjusting section 411. Furthermore, an adjustment value of the left-speaker-level adjusting section 412*a* is different from that of the right-speaker-level adjusting section 412*b*. Therefore, the left-speaker-level adjusting section 412*a* and the right-speaker-level adjusting section 412*b* generates a difference between an output level of the left speaker 2*a* and an output level of the right speaker 2*b*, thereby controlling the left-right sensation.

The left-speaker-level adjusting section 412*a* outputs the adjusted signal to the left speaker 2*a* as a left-ear acoustic signal. The right-speaker-level adjusting section 412*b* outputs the adjusted signal to the right speaker 2*b* as a right-ear acoustic signal.

Figure 9:
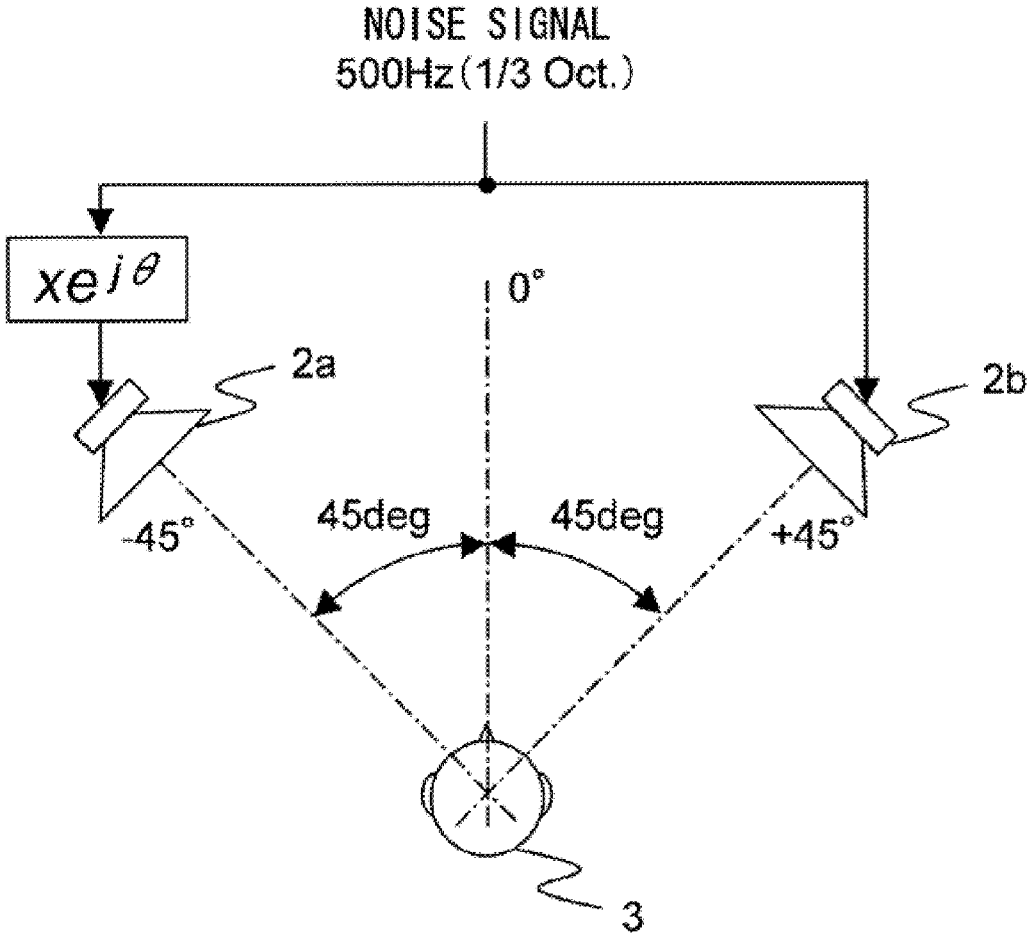
FIG. 9 is a diagram showing an experimental system used by Nakabayashi.

Note that it is widely known that the left-right localization of an acoustic image is executed based on a level difference or a time difference between the acoustic transfer functions of both ears. For example, in "the Journal of Acoustic Society of Japan, Vol. 33, No. 3 (in 1977)", Nakabayashi indicates a basic experimental result on the relationships among level and time differences between reproduction sound of two speakers and left-right localization of sensed acoustic image. FIG. 9 is a diagram showing an experimental system used by Nakabayashi. In FIG. 9, the left speaker 2*a* is arranged at a position rotated to the left by 45 degrees (45 deg) from the facing direction of the user 3 who is an examinee. The right speaker 2*b* is arranged at a position rotated to the right by 45 degrees (45 deg) from the facing direction of the user 3. Note that in FIG. 9, when the angular position the user faces is 0 degrees, an angular position of the left speaker 2*a* is −45 degrees, and an angular position of the right speaker 2*b* is +45 degrees. When noise signals (500 Hz, 1/30 ct.) are simultaneously reproduced from the left speaker 2*a* and the right speaker 2*b*, the user 3 responds to the direction in which an acoustic image is localized. Note that on an input signal to the left speaker 2*a*, as shown in FIG. 9, a process in which a level thereof is increased by XdB and a phase thereof is delayed by θ has been executed. X is a value represented based on X=20 log x when a level of an input signal is multiplied by x times.

FIG. 10 indicates response results of the user 3. In FIG. 10, when the angular position the user faces is 0 degrees, positive numerical values indicating values which vary in accordance with X and θ represent positive angles to the right from the angular position the user 3 faces such that the numerical values indicate positions at which the user 3 senses acoustic images. Furthermore, "-" shown in FIG. 10 indicates that the user 3 does not sense any acoustic image. As is clear from FIG. 10, the greater X is, the more leftward the position that the user 3 senses an acoustic image. That is, the greater an output level of the left speaker 2*a* is with respect to the right speaker 2*b*, the greater a level difference between an output of the left speaker 2*a* and the right speaker 2*b* becomes. Therefore, it has been recognized that the user 3 senses an acoustic image at a more leftward position. In other words, the more the phase θ is delayed, the more greatly the output timing of the left speaker 2*a* is delayed from that of the right speaker 2*b*. Therefore, it has been recognized that the user 3 senses an acoustic image at a more rightward position. This can be recognized from a response result obtained when X=0.

From the response results shown in FIG. 10, even in the case where a phase θ is not delayed (θ=0), for example, an acoustic image can be localized within a range tilted to the left and right by approximately 30 degrees, by only providing an output level difference of approximately 10 dB. This experimental result indicates that in the acoustic reproduction using two speakers, the left-right localization positions of the acoustic images can be controlled by using a level difference or time difference between the two speakers. Therefore, in the configuration shown in FIG. 2, an appropriate level difference may be given to the left-speaker-level adjusting section 412*a* and the right-speaker-level adjusting section 412*b* such that an acoustic image is localized at a predetermined position in the left-right direction. That is, the left-speaker-level adjusting section 412*a* adjusts an amplitude level of an acoustic signal, which is outputted from the amplitude characteristic adjusting section 411, to a constant level by using a first adjustment value, regardless of frequency. The right-speaker-level adjusting section 412*b* adjusts an amplitude level of an acoustic signal, which is outputted from the amplitude characteristic adjusting section 411, to a constant level by using a second adjustment value, regardless of frequency. A level difference between the first adjustment value and the second adjustment value may be set so as to be a level difference obtained when an acoustic image is localized at a predetermined position in the left-right direction.

Next, a process executed on a low-pass acoustic signal outputted from the low-pass section 410*a* will be described. In FIG. 2, a low-pass acoustic signal outputted from the low-pass section 410*a* is inputted to the left amplitude phase characteristic adjusting section 413*a* and the right amplitude phase characteristic adjusting section 413*b*. The left amplitude phase characteristic adjusting section 413*a* and the right amplitude phase characteristic adjusting section 413*b* are usually realized by an FIR type filter. The left amplitude phase characteristic adjusting section 413*a* and the right amplitude phase characteristic adjusting section 413*b* adjust the amplitude frequency characteristic and phase frequency characteristic of the low-pass acoustic signal such that an acoustic image is localized at a predetermined position. In the adder 414*a*, the low-pass acoustic signal outputted from the left amplitude phase characteristic adjusting section 413*a* is combined with a high-pass acoustic signal outputted from the left-speaker-level adjusting section 412*a*. The signal outputted from the adder 414*a* is inputted to the left speaker 2*a*. In the adder 414*b*, the low-pass acoustic signal outputted from the right amplitude phase characteristic adjusting section 413*b* is combined with a high-pass acoustic signal outputted from the right-speaker-level adjusting section 412*b*. The signal outputted from the adder 414*b* is inputted to the right speaker 2*b*. Hereinafter, a process executed on a low-pass acoustic signal when an acoustic image is localized at a position 120 degrees diagonally to the right-rear of the user 3.

Figure 11:
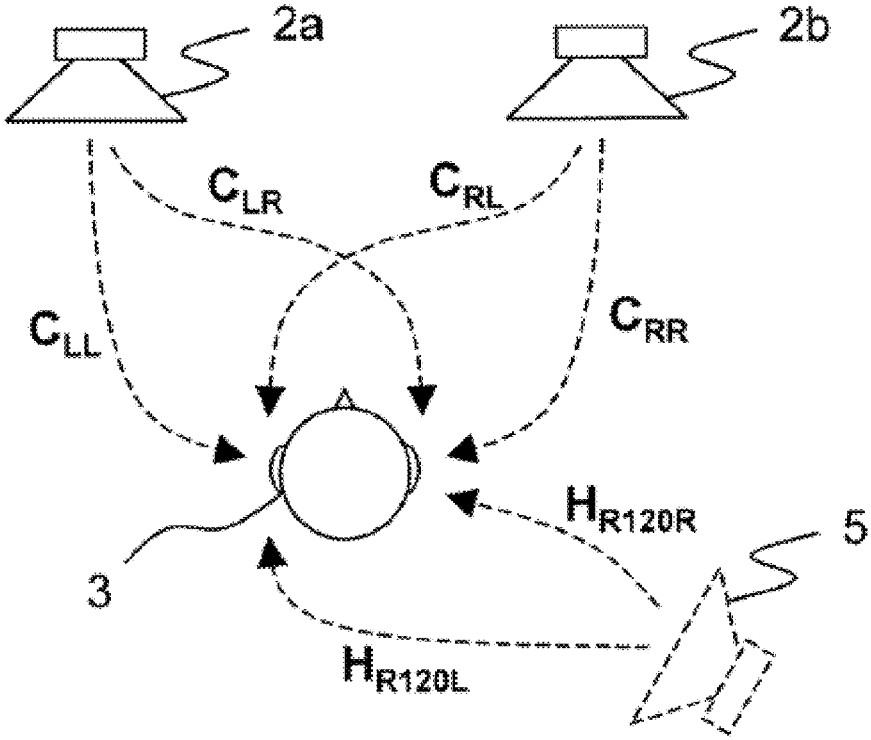
FIG. 11 is a diagram showing acoustic localization targets and acoustic transfer functions.

FIG. 11 is a diagram showing acoustic localization targets and acoustic transfer functions. The target acoustic image 5 indicates a predetermined position at which an acoustic image should be localized, i.e., a position 120 degrees diagonally to the right-rear of the user in FIG. 11. Note that an acoustic transfer function from the target acoustic image 5 to the left ear of the user 3 is denoted as $H_{R120L}$, and an acoustic transfer function from a target acoustic image 5 to the right ear of the user 3 is denoted as $H_{R120R}$. Furthermore, an acoustic transfer path from the left speaker 2*a* to the left ear of the user 3 is denoted as $C_{LL}$, and an acoustic transfer path from the left speaker 2*a* to the right ear of the user 3 is denoted as $C_{LR}$, an acoustic transfer path from the right speaker 2*b* to the right ear of the user 3 is denoted as $C_{RR}$, and an acoustic transfer path from the right speaker 2*b* from the left ear of the user 3 is denoted as $C_{RL}$. Furthermore, a transfer function of the left amplitude phase characteristic adjusting section 413*a* is denoted as $G_L$, and a transfer function of the right amplitude phase characteristic adjusting section 413*b* denoted as $G_R$. In this case, when the following equation is satisfied, an acoustic image is localized at the target acoustic image 5.

[Equation 1]

$$\begin{bmatrix} C_{LL} & C_{RL} \\ C_{LR} & C_{RR} \end{bmatrix} \begin{bmatrix} G_L \\ G_R \end{bmatrix} = \begin{bmatrix} H_{R120L} \\ H_{R120R} \end{bmatrix} \tag{1}$$

The following equation is obtained by modifying the equation (1).

[Equation 2]

$$\begin{bmatrix} G_L \\ G_R \end{bmatrix} = \begin{bmatrix} C_{LL} & C_{RL} \\ C_{LR} & C_{RR} \end{bmatrix}^{-1} \begin{bmatrix} H_{R120L} \\ H_{R120R} \end{bmatrix} \tag{2}$$

If $G_L$ of the left amplitude phase characteristic adjusting section 413*a* and $G_R$ of the right amplitude phase characteristic adjusting section 413*b* are designed as shown in the equation (2), an acoustic image of the low-pass acoustic signal can be localized at the target acoustic image 5. As described above, the left amplitude phase characteristic adjusting section 413*a* and the right amplitude phase characteristic adjusting section 413*b* adjust the amplitude frequency characteristic and phase frequency characteristic of an inputted low-pass acoustic signal such that an acoustic image is localized at a predetermined position. Note that the process of adjusting the phase frequency characteristic corresponds to the crosstalk cancellation process. Therefore, the high-precision control can be performed by the left amplitude phase characteristic adjusting section 413*a* and the right amplitude phase characteristic adjusting section 413*b*.

There is concern that the crosstalk cancellation effect deteriorates due to different listening positions. However, since a wavelength of an acoustic wave is long in the low frequency band, the crosstalk cancellation effect hardly deteriorates due to the adjustment of the phase frequency characteristic, which corresponds to the crosstalk cancellation process. That is, the acoustic image localization effect rarely deteriorates in the low frequency band. Note that an experimental study has conducted on a crossover frequency for separating the low frequency band in which the crosstalk cancellation process is performed from the high frequency band in which the crosstalk cancellation process is not performed. As a result, in order to obtain an appropriate acoustic image localization effect, it is discovered that the crossover frequency is at least set to be 4 kHz or less.

Note that each of the acoustic image localization apparatuses 41*b* to 41*e* executes the same process as that executed by the acoustic image localization apparatus 41*a* except that a channel of an acoustic signal inputted thereto and a position at which an acoustic image is localized are different. Therefore, any detailed descriptions of the acoustic localization apparatuses 41*b* to 41*e* will be omitted.

As described above, in the acoustic image localization apparatus according to the present embodiment, a predetermined process is executed on an acoustic signal such that an acoustic image is localized at a predetermined position on a space as viewed from the user 3, and sound generated based on the acoustic signal in which the predetermined process has been executed is outputted from the left speaker 2*a* and the right speaker 2*b*. More specifically, the amplitude characteristic adjusting section 411 adjusts a position in the front-rear direction of the predetermined position of the high-pass acoustic signal, and the left-speaker-level adjusting section 412*a* and the right-speaker-level adjusting section 412*b* adjust the left-right position of the predetermined position of the high-pass acoustic signal. Furthermore, the left amplitude phase characteristic adjusting section 413*a* and the right amplitude phase characteristic adjusting section 413*b* process a low-pass acoustic signal such that an acoustic image is localized at the predetermined position. Then, in the acoustic image localization apparatus according to the present embodiment, the low-pass acoustic signal and the high-pass acoustic signal, both have been adjusted by these processes, are added together so as to be outputted to the speaker. Thus, the user 3 senses a high-quality acoustic image in all frequency bands.

Note that an amplitude frequency characteristic of the high-pass acoustic signal adjusted by the process according to the present embodiment is a characteristic to which a target characteristic (an acoustic transfer function from the median plain to each ear) adjusted by the amplitude characteristic adjusting section 411 and a level difference generated by the left-speaker-level adjusting section 412*a* and the right-speaker-level adjusting section 412*b* are added. That is, the amplitude frequency characteristic of an acoustic signal adjusted by the process according to the present embodiment does not faithfully reproduce an acoustic transfer function from the predetermined position to each ear of the user 3. However, the subjective experiment reveals that even in the case where the acoustic transfer function from a predetermined position to each ear of the user 3 is not faithfully reproduced, the front-rear sensation of an acoustic image is controlled by faithfully reproducing the acoustic transfer function from the median plain to each ear, and the left-right sensation of the acoustic image is controlled by generating the level difference, thereby obtaining a desired acoustic image localization effect.

Figure 34:
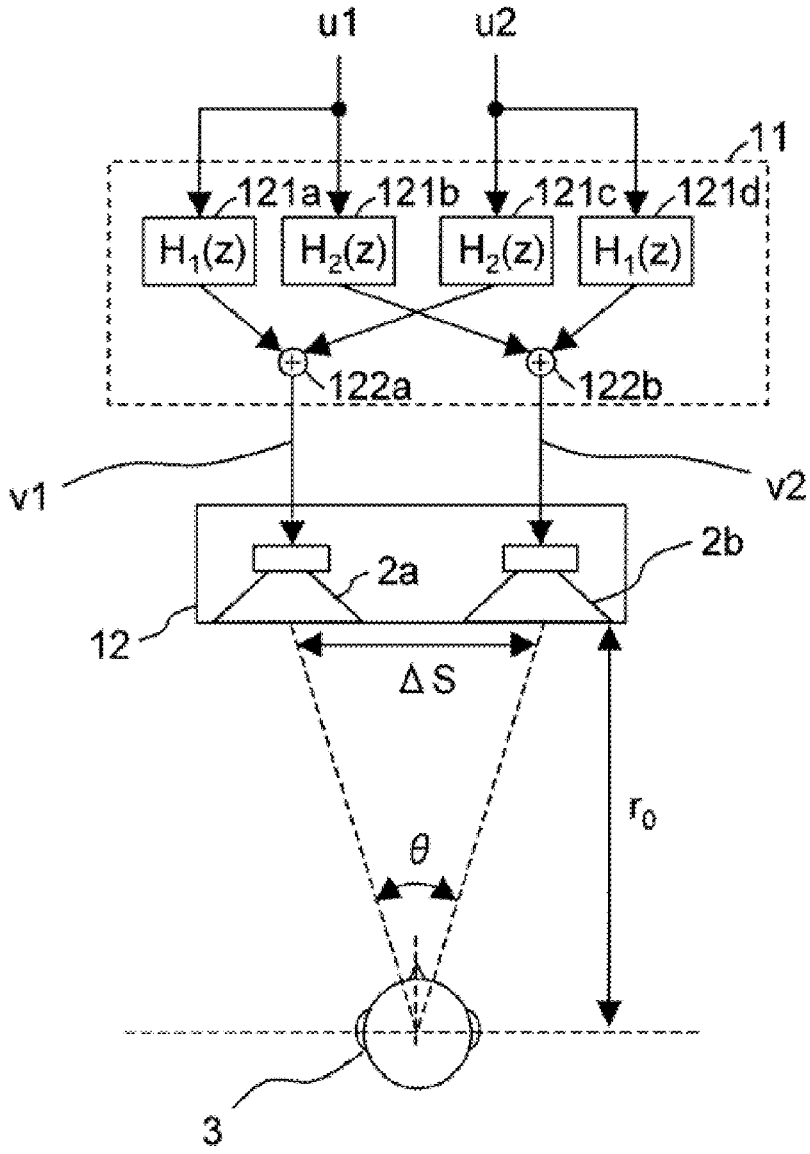
PRIOR ART FIG. 34
FIG. 34 is a diagram showing a configuration of a conventional acoustic reproduction system which provides the user with an acoustic image localization effect within a wide listening range.
Figure 35:
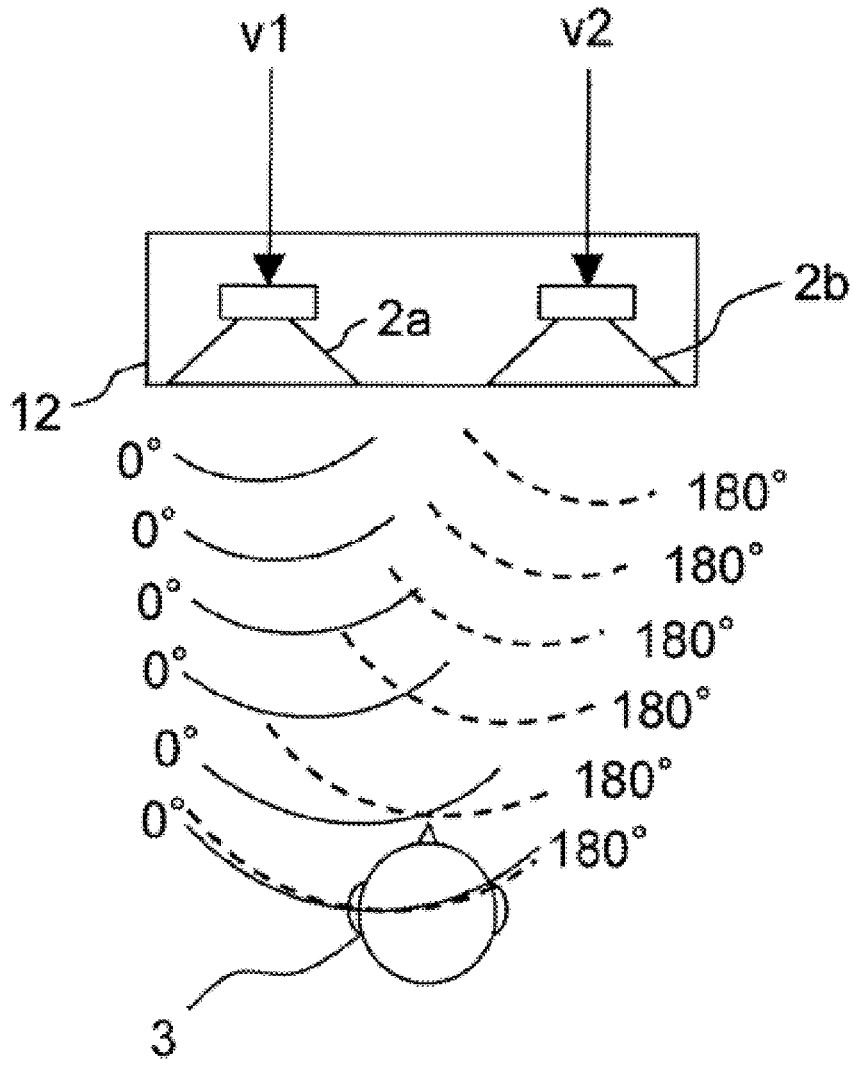
PRIOR ART FIG. 35
FIG. 35 is a diagram schematically showing wavefronts of reproduction sound and cancel sound.

Conventionally, as described above, the amplitude frequency characteristic of an acoustic transfer function from a predetermined position at which an acoustic image should be localized to each ear has been considered as key factors for the acoustic image localization. Thus, in the prior art shown in FIG. 32 and FIG. 34, adopted, as a control method, is a method of faithfully reproducing the amplitude frequency characteristic of an acoustic transfer function from the predetermined position at which an acoustic image should be localized to each ear. Thus, in the prior art, the crosstalk cancellation process is performed. However, the amplitude frequency characteristic in the high frequency band exerts a great influence on an acoustic image localization effect. Therefore, in the prior art, due to the crosstalk cancellation process, a listening range in which an acoustic image localization effect can be obtained needs to be extremely narrower, and an arrangement positions of the speakers are limited in order to solve this problem.

In contrast, in the acoustic image localization apparatus according to the present embodiment, in order to localize an acoustic image at a predetermined position, in a high-pass acoustic signal, the amplitude characteristic adjusting section 411 adjusts a position in the front-rear direction of the predetermined position, and the left-speaker-level adjusting section 412*a* and the right-speaker-level adjusting section 412*b* adjust a position in the left-right-direction of the predetermined position. That is, in the acoustic image localization apparatus according to the present embodiment, in the high frequency band which exerts a great influence on the acoustic image localization effect, a target characteristic adjusted by the amplitude characteristic adjusting section 411, i.e., an amplitude frequency characteristic of an acoustic transfer function from the median plain to each ear is faithfully reproduced without performing the crosstalk cancellation process. Thus, in the acoustic image localization apparatus according to the present embodiment, it is unnecessary to perform the crosstalk cancellation process in order to localize an acoustic image at the predetermined position, thereby further extending a listening range in which the acoustic image localization effect can be obtained as compared to the prior art.

As described above, according to the present embodiment, in the high frequency band which is important for the acoustic image localization, the crosstalk cancellation process of canceling the crosstalk is not performed by adjusting a phase frequency characteristic. Therefore, it becomes possible to extend a listening range in which the acoustic image localization effect can be obtained as compared to the prior art without limiting an arrangement position of the speaker.

Figure 12:
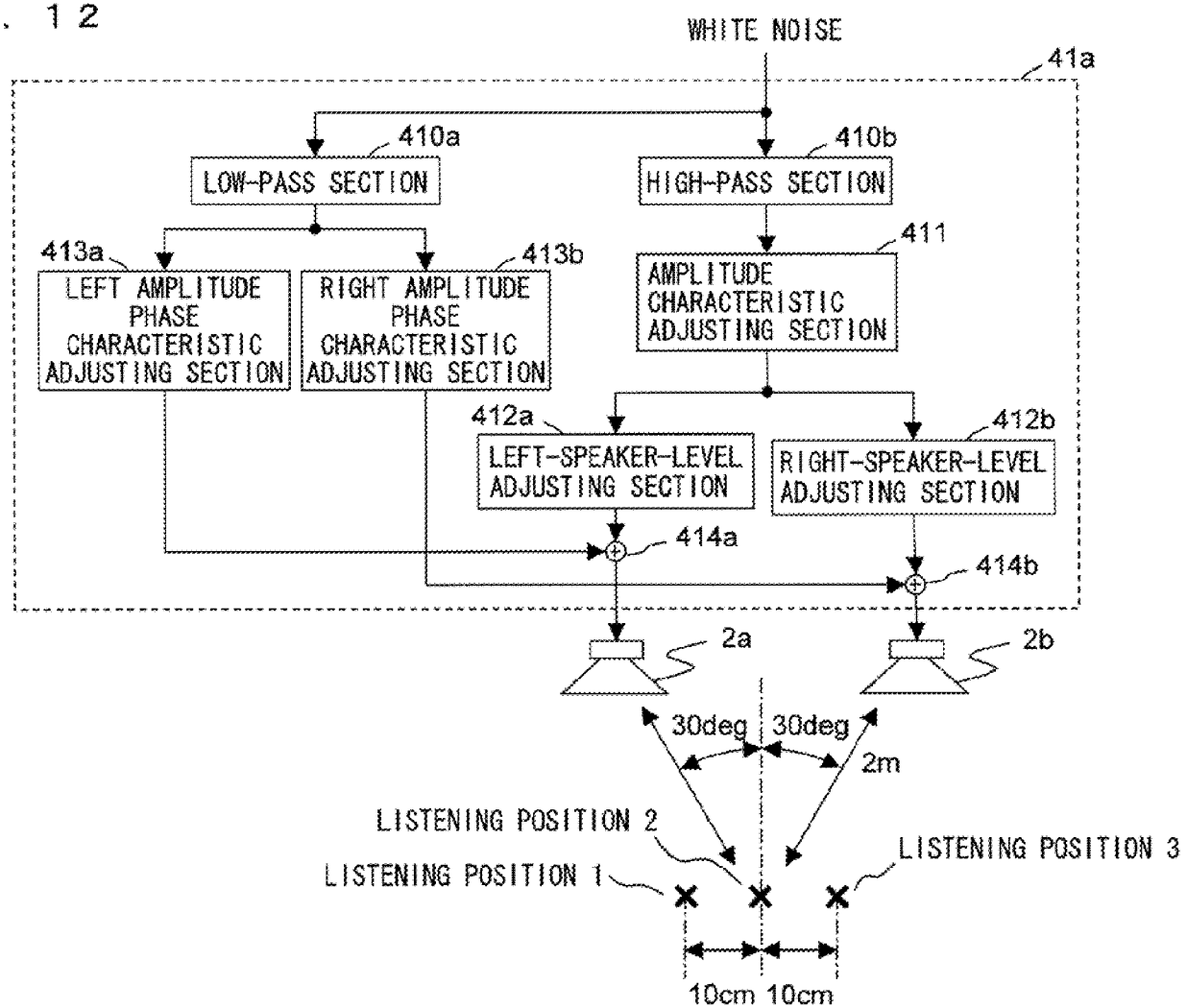
FIG. 12 is a diagram showing positions obtained by measuring an acoustic transfer function.
Figure 13:
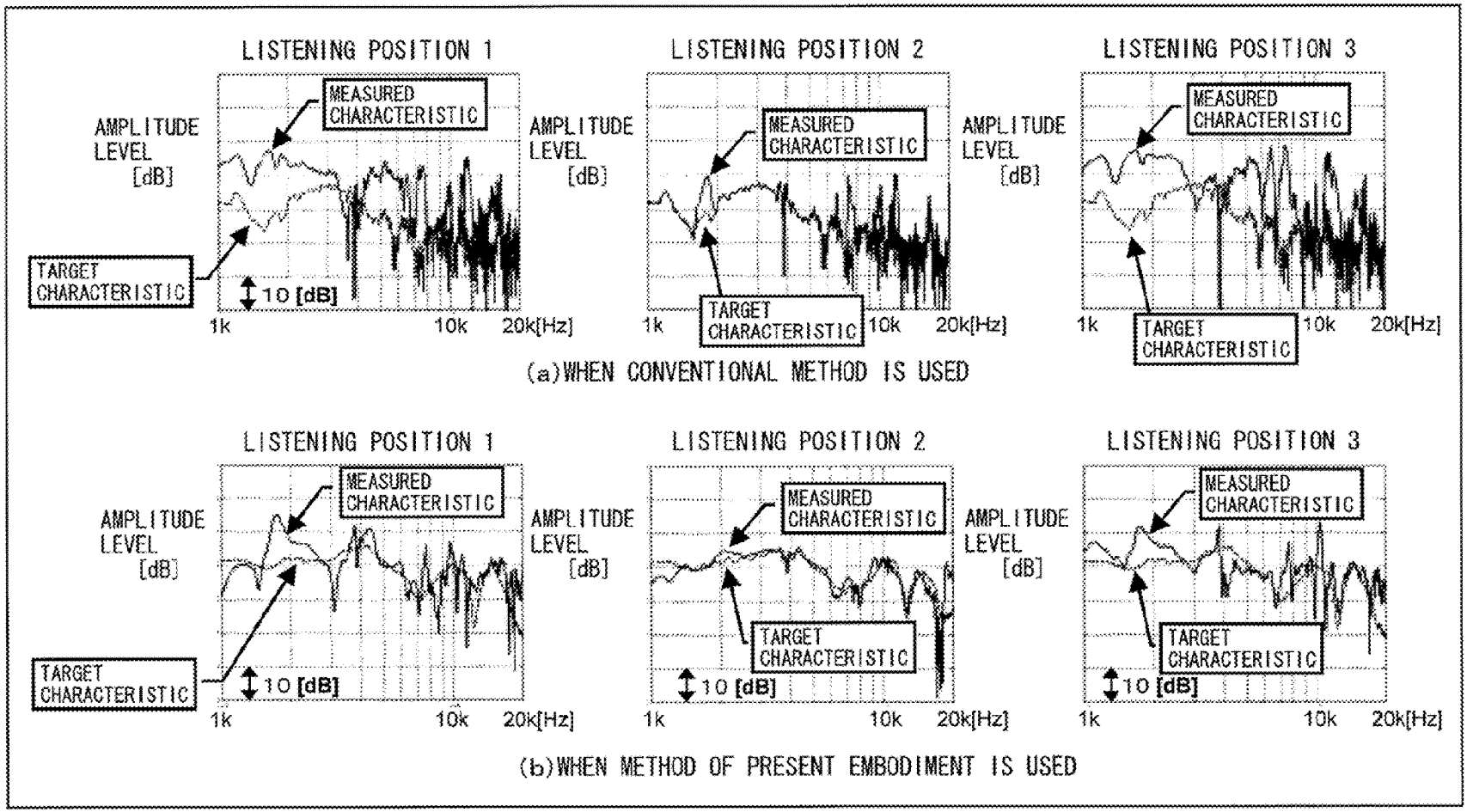
FIG. 13 is a diagram showing results measured from a measurement position shown in FIG. 12.
Figure 32:
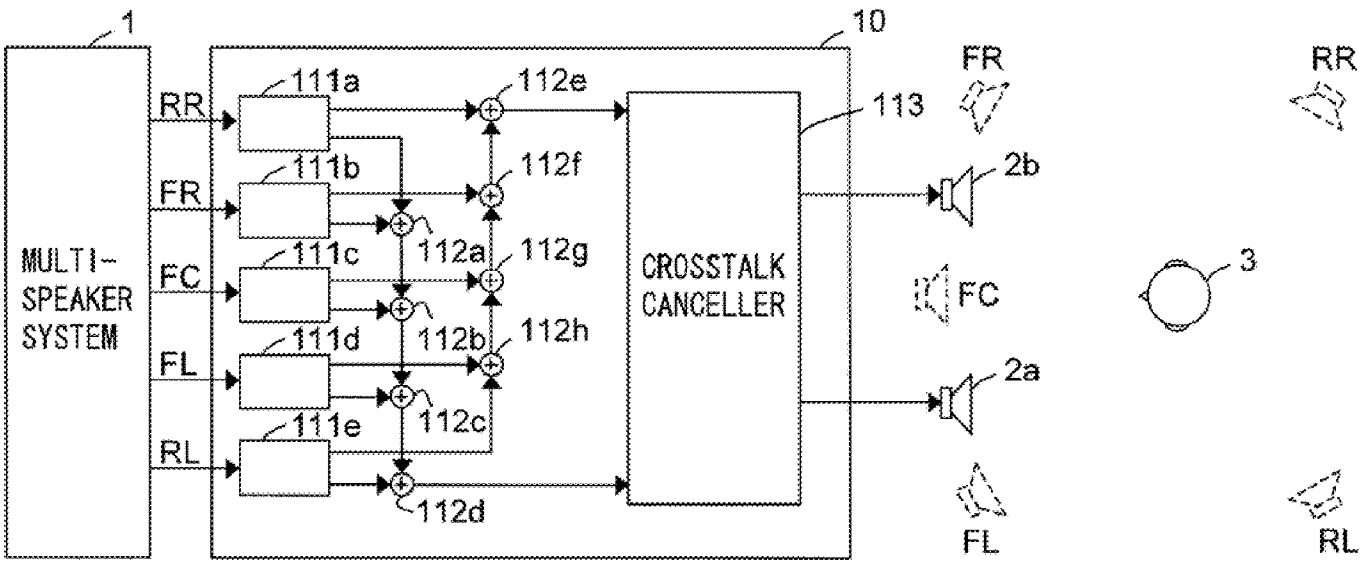
FIG. 32 is a diagram showing a configuration of a conventional acoustic image localization system 10.
Figure 33:
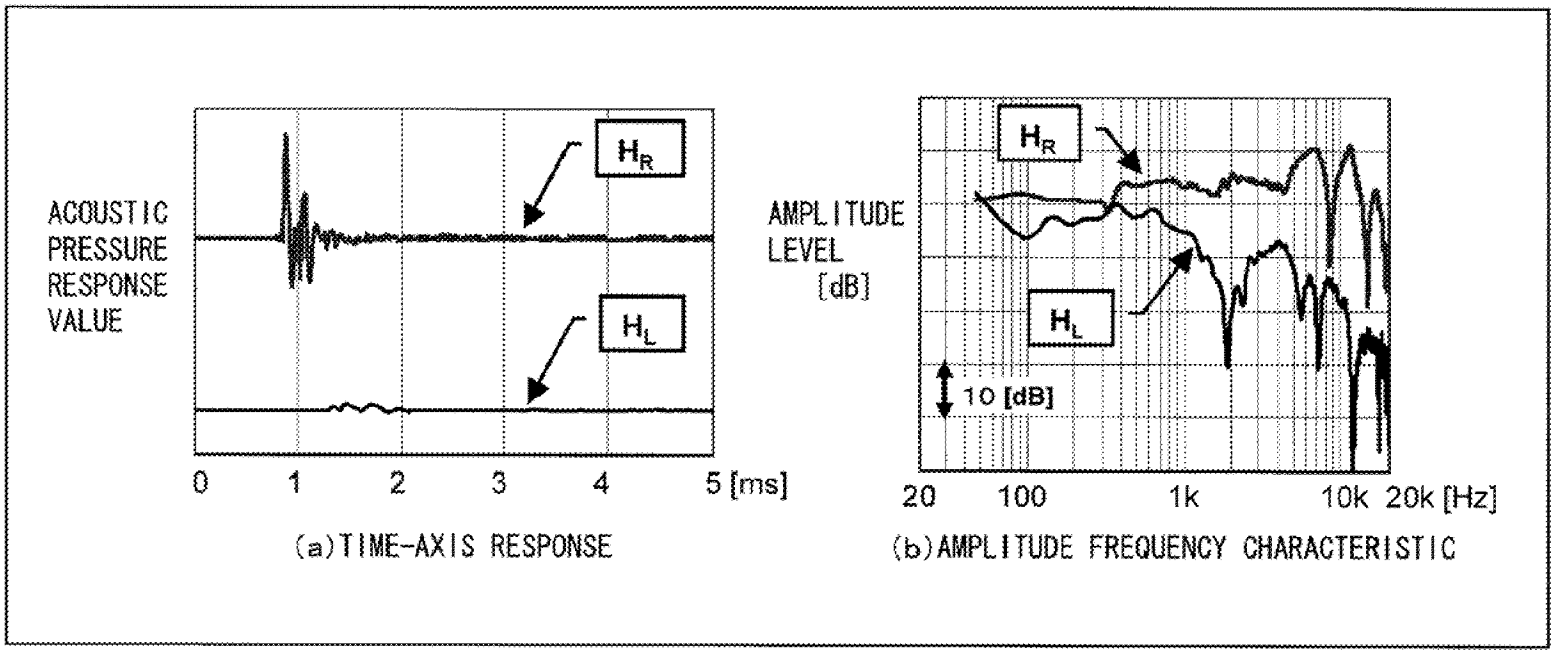
PRIOR ART FIG. 33
FIG. 33 is a diagram showing a time-axis response of an acoustic transfer function from the right surround speaker RR to the user 3 and an amplitude frequency characteristic thereof.

Hereinafter, a control error generated by different listening positions is quantitatively verified by using the conventional acoustic image localization system 10 shown in FIG. 32 and the acoustic image localization apparatus 41*a* according to the present embodiment shown in FIG. 2. FIG. 12 is a diagram showing positions obtained by measuring an acoustic transfer function. It is assumed that an acoustic image is localized at a position of the right surround speaker RR, which is a position 120 degrees diagonally to the right-rear of the user 3, and a listening position determined at the time of designing is a "listening position 2". Furthermore, a position shifted to the left by 10 cm from the "listening position 2" is a "listening position 1", and a position shifted to the right by 10 cm from the "listening position 2" is a "listening position 3". Furthermore, the left speaker 2*a* is disposed at a position rotated to the left by 30 degrees from the facing direction of the "listening position 2". The left speaker 2*a* is at a distance of 2*m* from the "listening position 2". Still furthermore, the right speaker 2*b* is disposed at a position rotated to the right by 30 degrees from the facing direction of the "listening position 2". The right speaker 2*b* is at a distance of 2*m*, from "the listening position 2". FIG. 13 shows results obtained by measuring an acoustic transfer function at each listening position when white noise is an input signal, and the crossover frequency of the low-pass section 410*a* and the high-pass section 410*b* is 1 kHz. In FIG. 13, a measured characteristic which is an amplitude frequency characteristic measured at each listening position is an amplitude frequency characteristic of an acoustic transfer function of sound to be actually arrived at the left ear of the user 3. FIG. 13(*a*) shows target characteristics and measured characteristics obtained when the conventional method is used. FIG. 13(*b*) also shows target characteristics and measured characteristics obtained when a method of present embodiment is used. Note that the target characteristic shown in FIG. 13(*a*) indicates an amplitude frequency characteristic of an acoustic transfer function from a position 120 degrees diagonally to the right-rear of the user 3, at which an acoustic image should be localized to each ear. The target characteristic shown in FIG. 13(*b*) indicates an amplitude frequency characteristic of an acoustic transfer function from a position, on the median plain, 180 degrees from the user's facing direction, that is a position directly behind the user 3. As is clear from FIG. 13, the measured characteristic becomes closer to the target characteristic even if either of the methods is used at the listening position 2, i.e., a listening position which has been determined at the time of designing. However, it is clear that at the listening positions 1 and 3, a control error is greater in the prior art shown in FIG. 13(*a*). That is, in the prior art shown in FIG. 13(*a*), the acoustic image localization effect is greatly damaged at the listening positions 1 and 3. As described above, this is because in the prior art, a phase frequency characteristic of an acoustic signal is adjusted in order to cancel the crosstalk.

Figure 14:
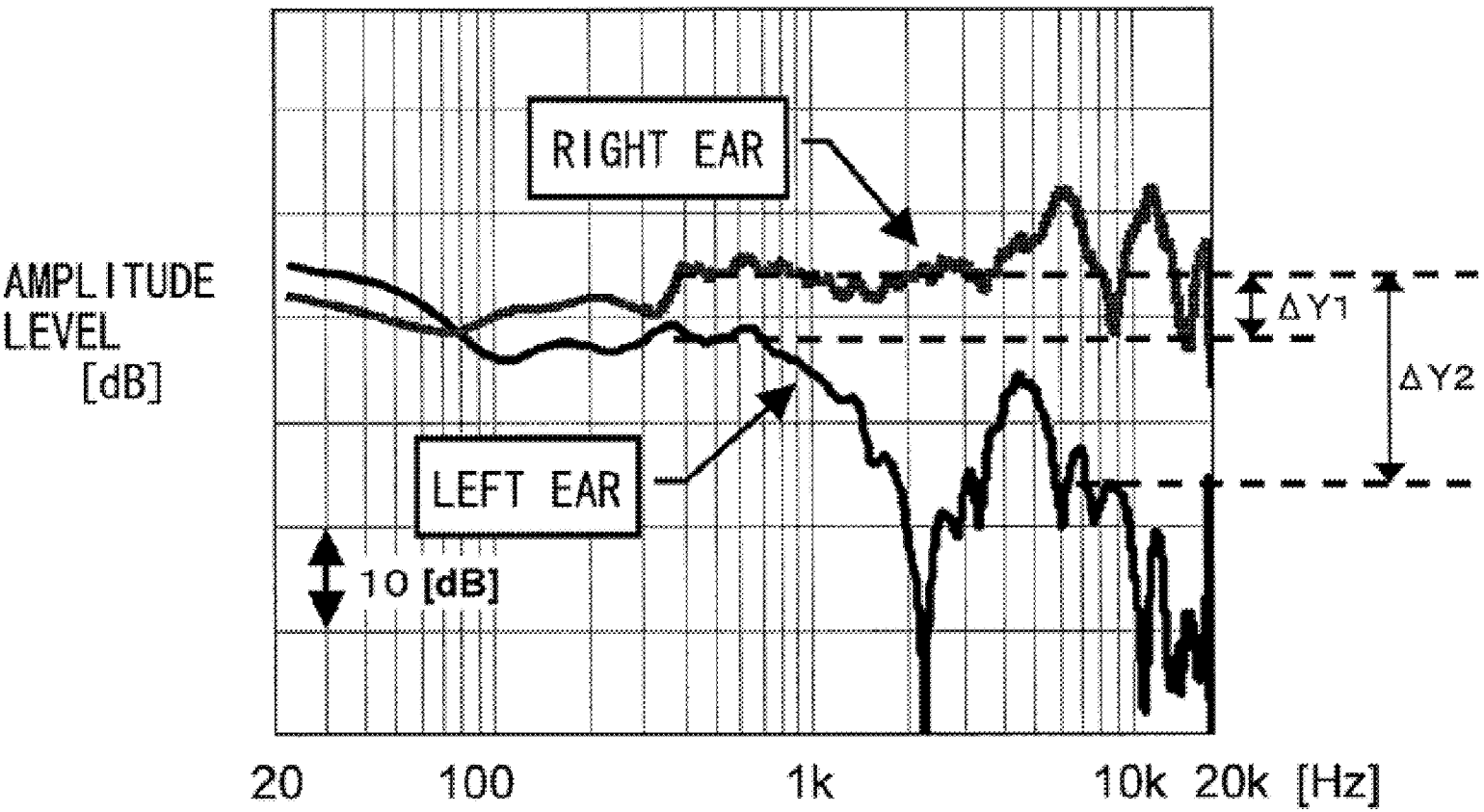
FIG. 14 is a diagram showing the amplitude frequency characteristics of the acoustic transfer functions obtained when an acoustic image is localized at a position 120 degrees diagonally to the right-rear of the user 3.

Note that in the configuration shown in FIG. 2, the left-speaker-level adjusting section 412*a* and the right-speaker-level adjusting section 412*b* adjust an amplitude level of an inputted acoustic signal in a uniform manner, regardless of frequency. However, the present invention is not limited thereto. Each of the left-speaker-level adjusting section 412*a* and the right-speaker-level adjusting section 412*b* may adjust an amplitude level of an inputted acoustic signal by using an adjustment value which is different for each predetermined frequency band. Note that the predetermined frequency band is a band including a notch characteristic and a peak characteristic which are the key factors for the acoustic image localization. That is, an amplitude level is adjusted by using an adjustment value which is different for each predetermined frequency band, whereby these characteristics are not to be changed. For example, when an acoustic image is localized at a position 120 degrees diagonally to the right-rear of the user 3, an amplitude frequency characteristic indicated by an acoustic transfer function from the position to the left ear of the user 3 and an amplitude frequency characteristic indicated by an acoustic transfer function from the position to the right ear of the user 3 are both shown in FIG. 14. FIG. 14 is a diagram showing the amplitude frequency characteristics of the acoustic transfer functions obtained when an acoustic image is localized at a position 120 degrees diagonally to the right-rear of the user 3. In FIG. 14, in a band in the vicinity of 1 kHz including the notch characteristic and peak characteristic, an amplitude level of the left ear is greater than an amplitude level of the right ear by ΔY1. That is, the level difference is ΔY1 in the vicinity of 1 kHz. Also, in a band in the vicinity of 10 kHz including the notch characteristic and peak characteristic, the level difference is ΔY2. An adjustment value which is different for each predetermined frequency band is set in each of the left-speaker-level adjusting section 412*a* and the right-speaker-level adjusting section 412*b*, in order to reproduce the level difference therebetween in such a frequency band. In practical, an appropriate equalizer may be designed in each of the left-speaker-level adjusting section 412*a* and the right-speaker-level adjusting section 412*b* in order to reproduce the level difference in such a frequency band. In this case, a process coefficient used in the amplitude characteristic adjusting section 411 is embedded in each of the left-speaker-level adjusting section 412*a* and the right-speaker-level adjusting section 412*b*, and the amplitude characteristic adjusting section 411 may be omitted. With such a configuration, it becomes possible to reduce calculation amount of the acoustic image localization apparatus 41*a* by a calculation amount of the amplitude characteristic adjusting section 411.

Figure 15:
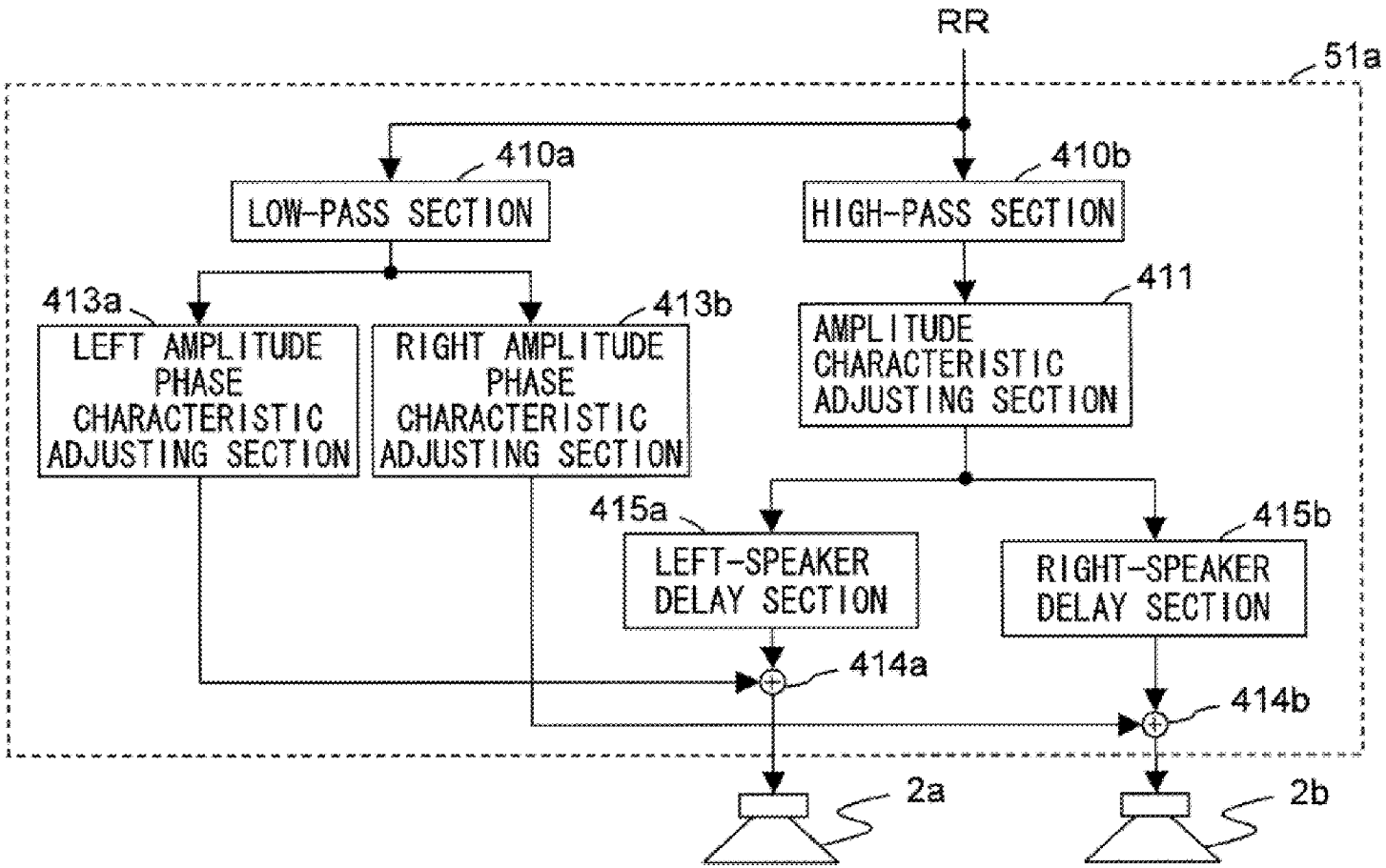
FIG. 15 is a diagram showing a configuration of an acoustic image localization apparatus 51*a*.

Note that in the configuration shown in FIG. 2, a level of an acoustic signal is adjusted by using the left-speaker-level adjusting section 412*a* and the right-speaker-level adjusting section 412*b* in order to control the left-right sensation of the acoustic image. However, the present invention is not limited thereto. As described in FIG. 10, other than adjusting a difference between output levels of the speakers, it is possible to change a localization position in the left-right direction of an acoustic image by adjusting a time difference (phase difference) Therefore, the acoustic image localization apparatus 41*a* may have a configuration of an acoustic image localization apparatus 51*a* shown in FIG. 15. FIG. 15 is a diagram showing a configuration of the acoustic image localization apparatus 51*a*. In FIG. 15, the left-speaker delay section 415*a* is provided to so as to correspond to the left speaker 2*a*. The right-speaker delay section 415*b* is provided so as to correspond to the right speaker 2*b*. The left-speaker delay section 415*a* delays an output timing of a high-pass acoustic signal outputted from the amplitude characteristic adjusting section 411 to a first timing, and the delayed signal is outputted to the left speaker 2*a* as a left-ear acoustic signal. The right-speaker delay section 415*b* delays an output timing of a high-pass acoustic signal outputted from the amplitude characteristic adjusting section 411 to a second timing, and the delayed signal is outputted to the right speaker 2*b* as a right-ear acoustic signal. That is, each of the left-speaker delay section 415*a* and the right-speaker delay section 415*b* adjusts the phase frequency characteristic of the high-pass acoustic signal outputted from the amplitude characteristic adjusting section 411. As described above, each of the left-speaker delay section 415*a* and the right-speaker delay section 415*b* corresponds to phase characteristic adjusting means of the present invention. A time difference between the first timing and the second timing may be set so as to be a time difference obtained when an acoustic image is localized at a predetermined position in the left-right direction. With the configuration shown in the acoustic image localization apparatus 51*a*, an acoustic image can be localized at a position within a wider range of the left-right direction. Note that the above time difference is used only when a phase difference between the left-ear acoustic signal outputted from the left-speaker delay section 415*a* and the right-ear acoustic signal outputted from the right-speaker delay section 415*b* is less than 180 degrees. That is, the above time difference is used in a range in which when a phase of the left-ear acoustic signal is not opposite to a phase of the right-ear acoustic signal, which is a range in which an amplitude frequency characteristic of each sound arrived at the right ear or the left ear of the user 3 remains unchanged.

Note that the left-speaker delay section 415*a* and the right-speaker delay section 415*b* shown in FIG. 15 may be additionally provided in the configuration shown in FIG. 2. In this case, an output of the left-speaker-level adjusting section 412*a* is connected to an input of the left-speaker delay section 415*a*, and an output of the right-speaker-level adjusting section 412*b* is connected to an input of the right-speaker delay section 415*b*.

Figure 16:
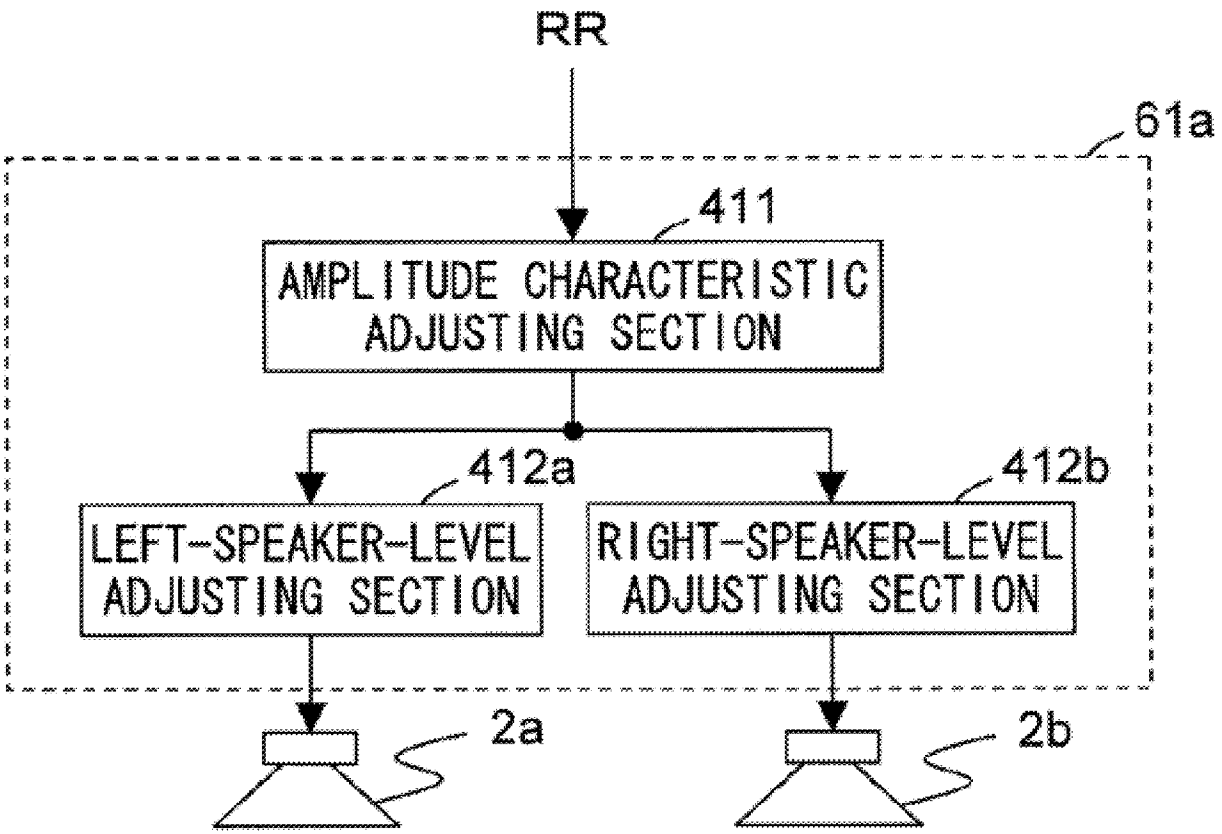
FIG. 16 is a diagram showing a configuration of an acoustic image localization apparatus 61*a*.

Note that in the configuration shown in FIG. 2, an inputted acoustic signal is separated into a low-pass acoustic signal and a high-pass acoustic signal, and an individual process is performed on each of the signals. However, the present invention is not limited thereto. The amplitude characteristic adjusting section 411 may adjust a position in the front-rear direction of the predetermined position of both low-pass and high-pass acoustic signals, and the left-speaker-level adjusting section 412*a* and the right-speaker-level adjusting section 412*b* may adjust a position in the left-right direction of the predetermined position of both low-pass and high-pass acoustic signals. In this case, a configuration of an acoustic image localization apparatus 61*a* is shown in FIG. 16. In FIG. 16, the same components as those shown in FIG. 2 will be denoted by the same reference numerals. In FIG. 16, an acoustic signal inputted to the amplitude characteristic adjusting section 411 is a right surround channel signal RR. Even when the acoustic image localization apparatus 61*a* shown in FIG. 16 is used, 3 phase frequency characteristic is not adjusted for canceling the crosstalk. Thus, it becomes possible to extend a listening range in which a desirable acoustic image localization effect can be obtained without limiting an arrangement position of a speaker. Note that in the acoustic image localization apparatus 61*a*, a process of canceling the crosstalk is not performed on a low-pass acoustic signal, and therefore the acoustic image localization effect slightly deteriorates as compared to the configuration shown in FIG. 2. However, in the acoustic image localization apparatus 61*a*, the left amplitude phase characteristic adjusting section 413*a* and the right amplitude phase characteristic adjusting section 413*b* shown in FIG. 2 can be omitted. Thus, the signal processing calculation amount can be accordingly reduced.

Note that in the configuration shown in FIG. 2, the left amplitude phase characteristic adjusting section 413*a* and the right amplitude phase characteristic adjusting section 413*b* are realized as an FIR type filter whose signal processing calculation amount is large. In the case of the acoustic image localization system 4 shown in FIG. 1, it is extremely likely that the left amplitude phase characteristic adjusting section 413*a* and the right amplitude phase characteristic adjusting section 413*b* are realized as an FIR filter in each of the acoustic image localization apparatuses 41*a*, 41*b*, 41*d* and 41*e*, which process acoustic signals except for the center channel signal FC. Thus, tap lengths of the FIR type filters may be different depending on the channels. For example, similarly to the left speaker 2*a* and the right speaker 2*b* which perform acoustic reproduction, the left front speaker FL and the right front speaker FR are located in front of the user 3. That is, considering a distance between a position at which an acoustic image should be localized and the left speaker 2*a* or the right speaker 2*b*, the shortest distance is a distance between the left front speaker FL and the left speaker 2*a* or a distance between the right front speaker FR and the right speaker 2*b*. Therefore, even if the acoustic image localization control of each of the left front speaker FL and the right front speaker FR generates some errors, an acoustic image is localized in front of the user 3 and therefore the user rarely has awkward feelings. Therefore, some control errors are allowed in the left amplitude phase characteristic adjusting section 413*a* and the right amplitude phase characteristic adjusting section 413*b* which process the left front channel signal FL and the right front channel signal FR, respectively. Therefore, a tap length of each of the left amplitude phase characteristic adjusting section 413*a* and the right amplitude phase characteristic adjusting section 413*b* included in the acoustic image localization apparatuses 41*b* and 41*d* can be shorter than that of the left amplitude phase characteristic adjusting section 413*a* and the right amplitude phase characteristic adjusting section 413*b* which process other channel signals. Therefore, it becomes possible to reduce the signal processing calculation amount of the left amplitude phase characteristic adjusting section 413*a* and the right amplitude phase characteristic adjusting section 413*b* included in the acoustic image localization apparatuses 41*b* and 41*d*.

Figure 17:
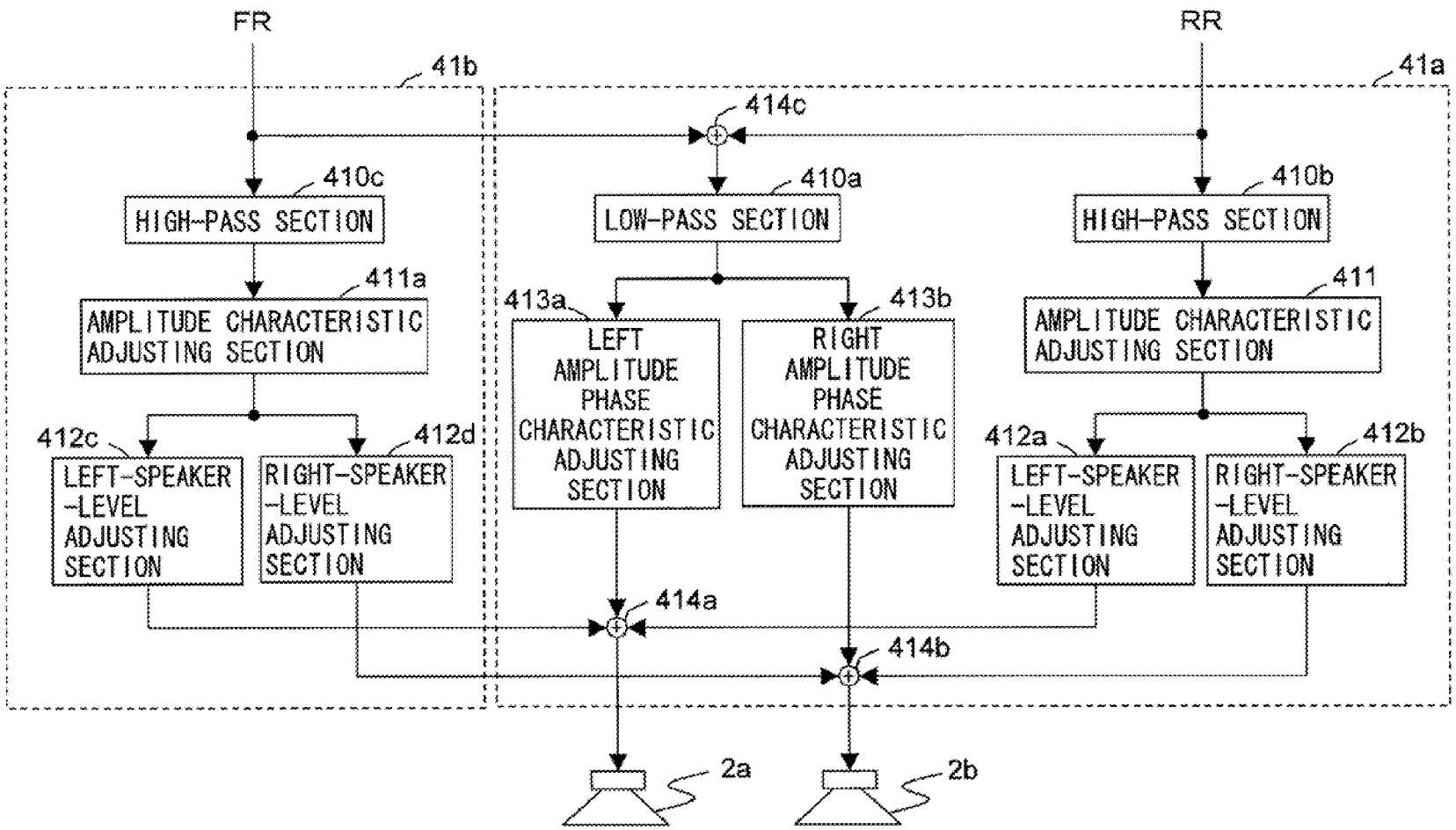
FIG. 17 is a diagram showing a configuration obtained when the acoustic image localization apparatuses 41*a* and 41*b* perform the same process on a low-pass acoustic signal.

Furthermore, in order to reduce the signal processing calculation amount, among the acoustic image localization apparatuses 41*a* to 41*e* constituting the acoustic image localization system 4, any of the two acoustic image localization apparatuses may perform the same process on a low-pass acoustic signal. FIG. 17 shows a configuration of the case where the acoustic image localization apparatus 41*a* for processing the right surround channel signal RR and the acoustic image localization apparatus 41*b* for processing the right front channel signal FR perform the same process on a low-pass acoustic signal. In the configuration shown in FIG. 17, the acoustic image localization apparatus 41*a* in which an adder 414*c* is additionally provided in the configuration shown in FIG. 2 and the acoustic image localization apparatus 41*b* for processing the right front channel signal FR are combined together. In FIG. 17, the acoustic image localization apparatus 41*b* includes a high-pass section 410*c*, an amplitude characteristic adjusting section 411*a*, a left-speaker-level adjusting section 412*c*, and a right-speaker-level adjusting section 412*d*. In order to localize an acoustic image at a position of the right front speaker FR, in a high-pass acoustic signal of the right front channel signal FR, the amplitude characteristic adjusting section 411*a* controls the front-rear sensation of the acoustic image, and the left-speaker-level adjusting section 412*c* and the right-speaker-level adjusting section 412*d* control the left-right sensation of the acoustic image. In the configuration shown in FIG. 17, the low-pass section 410*a*, the left amplitude phase characteristic adjusting section 413*a* and the right amplitude phase characteristic adjusting section 413*b* can be integrated. Thus, the number of FIR type filters can be reduced, thereby making it possible to further reduce the signal processing calculation amount.

Figure 18:
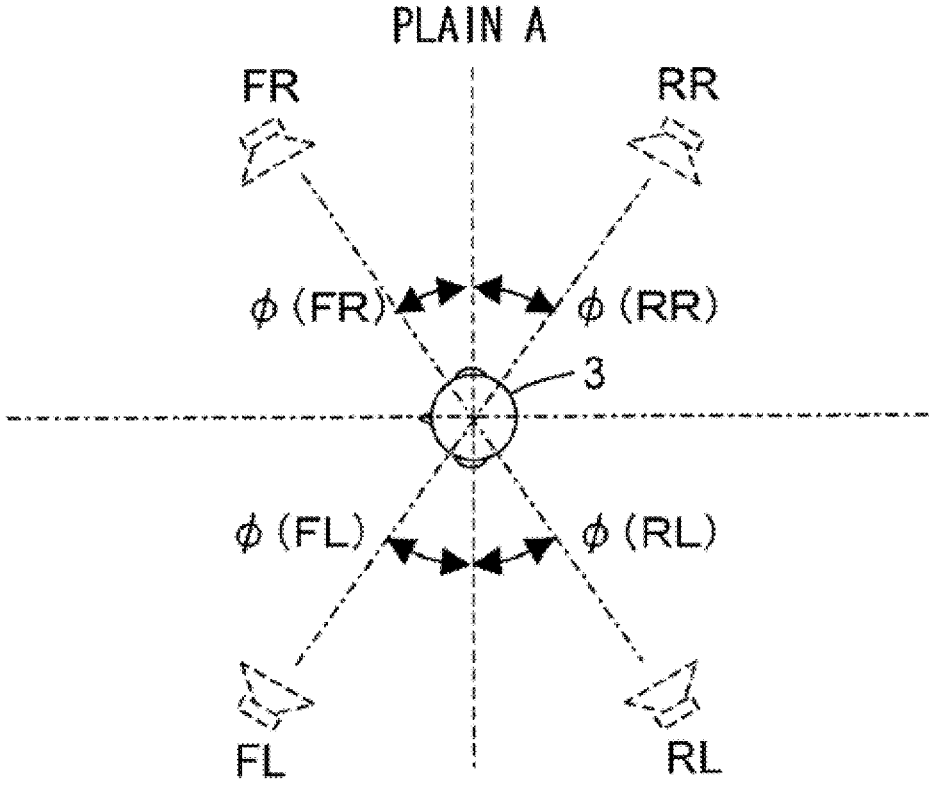
FIG. 18 is a diagram showing positions of a right front speaker FR, a right surround speaker RR, a left front speaker FL and a left surround speaker RL.

Note that in the configuration shown in FIG. 17, when the right front speaker FR and the right surround speaker RR are located so as to be symmetrical with respect to a plain A extending through both ears of the user 3. i.e., when the right front speaker FR and the right surround speaker RR are located such that $\phi(FR)=\phi(RR)$ is satisfied, as shown in FIG. 18, the acoustic localization effect can be maintained even if the same process is performed on a low-pass acoustic signal. Alternatively, in the case where the acoustic image localization apparatuses 41*d* and 41*e* perform the same process on a low-pass acoustic signal, the acoustic localization effect can be maintained when the left front speaker FL and the left surround speaker RL are located so as to be symmetrical with respect to the plain A extending through both ears of the user 3, i.e., when $\phi(FL)=\phi(RL)$ is satisfied, as shown in FIG. 18. The reasons therefor will be described with respect to FIG.

Figure 19:
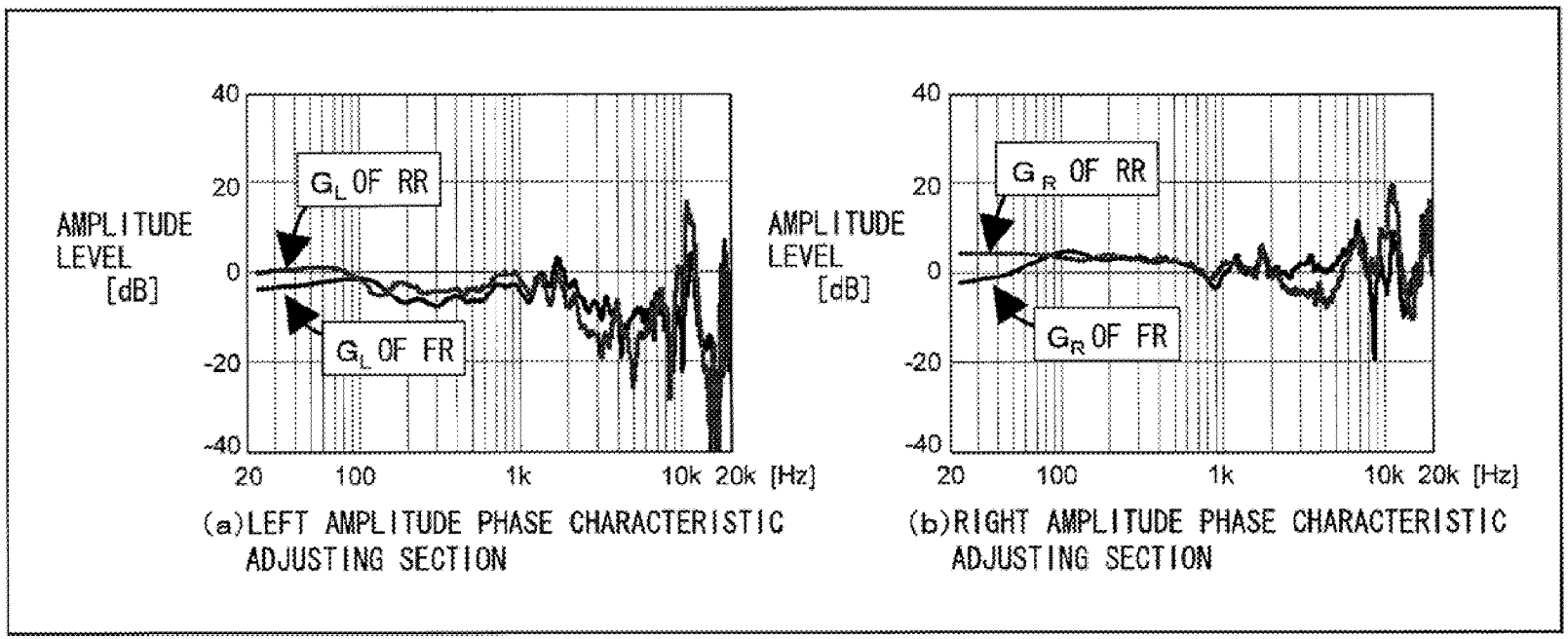
FIG. 19 is a diagram showing amplitude frequency characteristics of transfer functions of the left amplitude phase characteristic adjusting section 413*a* and the right amplitude phase characteristic adjusting section 413*b* in the case where $\phi(FR)=\phi(RR)=30$ degrees.

19. FIG. 19 is a diagram showing an amplitude frequency characteristic of a transfer function $G_L$ of the left amplitude phase characteristic adjusting section 413*a* and an amplitude frequency characteristic of a transfer function $G_R$ of the right amplitude phase characteristic adjusting section 413*b*, when $\phi(FR)=\phi(RR)=30$ degrees is satisfied. FIG. 19 shows the amplitude frequency characteristics in all frequency bands. FIG. 19(*a*) is a diagram showing an amplitude frequency characteristic of a transfer function $G_L$ of the FR and the amplitude frequency characteristic of the transfer function $G_L$ of the RR. FIG. 19(*b*) is a diagram showing the amplitude frequency characteristic of the transfer function $G_R$ of the FR and the amplitude frequency characteristic of the transfer function $G_R$ of the RR. As is clear from FIGS. 19(*a*) and (*b*), in a frequency band lower than 2 kHz, the amplitude frequency characteristic of the FR substantially coincides with that of the RR. This is because a difference between a distance from the right front speaker FR to the left ear and a distance from the right front speaker FR to the right ear is physically equal to a difference between a distance from the right surround speaker RR to the left ear and a distance from the right surround speaker RR to the right ear. Also, although not shown, a phase characteristic of the FR substantially coincides with that of the RR. Therefore, in the configuration shown in FIG. 17, even if the same process is performed on a low-pass acoustic signal, the acoustic image localization effect can be maintained when the right front speaker FR and the right surround speaker RR are located so as to be symmetrical with respect to the plain A extending through the both ears of the user 3 as shown in FIG. 18, and when the crossover frequency is set approximately at 2 kHz.

Note that in the configuration shown in FIG. 2, the left amplitude phase characteristic adjusting section 413*a* and the right amplitude phase characteristic adjusting section 413*b* perform a process on a low-pass acoustic signal. However, the present invention is not limited thereto. In order to further reduce the signal processing calculation amount, either of the left amplitude phase characteristic adjusting section 413*a* or the right amplitude phase characteristic adjusting section 413*b* may be omitted. In this case, since the equation (1) is not satisfied, an acoustic image may not be localized at a position of the target acoustic image 5. In a low frequency band, however, a level difference between the acoustic transfer functions of both ears and a phase difference between the acoustic transfer functions of both ears are key factors for the acoustic image localization. Therefore, only if the ratio between the acoustic transfer functions of the both ears coincides with the ratio between $H_{R120L}$ and $H_{R120R}$, an acoustic image can be localized at a position of the target acoustic image 5.

Therefore, for example, the transfer function $G_L$ of the left amplitude phase characteristic adjusting section 413*a* may be divided by the transfer function $G_R$. Or the transfer function $G_R$ of the right amplitude phase characteristic adjusting section 413*b* may be divided by the transfer function $G_R$. In this case, the transfer function of the left amplitude phase characteristic adjusting section 413*a* is $G_L/G_R$, and the transfer function of the right amplitude phase characteristic adjusting section 413*b* is 1. Furthermore, the acoustic transfer function to each ear is shown in the right side of the following equation.

[Equation 3]

$$\begin{bmatrix} C_{LL} & C_{RL} \\ C_{LR} & C_{RR} \end{bmatrix} \begin{bmatrix} G_L/G_R \\ 1 \end{bmatrix} = \begin{bmatrix} H_{R120L}/G_R \\ H_{R120R}/G_R \end{bmatrix} \tag{3}$$

However, sound listened by the user 3 is localized at a position of the target acoustic image 5. As is clear from the equation (3), $1/G_R$ is included in the acoustic transfer function of each ear. Therefore, sound quality changes as compared to the sound reproduced in the configuration shown in FIG. 2. Thus, a characteristic of the transfer function $G_R$ may be given to a low-pass acoustic signal outputted from the low-pass section 410*a* in order to previously correct such a sound variation. Note that it is desirable that a process section for providing the characteristic of the transfer function $G_R$ may be realized as a low calculation IIR filter for correcting only the amplitude frequency characteristic of the transfer function $G_R$ in order not to increase the signal processing calculation amount.

Figure 20:
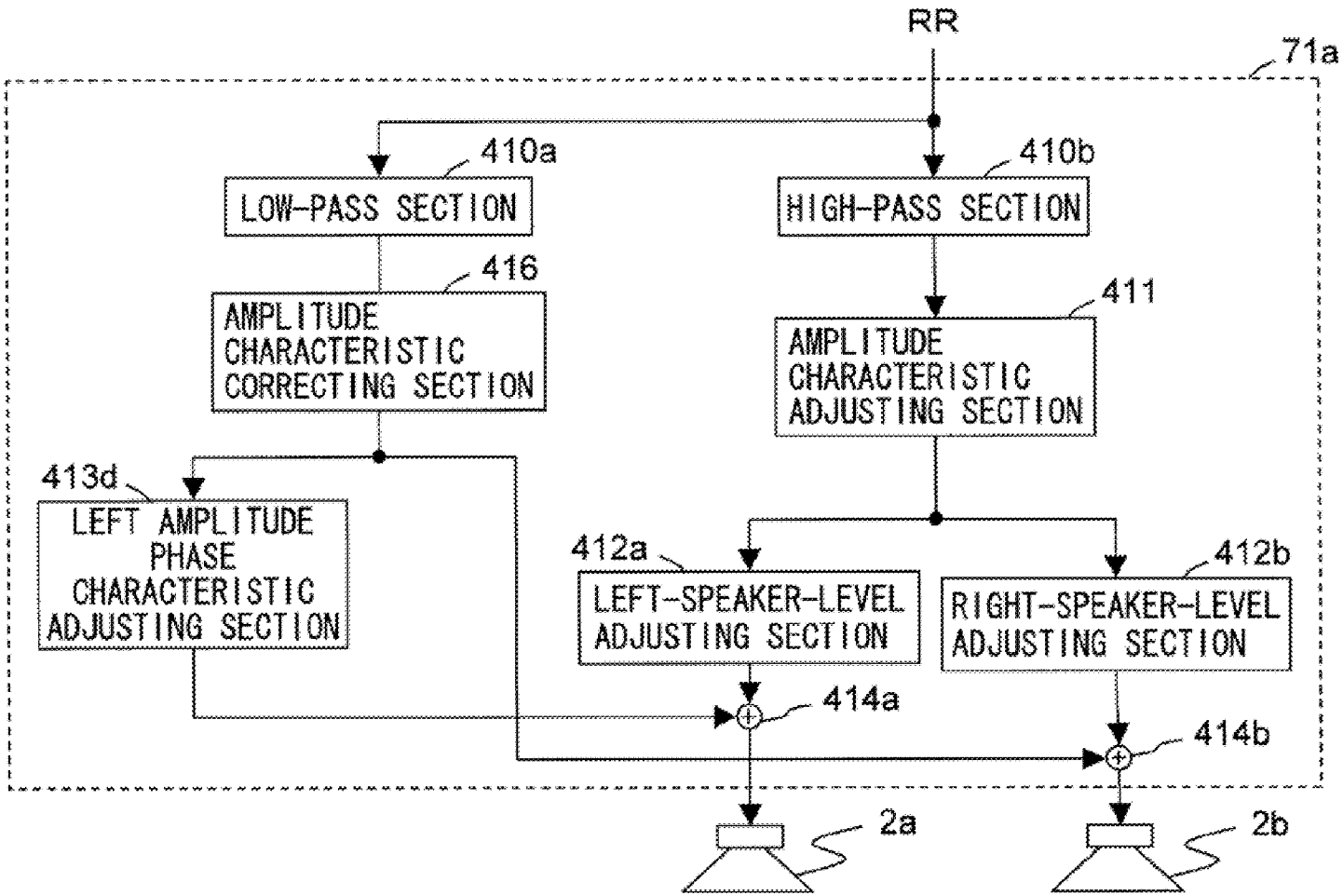
FIG. 20 is a diagram showing a configuration of an acoustic image localization apparatus 71*a*.

FIG. 20 shows a configuration of an acoustic image localization apparatus 71*a* which applies the above case. The acoustic image localization apparatus 71*a* differs from the acoustic image localization apparatus 41*a* shown in FIG. 2 in that in the acoustic image localization apparatus 71*a*, the right amplitude phase characteristic adjusting section 413*b* is omitted, an amplitude characteristic correction section 416 is additionally provided, and a left amplitude phase characteristic adjusting section 413*d* replaces the left amplitude phase characteristic adjusting section 413*a*. The amplitude characteristic correction section 416 adjusts the amplitude frequency characteristic of a low-pass acoustic signal, which is outputted from the low-pass section 410*a*, to an amplitude frequency characteristic of the transfer function $G_R$. The left amplitude phase characteristic adjusting section 413*d*, in which a transfer function $G_L/G_R$ is set, processes an output signal of the amplitude characteristic correction section 416. While the left amplitude phase characteristic adjusting section 413*d* is realized by an FIR type filter, the amplitude characteristic correction section 416 is realized by a low-order IIR type filter. Note that the reduction in the signal processing calculation amount has higher priority than the sound variation, it is understood that the amplitude characteristic correction section 416 may be omitted. Furthermore, in the configuration shown in FIG. 17, the right amplitude phase characteristic adjusting section 413*b* may be omitted, the amplitude characteristic correction section 416 may be additionally provided, and the left amplitude phase characteristic adjusting section 413*d* may replace the left amplitude phase characteristic adjusting section 413*a*.

Figure 21:
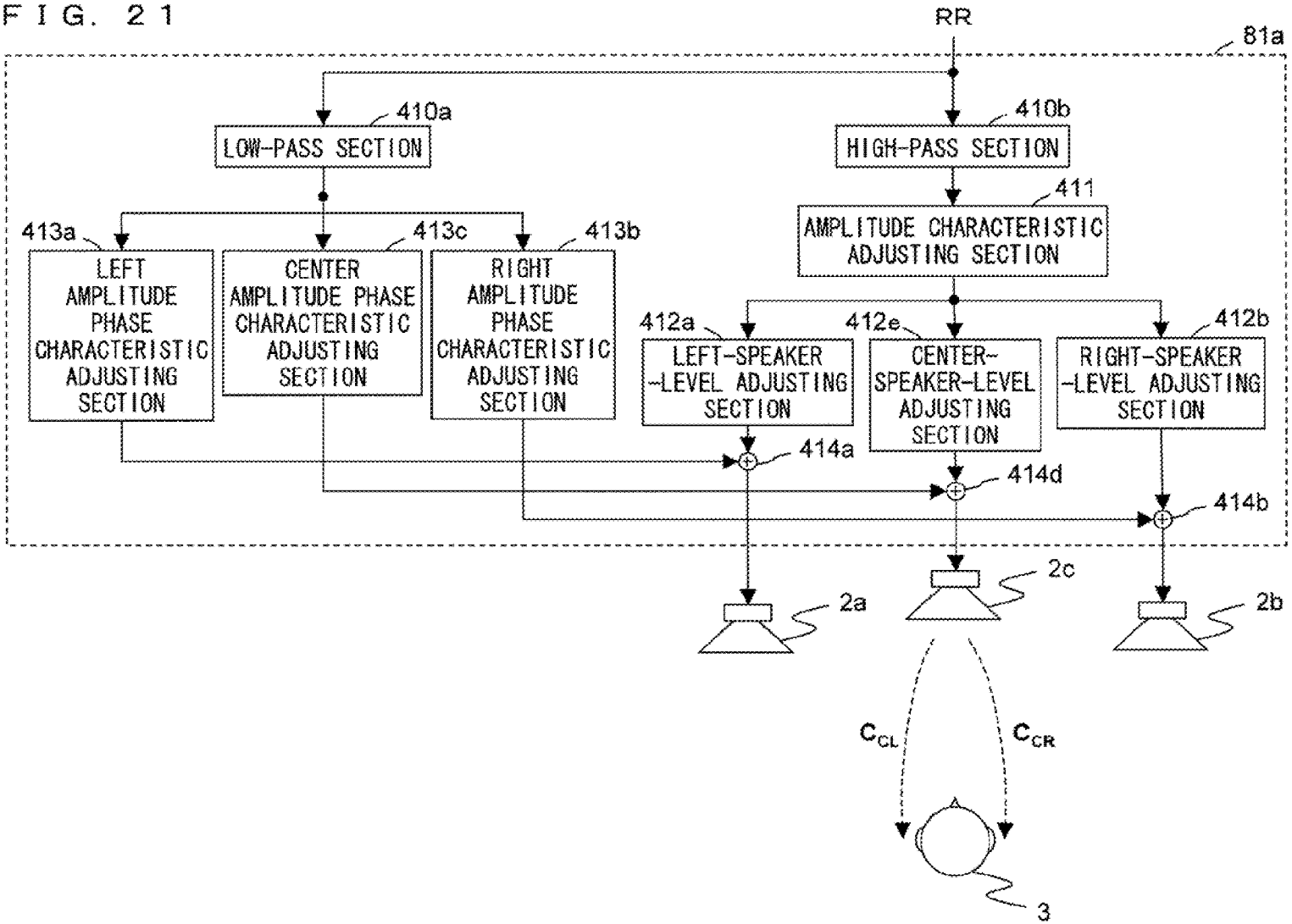
FIG. 21 is a diagram showing a configuration of an acoustic image localization apparatus 81*a* which performs a control by using three speakers.

In the configuration shown in FIG. 2, an acoustic reproduction is performed by using the two left speaker 2*a* and the right speaker 2*b* which are set in front of the user 3. However, three or more speakers may be used. FIG. 21 is a diagram showing a configuration of an acoustic image localization apparatus 81*a* in which the control is performed by using three speakers. The configuration of the acoustic image localization apparatus 81*a* shown in FIG. 21 differs from that shown in FIG. 2 in that in the acoustic image localization apparatus 81*a*, a center-speaker-level adjusting section 412*e*, a center amplitude phase characteristic adjusting section 413*c* and an adder 414*d* are additionally provided. Note that the center speaker 2*c* is disposed directly in front of the user 3. In this configuration, a reproduction characteristic correction processing section 4112 constituting the amplitude characteristic adjusting section 411 may be designed so as to planarize a characteristic ($C_{LL}$+$C_{RL}$+$C_{CL}$) or a characteristic ($C_{LR}$+$C_{RR}$+$C_{CR}$) considering the acoustic transfer function from the center speaker 2*c* to each ear of the user 3. Furthermore, an appropriate gain may be set in the center-speaker-level adjusting section 412*e* such that a localization position in the left-right direction of an acoustic image rarely changes even if a listening position of the user 3 is chanced. Furthermore, an appropriate transfer function may be set in the center amplitude phase characteristic adjusting section 413*c* such that a localization position in the left-right direction of an acoustic image rarely changes even if a listening position of the user 3 is changed. With the configuration shown in FIG. 21, the acoustic pressure distribution becomes more uniform in the vicinity of the user 3, thereby making it possible to reduce variation of the acoustic image localization effect caused by different listening positions.

Figure 22:
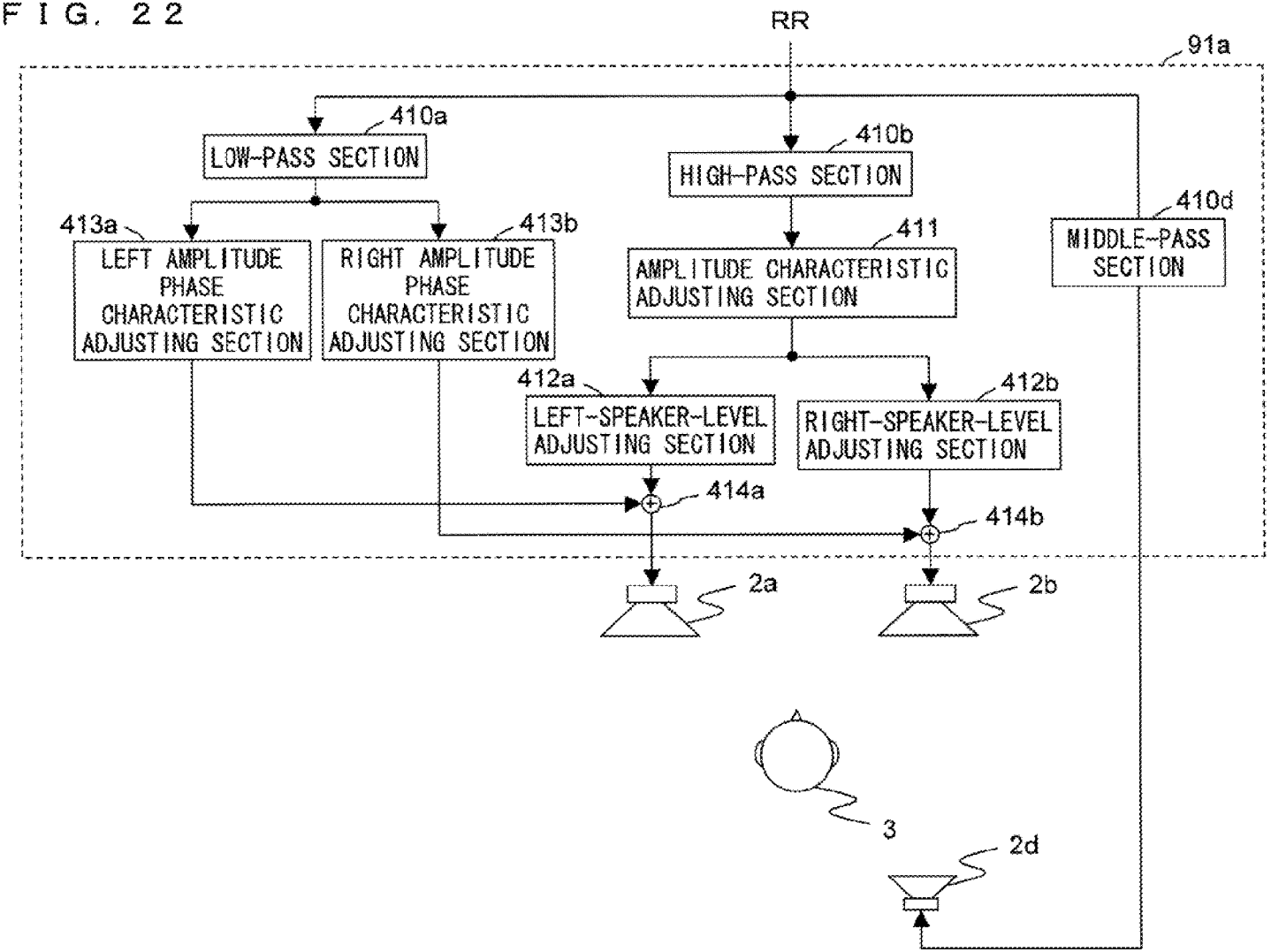
FIG. 22 is a diagram showing a configuration of an acoustic image localization apparatus 91*a* using an auxiliary speaker.
Figure 23:
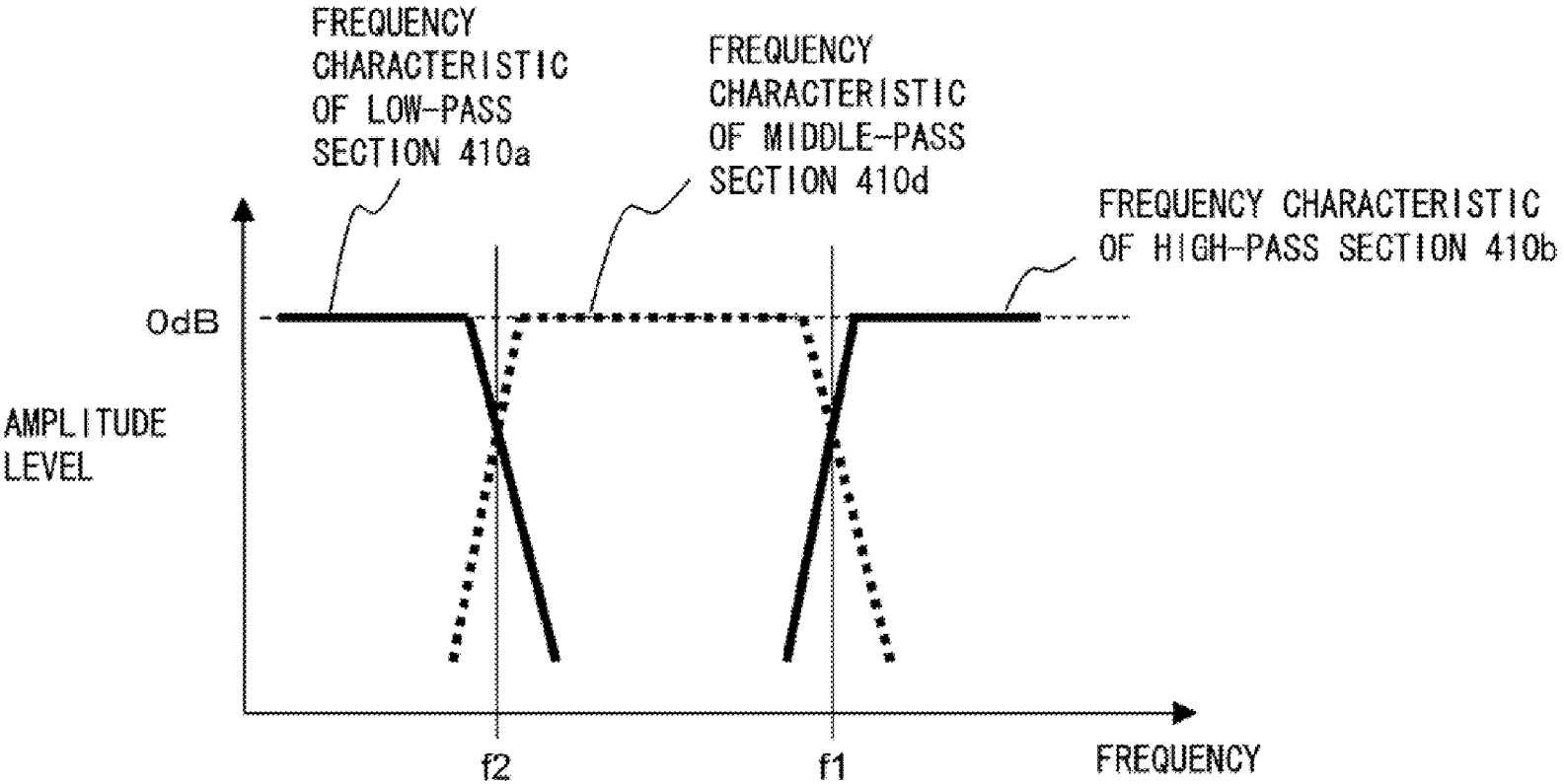
FIG. 23 is a diagram showing frequency characteristics of a low-pass section 410*a*, a high-pass section 410*b* and a predetermined band passing section 410*d*.

In the case where three or more speakers are used, at least one speaker may be disposed, as an auxiliary speaker, in the vicinity of a predetermined position at which an acoustic image wishes to be localized. FIG. 22 is a diagram showing a configuration of an acoustic image localization apparatus 91*a* using an auxiliary speaker. In FIG. 22, the configuration of the acoustic image localization apparatus 91*a* differs from that shown in FIG. 2 in that in the acoustic image localization apparatus 91*a*, a middle-pass section 410*d* is additionally provided. In FIG. 22, the predetermined position at which an acoustic image wishes to be localized is a position diagonally to the right-rear of the user 3, and the auxiliary speaker 2*d* is disposed at the predetermined position. The middle-pass section 410*d* is constituted by a bandpass filter for passing middle-pass components of the right surround channel signal RR. As shown in FIG. 23, the low-pass section 410*a*, the high-pass section 410*b* and the middle-pass section 410*d* are designed such that frequency characteristics thereof do not overlap with each other. As shown in FIG. 23, the high-pass section 410*b* passes only an acoustic signal having a frequency higher than or equal to a first predetermined frequency f1, and the middle-pass section 410*d* passes only an acoustic signal having a frequency lower than the first predetermined frequency f1 and higher than or equal to a second predetermined frequency f2, and the low-pass section 410*a* passes only an acoustic signal having a frequency lower than the second predetermined frequency f2. An output signal of the middle-pass section 410*d* is reproduced by the auxiliary speaker 2*d*.

Therefore, an output signal of the middle-pass section 410*d* is acoustically reproduced by a real speaker disposed in a direction in which an acoustic image wishes to be localized, thereby further improving the acoustic image localization effect.

Note that in the configuration shown in FIG. 22, a reproduction bandwidth of the auxiliary speaker 2*d* may be wide. In general, however, a speaker having a wide reproduction bandwidth is large in size and heavy in weight. Therefore, it is difficult to set such a speaker in a limited space. However, as shown in FIG. 23, the reproduction band required for the auxiliary speaker 2*d* is a middle band. Therefore, the reproduction bandwidth required for the auxiliary speaker 2*d* may be narrow. Thus, a compact speaker may be used as an auxiliary speaker 2*d*, and therefore such a speaker can be easily mounted. Furthermore, in high-pass components (i.e., middle-pass components) of a low-pass acoustic signal which is processed in the configuration shown in FIG. 2, a control error caused by a change in the listening position is easily generated by performing the crosstalk cancellation process. However, in the configuration shown in FIG. 22, no control is performed in the middle band, and sound in the middle band is outputted directly from the auxiliary speaker 2*d*. Therefore, no control errors are generated in the middle band, thereby making it possible to obtain the higher acoustic image localization effect.

Figure 24:
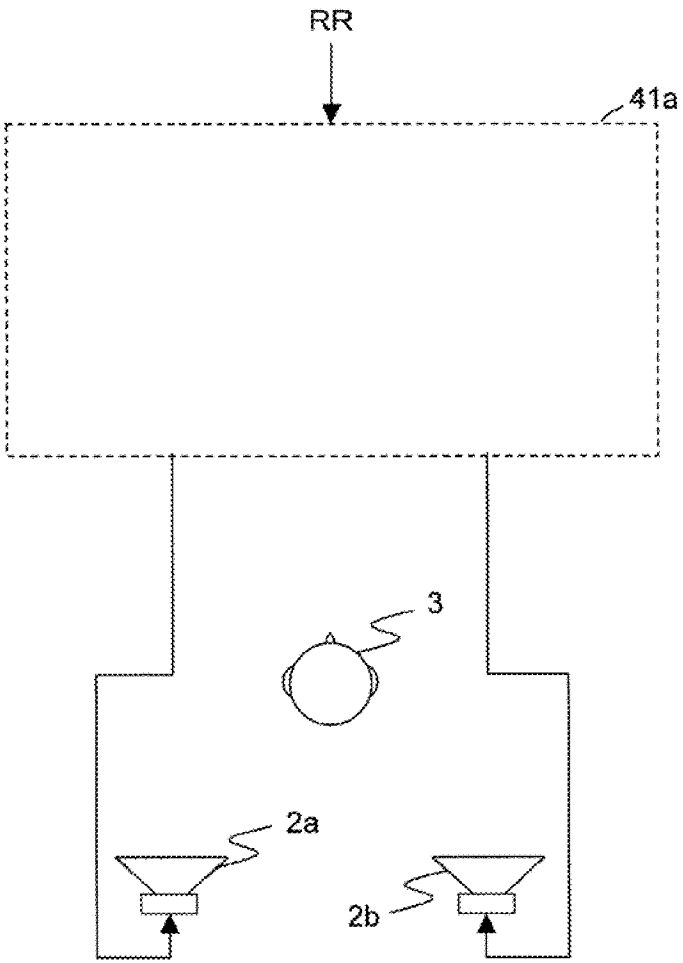
FIG. 24 is a diagram showing a configuration in which the left speaker 2*a* and the right speaker 2*b* are disposed behind the user 3.

Furthermore, in the configuration shown in FIG. 2, an acoustic reproduction is performed by using the left speaker 2*a* and the right speaker 2*b* which are disposed in front of the user 3. However, the left speaker 2*a* and the right speaker 2*b* may be disposed behind the user 3. FIG. 24 is a diagram showing the configuration in which the left speaker 2*a* and the right speaker 2*b* are disposed behind the user 3. In the configuration shown in FIG. 24, it is assumed that an acoustic transfer path $C_{LL}$ from the left speaker 2*a* to the left ear of the user 3, an acoustic transfer path $C_{LR}$ from the left speaker 2*a* to the right ear of the user 3, an acoustic transfer path $C_{RR}$ from the right speaker 2*b* to the right ear of the user 3, and an acoustic transfer path $C_{RL}$ from the right speaker 2*b* to the left ear of the user 3 are obtained by measurement or the like. In this case, the reproduction characteristic correction processing section 4112 constituting the amplitude characteristic adjusting section 411 may be designed so as to planarize a characteristic ($C_{LL}$+$C_{RL}$) or a characteristic ($C_{LR}$+$C_{RR}$). With the configuration shown in FIG. 24, it becomes possible to provide the user 3 with the acoustic image localization effect within a wide listening range even in an environment where the speakers cannot be disposed in front of the user 3 due to the space limitation or the like.

Figure 25:
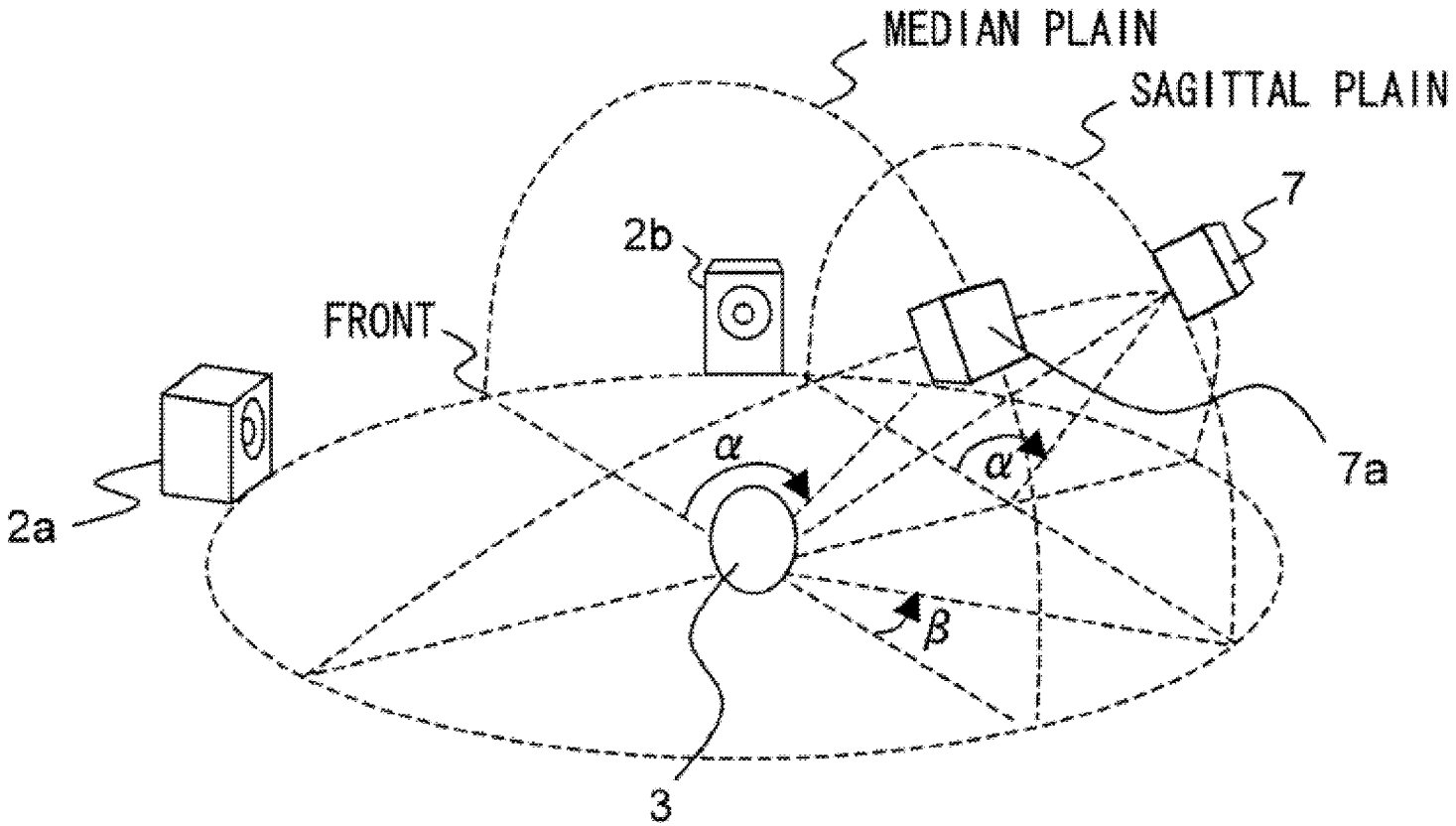
FIG. 25 is a three-dimensional diagram showing a state where an acoustic image is localized at a position diagonally to the upper-rear of the user 3.

In the configuration shown in FIG. 2, an operation is performed such that an acoustic image is localized at a position of the right surround speaker RR, which is a position diagonally to the rear of the user 3. However, an acoustic image may be localized at any position. FIG. 25 is a three-dimensional diagram showing a state where an acoustic image is localized at a position diagonally to the upper-rear of the user 3. In FIG. 25, a target acoustic image 7 is located at a position diagonally to the upper-rear of the user 3. Note that a plain parallel with the median plain and on which the target acoustic image 7 is positioned is referred to as a sagittal plain. Furthermore, an angle α of the upper position of the target acoustic image 7 on the sagittal plain is referred to as an ascending angle, and a forward angle β between the median plain and the sagittal plain as viewed from the user 3 is referred to as a side direction angle. The target acoustic image 7*a* is located at a position, on the median plain, having the same ascending angle as the ascending angle α of the target acoustic image 7. In the case where an acoustic image is localized at a position of the target acoustic image 7, the target characteristic correction processing section 4111 adjusts an amplitude frequency characteristic of an inputted acoustic signal to an amplitude frequency characteristic of the acoustic transfer function from the target acoustic image 7*a* to either of the left or right ear of the user 3. By executing this process, the acoustic image is localized at the target acoustic image 7*a* located at a position rotated by the ascending angle α, that is, a position rotated upward by an angle α from the facing direction of the user 3 when the position of the user 3 is the center. Next, the left-speaker-level adjusting section 412*a* and the right-speaker-level adjusting section 412*b* generate an appropriate level difference between an output of the left speaker 2*a* and an output of the right speaker 2*b* in order to realize the side direction angle β. By executing this process, an acoustic image is localized at the target acoustic image 7 located at a position rotated by the side direction angle β, that is, a position rotated in the rightward direction orthogonal to the upward direction by an angle β from the position of the target acoustic image 7*a* when the position of the user 3 is the center. As described above, when an acoustic image is localized at a predetermined position, the ascending angle α and the side direction angle β, both of which are obtained based on the predetermined position, and an appropriate value may be set in each of the target characteristic correction processing section 4111, the left-speaker-level adjusting section 412*a* and the right-speaker-level adjusting section 412*b*.

Second Embodiment

Figure 26:
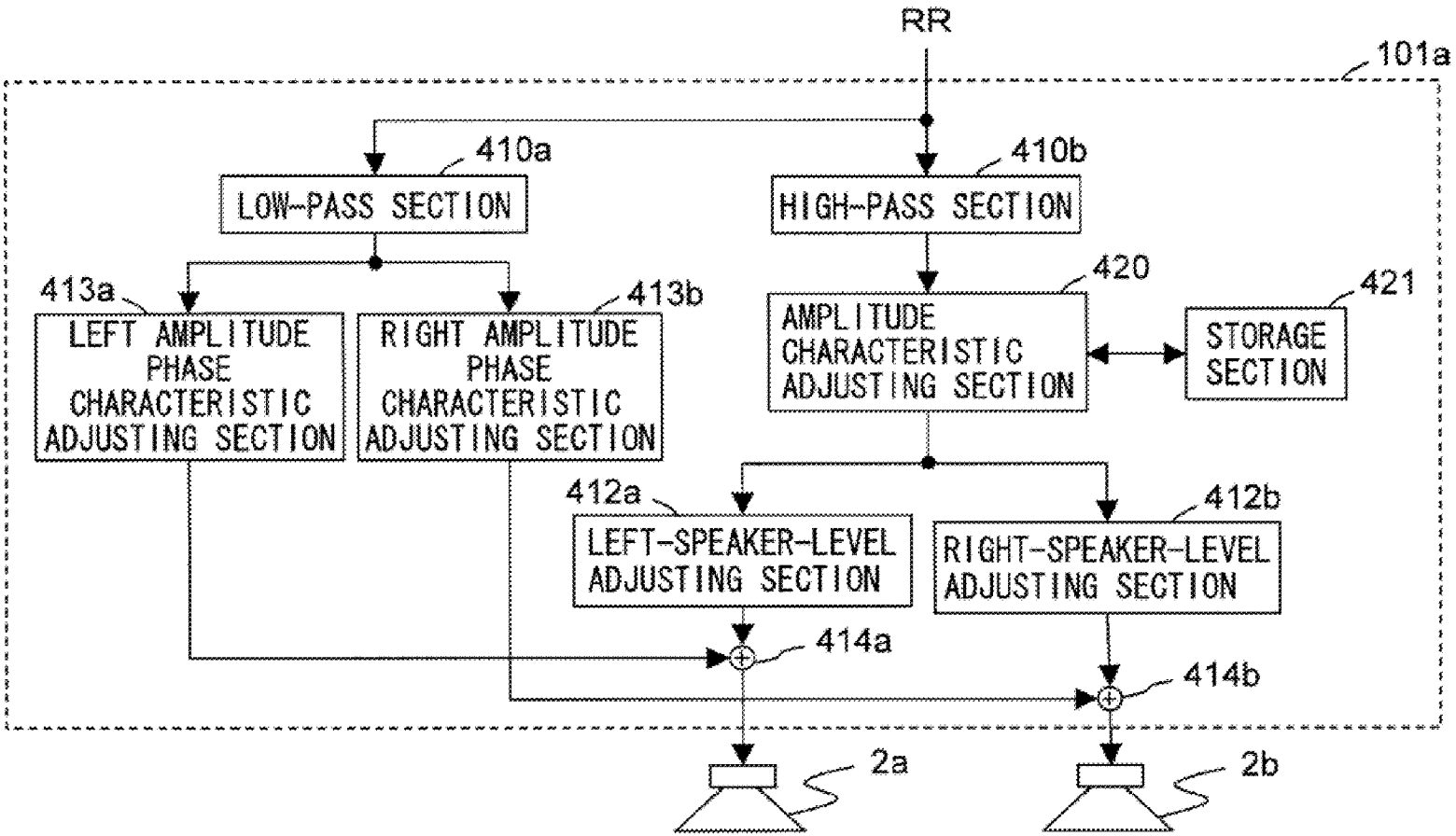
FIG. 26 is a diagram showing a configuration of an acoustic image localization apparatus 101*a* according to a second embodiment.

Next, the acoustic image localization apparatus according to a second embodiment of the present invention will be described with reference to FIG. 26. FIG. 26 is a diagram showing a configuration of an acoustic image localization apparatus 101*a* according to the second embodiment. The acoustic image localization apparatus 101*a* differs from the acoustic image localization apparatus 41*a* shown in FIG. 2 in that in the acoustic image localization apparatus 101*a*, an amplitude characteristic adjusting section 420 replaces the amplitude characteristic adjusting section 411, and the storage section 421 is additionally provided. Hereinafter, the second embodiment will be described mainly with respect to this difference. Note that FIG. 26 shows the configuration of the acoustic image localization apparatus 101*a* for processing the right surround channel signal RR, as an example. Furthermore, in FIG. 26, the user 3 faces upward. Furthermore, FIG. 26 is a diagram as viewed from above the head of the user 3.

In FIG. 26, a high-pass acoustic signal outputted from the high-pass section 410*b* is inputted to the amplitude characteristic adjusting section 420. The amplitude characteristic adjusting section 420 is connected to the storage section 421. An output signal of the amplitude characteristic adjusting section 420 is inputted to the left-speaker-level adjusting section 412*a* and the right-speaker-level adjusting section 412*b*. The processes performed by the left-speaker-level adjusting section 412*a* and the right-speaker-level adjusting section 412*b* are the same as those have been described in the first embodiment. Therefore, any descriptions thereof will be omitted.

Figure 27:
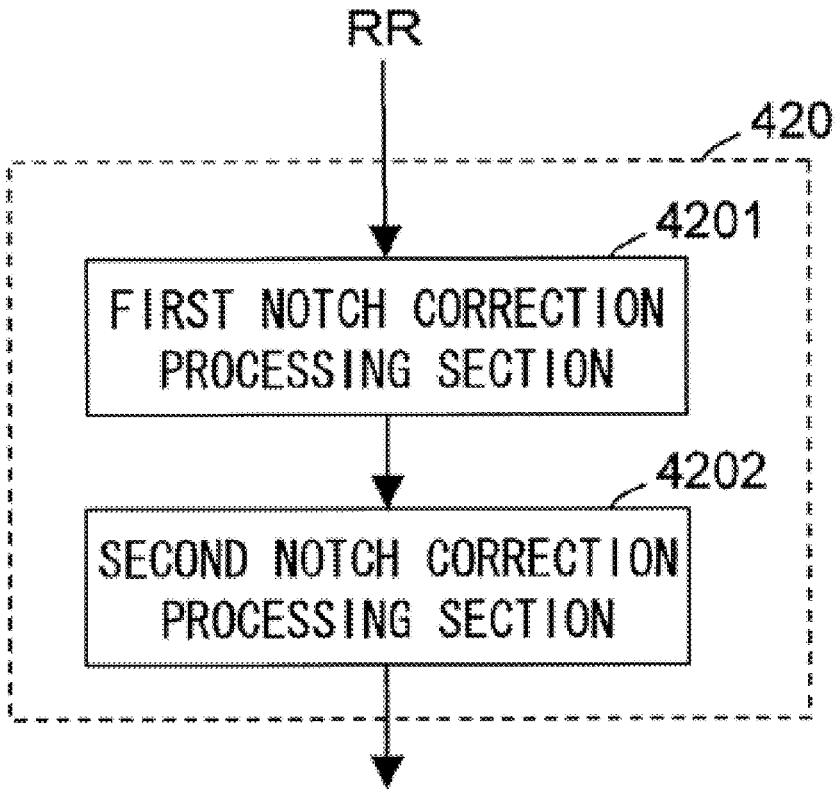
FIG. 27 is a diagram showing a configuration of an amplitude characteristic adjusting section 420.

As shown in FIG. 27, the amplitude characteristic adjusting section 420 is constituted by a parametric equalizer filter which realizes a first notch correction processing section 4201 and a second notch correction processing section 4202 as shown in FIG. 27. FIG. 27 is a diagram showing a configuration of the amplitude characteristic adjusting section 420. The first notch correction processing section 4201 is connected in series with the second notch correction processing section 4202. Note that the amplitude characteristic adjusting section 420 realizes the first notch correction processing section 4201 and the second notch correction processing section 4202 by using a known biquad IIR filter as a parametric equalizer filter.

Figure 28:
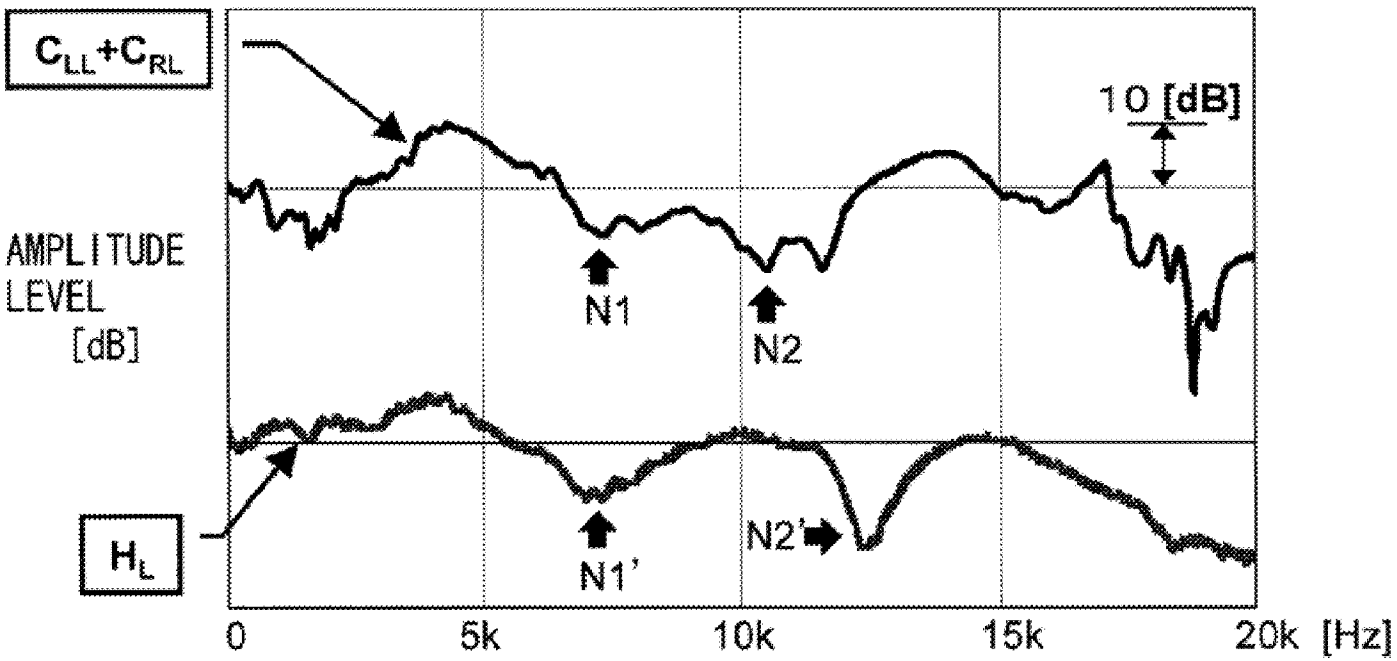
FIG. 28 is a diagram showing an amplitude frequency characteristic of an acoustic transfer path $C_{LL}$+$C_{RL}$ of the left speaker 2*a* and the right speaker 2*b* and the amplitude frequency characteristic of the acoustic transfer function $H_L$ shown in FIG. 4.

In the configuration shown in FIG. 2, the amplitude characteristic adjusting section 411 performs an adjustment so as to faithfully reproduce an amplitude frequency characteristic of an acoustic transfer function obtained based on the median plain which is considered as a key factor for localizing an acoustic image in the front-rear direction. However, Iida and his colleagues have reported in "A novel head-related transfer function model based spectral and interaural difference cues, WESPAC9 (June, 2006)" that it is possible to localize an acoustic image in the front-rear direction only by reproducing two notch characteristics appeared within a frequency bandwidth from 4 kHz to 16 kHz, and these two characteristics play a particularly important role for localizing an acoustic image in the front-rear direction. FIG. 28 is a diagram showing an amplitude frequency characteristic of an acoustic transfer path $C_{LL}+C_{RL}$ of the left speaker 2*a* and the right speaker 2*b*, and an amplitude frequency characteristic of an acoustic transfer function $H_L$ shown in FIG. 4. The $C_{LL}+C_{RL}$ shows a characteristic (notch characteristic) in which an amplitude level falls in the vicinities of 7 kHz (N1) and 11 kHz (N2). Also, the $H_L$ shows that a notch characteristic appears in the vicinities of 7 kHz (N1') and 12 kHz (N2'). As already described in the first embodiment, when the user 3 listens to the characteristic of $C_{LL}+C_{RL}$ with each ear, an acoustic image is localized at a position slightly upward from the facing direction of the user 3. When the user 3 listens to the characteristic of $H_L$, an acoustic image is localized at a position directly behind the user 3. As described above, by changing frequencies, a gain (depth of notch) and an acuminate degree (acumination of notch) of the two notch characteristics appeared within a frequency bandwidth from 4 kHz to 16 kHz, to predetermined values, it is possible to control the localization of an acoustic image in the front-rear direction.

Figure 29:
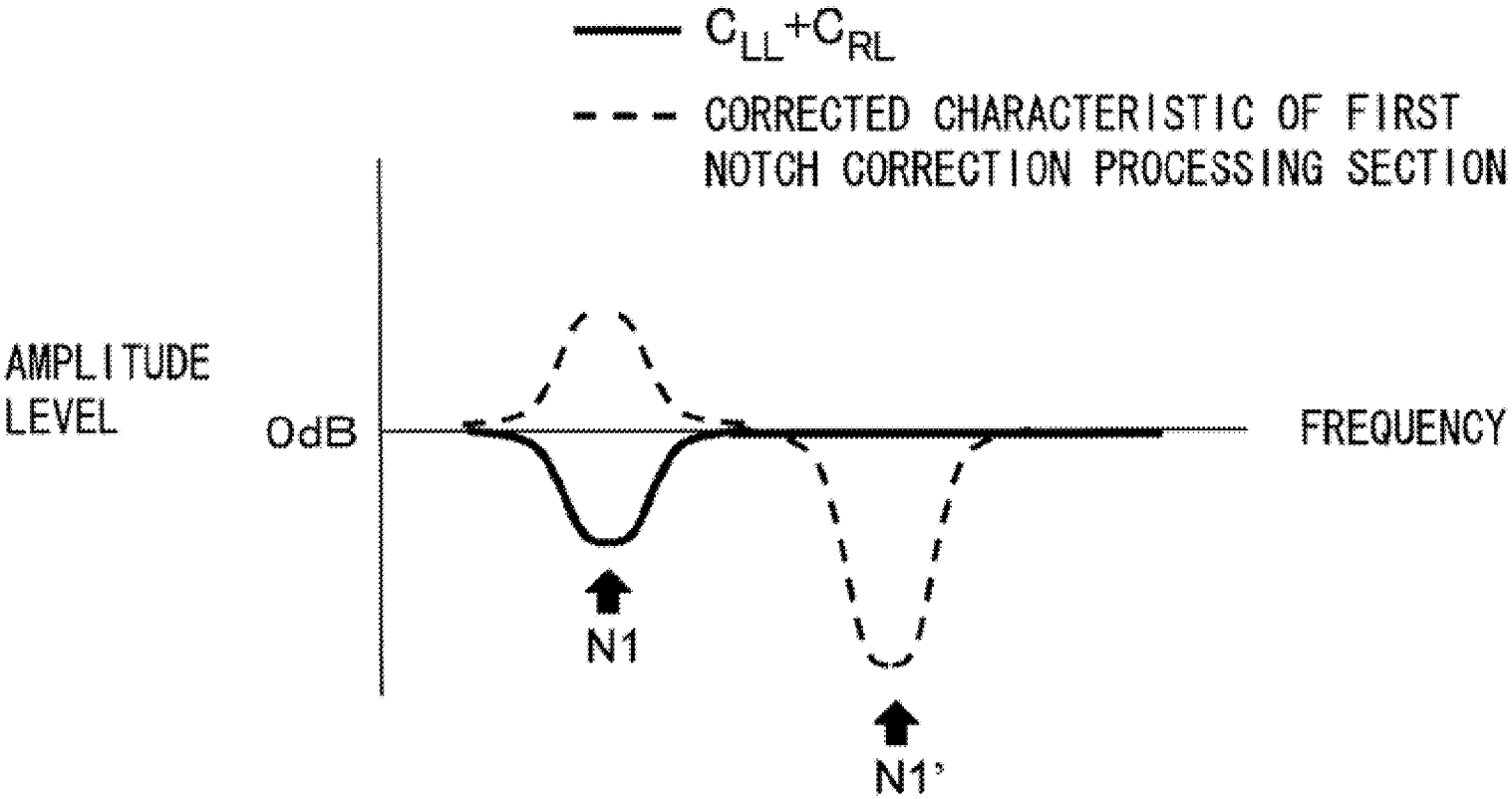
FIG. 29 is a schematic diagram showing a process executed by a first notch correction processing section 4201.

The amplitude characteristic adjusting section 420 is constituted by the first notch correction processing section 4201 for reproducing N1' and the second notch correction processing section 4202 for reproducing N2' based on this knowledge. For example, the first notch correction processing section 4201 is designed, as shown in FIG. 29, by a parametric equalizer in which the notch characteristic N1 of $C_{LL}+C_{RL}$ is planarized and appropriate frequency, gain and acuminate degree are set to form the notch characteristic at N1'. FIG. 29 is a schematic diagram showing a process executed by the first notch correction processing section 4201. In FIG. 29, a dotted line indicates corrected characteristic designed by the first notch correction processing section 4201. A solid line indicates a characteristic of $C_{LL}+C_{RL}$. Similarly to the first notch correction processing section 4201, the second notch correction processing section 4202 may be designed so as to reproduce N2'. As described above, by executing the processes executed by the first notch correction processing section 4201 and the second notch correction processing section 4202, the amplitude characteristic adjusting section 420 adjusts an amplitude frequency characteristic of an inputted acoustic signal such that a reproduction characteristic of the left ear of the user 3 has the same notch characteristic as that of the amplitude frequency characteristic of the acoustic transfer function $H_L$ shown in FIG. 4.

Figure 30:
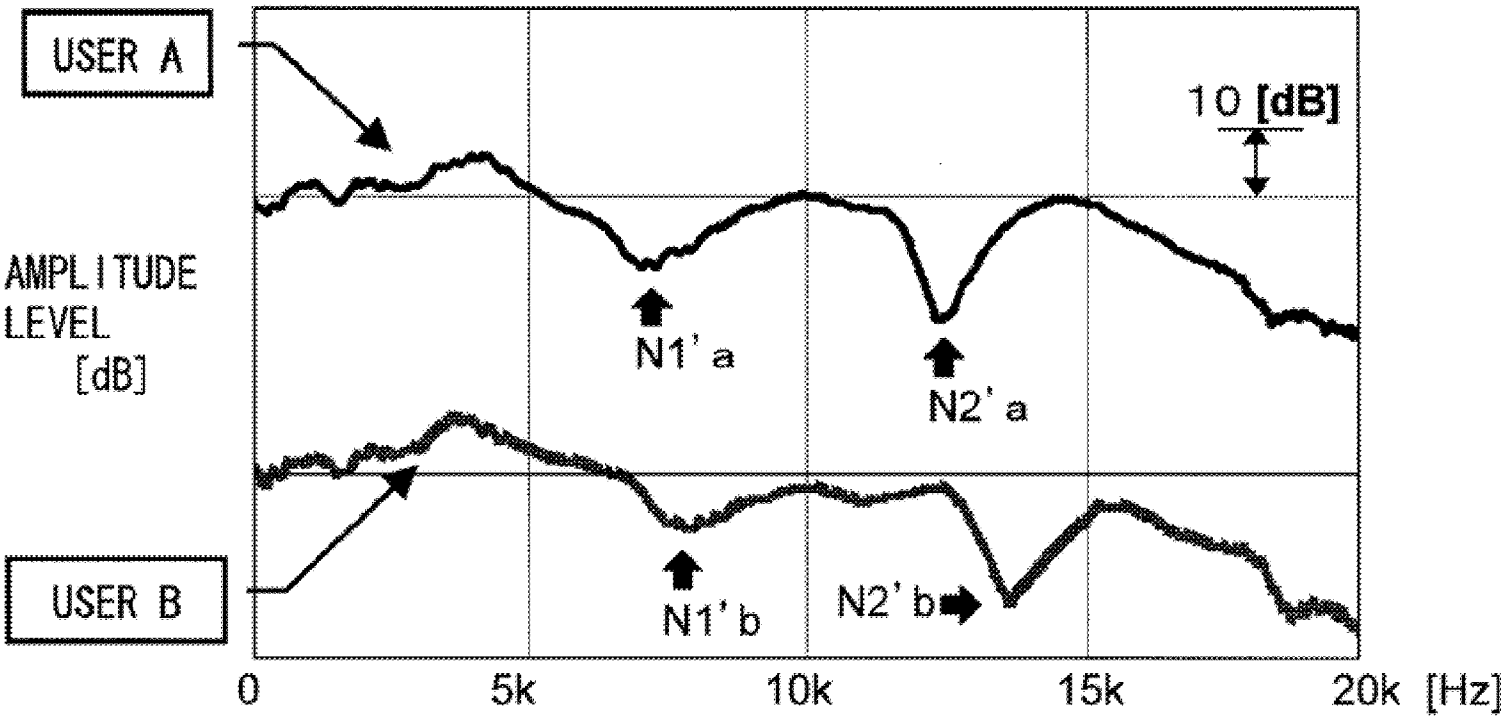
FIG. 30 is a diagram showing amplitude frequency characteristics of the acoustic transfer functions $H_L$ of positions directly behind different users A and B.

By the way, in general, the first notch correction processing section 4201 and the second notch correction processing section 4202 are designed by using an acoustic transfer function measured by setting a commercial dummy head at a listening position. However, an acoustic transfer function differs depending on a shape of the head of an ear of the user 3 who actually uses the apparatus. Therefore, in the case where the same correction process is performed, the acoustic image localization effect differs depending on the users 3. FIG. 30 shows amplitude frequency characteristics of the acoustic transfer functions $H_L$ of positions directly behind different users A and B. In FIG. 30, notch characteristics N1'*a* and N2'*a* are notch characteristics of the user A. Notch characteristics N1'*b* and N2'*b* are notch characteristics of the user B. As shown in FIG. 30, between the users A and B, the number of notch characteristics generated within the frequency band from 4 kHz to 16 kHz is the same. However, between the users A and B, the frequency, gain and acuminate degree are different. Thus, in the storage section 421, identifying information for identifying the user and corresponding information associated with information related to a notch characteristic of the user (frequencies, gains and acuminate degrees of N1' and N2') are stored. Furthermore, a plurality of pieces of corresponding information are stored for each user. Still furthermore, in each of the first notch correction processing section 4201 and the second notch correction processing section 4202, a parameter is variable for handling the difference between the acoustic transfer functions which difference is caused by different users. Specifically, the amplitude characteristic adjusting section 420 reads the corresponding information on the user who is currently listening to the sound from the storage section 421, so as to change a parameter of the first notch correction processing section 4201 and a parameter of the second notch correction processing section 4202 for each of the users. By the aforementioned operation, an appropriate parameter can be set for each user, thereby making it possible to maximize the acoustic image localization effect.

Note that in the configuration shown in FIG. 26, for setting an appropriate parameter for each user, the storage section 421 is additionally provided and a variable parameter is set in the amplitude characteristic adjusting section 420. Alternatively, the storage section 421 is omitted, and a fixed parameter may be set in the amplitude characteristic adjusting section 420. In such a configuration, it is not possible to set an appropriate parameter for each of the users. However, since the amplitude characteristic adjusting section 420 serving as a process section for controlling the front-rear sensation of an acoustic image is a two-layer biquad IIR filter. Thus, a calculation amount is smaller in the configuration shown in FIG. 26 as compared to the configuration shown in FIG. 2.

Note that in the configuration shown in FIG. 26, the amplitude characteristic adjusting section 420 corrects the two notch characteristics. However, three or more notch characteristics or peak characteristics may be corrected. With such a configuration, precision of correction is improved, thereby improving the acoustic image localization effect.

Note that it is understood that each of the variants (FIGS. 14 to 17, FIGS. 20 to 22 and FIG. 24) described in the first embodiment may be applied in the configuration shown in FIG. 26.

Figure 31:
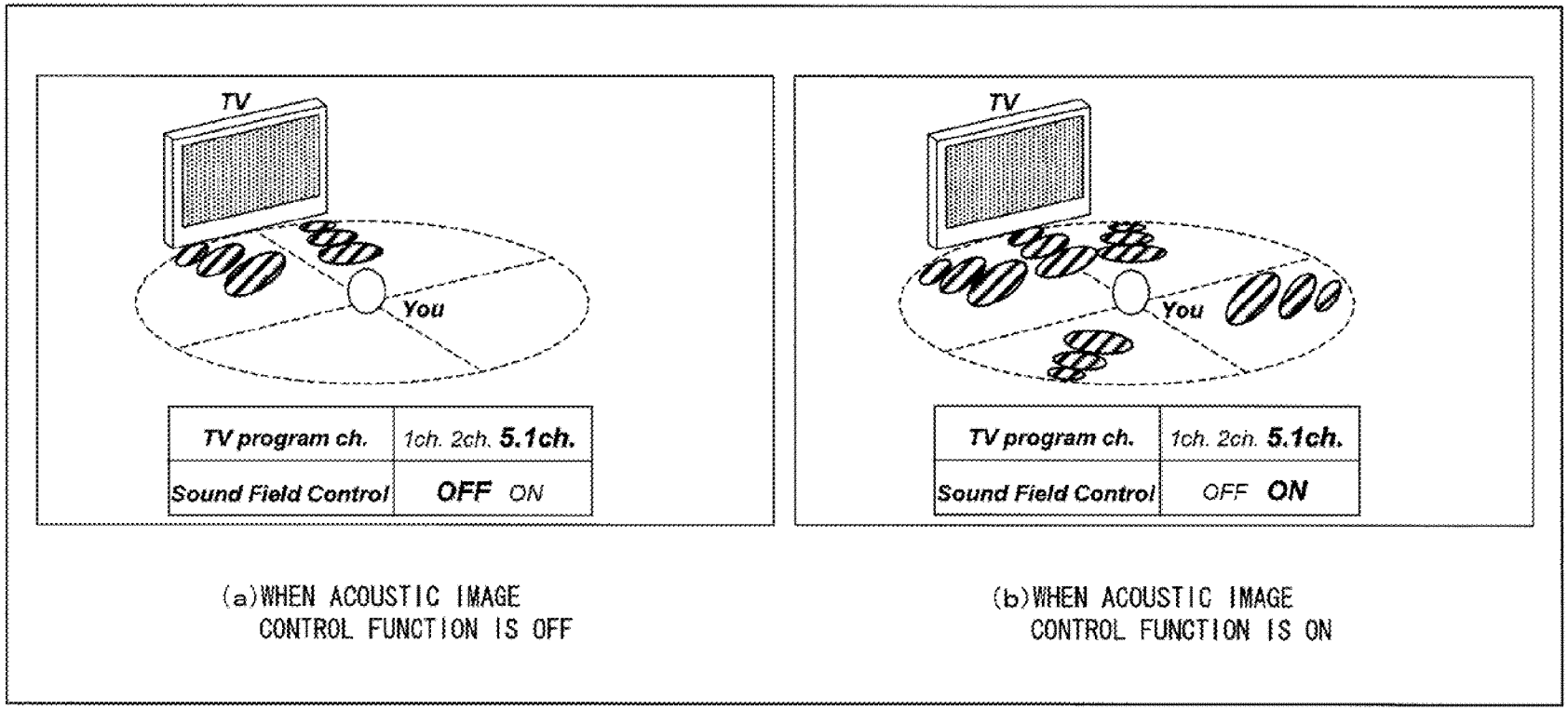
FIG. 31 is a diagram showing an exemplary display screen of a television receiver.

Note that in the acoustic image localization apparatus and the acoustic image localization system according to the first to second embodiments described above can be mounted in a video apparatus such as a television receiver or a CRT. In recent years, in the television broadcasting, a 5.1 channel sound content is broadcast in addition to monophonic sound or stereo sound, and a broadcast content having a different number of channels is broadcast in a mixed manner. Under such circumstances, when the acoustic image localization system is applied to the television receiver, a variety of types of acoustic effects exist by a combination of the number of channels of television programs (television contents) and sound field control ON/OFF. Thus, it is difficult for the user to instantly and intuitively recognize which type of acoustic effect he or she is receiving, and thus the user may feel confused. As shown in FIG. 31, a channel number of a television program, a sound field control ON/OFF and a sound effect the user is receiving are displayed on a display screen by using a visually recognizable image. Therefore, the user can instantly and intuitively recognize which type of acoustic effect he or she is receiving. FIG. 31(*a*) shows a state where while a television program indicates the 5.1 channel sound content, a 2-channel reproduction is performed by two speakers mounted in the television receiver. FIG. 31 (*b*) shows a display screen obtained when the 5.1 channel sound content is viewed when a sound control is ON. FIG. 31(*a*) shows a state where while sound is radiated from only the two speakers mounted in the television receiver, the 5.1 channel reproduction is also performed such that the user feels as if other speakers are disposed so as to surround the user.

Note that the acoustic image localization apparatus and the acoustic image localization system according to the above first and second embodiments can be realized as information processing apparatus, such as a general computer system, to which an acoustic signal of multi channels is inputted and from which the processed acoustic signal is outputted. In this case, by storing a program for causing a computer to execute the aforementioned operation in a predetermined recording medium and causing the computer to read and execute the program stored in the information recording medium, the acoustic image localization apparatus and the acoustic image localization system according to the first and second embodiments can be realized. Furthermore, the storage section 421 shown in FIG. 26 is constituted in a hard disc included in an information processing apparatus, for example. Furthermore, an information recording medium for storing the program is a nonvolatile semiconductor memory such as a ROM or a flash memory, a CD-ROM, a DVD, or an optical disc recording medium of a similar kind, for example. Furthermore, the program may be supplied to the information processing apparatus via other media or communication circuits. In the above example, the storage section 421 is constituted in the hard disc included in the information processing apparatus, for example. However, the storage section 421 may be constituted in a memory included in the information processing apparatus and other recording media other than the information processing apparatus.

Components included in the acoustic image localization apparatus and the acoustic image localization system which have been described in the first to second embodiments can be respectively implemented as LSIs, integrated circuits. These components may be individually integrated on a single chip or may also be integrated on a single chip so as to include a part or the whole thereof. Here, the term, LSI is used, but it may also be referred to as IC, system LSI, super LSI or ultra-LSI or the like depending on the difference in the degree of integration. Furthermore, the technique of implementing an integrated circuit is not limited to an LSI, but an integrated circuit may also be implemented with a dedicated circuit or general-purpose processor. It is also possible to use an FPGA (Field Programmable Gate Array) which is programmable after manufacturing an LSI or a reconfigurable processor whereby connections or settings of circuit cells inside the LSI are reconfigurable. Moreover, when technologies for implementing an integrated circuit substitutable for an LSI emerges with the advance of semiconductor technology or other derived technologies, those technologies may of course be used to integrate functional blocks.

INDUSTRIAL APPLICABILITY

An acoustic image localization apparatus, an acoustic image localization system, and acoustic image localization method, program and integrated circuit according to the present invention are capable of providing the user with an acoustic image localization effect within a wide listening range without limiting an arrangement position of a speaker, and are applicable to an acoustic reproduction system such as a video apparatus, a car audio apparatus and the like.

The invention claimed is:

1. An acoustic image localization apparatus that outputs sound from a plurality of speakers so as to localize an acoustic image at a predetermined position or direction on a space as viewed from a listener, the acoustic image localization apparatus comprising:

in a low frequency band, amplitude phase characteristic adjusting means, provided so as to respectively correspond to the plurality of speakers, for adjusting an amplitude phase frequency characteristic such that a first acoustic image is localized at the predetermined position, while performing a crosstalk cancellation process on an inputted acoustic signal;

in a high frequency band, amplitude characteristic adjusting means for adjusting an amplitude frequency characteristic of the inputted acoustic single such that a second acoustic image is localized in a direction rotated by a first angle about a position of a listener toward an upper direction from a facing direction of the listener; and level adjusting means, provided so as to respectively correspond to the plurality of speakers, for adjusting a level of the acoustic signal outputted from the amplitude characteristic adjusting means and for outputting, to a corresponding speaker, the acoustic signal whose level has been adjusted, such that a third acoustic image is localized in a direction rotated by the second angle toward the predetermined direction from the direction rotated by the first angle, wherein the low frequency band at least includes a frequency lower than or equal to approximately 1 kHz, and the high frequency band at least includes a frequency higher than or equal to approximately 4 kHz.

2. The acoustic image localization apparatus according to claim 1, wherein the amplitude characteristic adjusting means adjusts the amplitude frequency characteristic such that sound arrived at left and right ears of the listener has a notch characteristic obtained based on an acoustic transfer function from the direction rotated by the first angle to either of the left or right ear of the listener.

3. The acoustic image localization apparatus according to claim 2, wherein at least two notch characteristics obtained based on the acoustic transfer function from the direction rotated by the first angle to either of the left or right ear of the listener exist within a frequency band higher than 4 kHz.

4. The acoustic image localization apparatus according to claim 2 further comprising a storage section for storing, for each listener, information regarding the notch characteristic of the acoustic transfer function from the direction rotated by the first angle to either of the left or right ear of the listener, and corresponding information associated with identification information of the listener, wherein the amplitude characteristic adjusting means adjusts the amplitude frequency characteristic based on the corresponding information stored in the storage section such that the sound arrived at the left and right ears of the listener has the notch characteristic corresponding to the listener.

5. The acoustic image localization apparatus according to claim 1, wherein the amplitude characteristic adjusting means adjusts the amplitude frequency characteristic such that sound arrived at the left and right ears of the listener has a peak characteristic obtained based on the acoustic transfer function from the direction rotated by the first angle to the either of the left or right ear of the listener.

6. The acoustic image localization apparatus according to claim 5, wherein the level adjusting means adjusts the level of the acoustic signal outputted from the amplitude characteristic adjusting means by using the same adjustment value regardless of frequency.

7. The acoustic image localization apparatus according to claim 5, wherein the level adjusting means adjusts the level of the acoustic signal outputted from the amplitude characteristic adjusting means by using an adjustment value which is different for each predetermined frequency band.

8. The acoustic image localization apparatus according to claim 7 wherein the greater an amplitude level difference of the plurality of acoustic transfer functions, respectively corresponding to frequency bands, from the plurality of speakers to either of the left or right ear of the listener is, the greater an adjustment value of the level adjusting means becomes.

9. The acoustic image localization apparatus according to claims 8, further comprising a plurality of phase characteristic adjusting means, provided so as to respectively correspond to the plurality of level adjusting means, for adjusting a phase frequency characteristic of the acoustic signal outputted from corresponding level adjusting means, and outputs, to the corresponding speaker, the acoustic signal whose phase frequency characteristic has been adjusted, wherein the phase characteristic adjusting means adjusts the phase frequency characteristic of the acoustic signal, which is outputted from the corresponding level adjusting means, to a characteristic of the corresponding speaker such that the third acoustic image is localized at the predetermined position rotated by the second angle from the position rotated by the first angle within a range in which the amplitude frequency characteristic of sound arrived to the left and right ears of the listener remains unchanged.

10. The acoustic image localization apparatus according to claim 9, wherein the amplitude phase characteristic adjustment means are provided so as to respectively correspond to the speakers and has a plurality of amplitude phase characteristic adjusting filter for adjusting the amplitude phase frequency characteristic of the inputted acoustic signal to a characteristic of the corresponding speaker such that the acoustic image is localized at the predetermined position, and for outputting, to the corresponding speaker, the acoustic signal whose amplitude phase frequency characteristic have been adjusted.

11. The acoustic image localization apparatus according to claim 9, wherein the amplitude phase characteristic adjustment means are provided so as to respectively correspond to the speakers except for a predetermined speaker which is one of the plurality of speakers, and has a plurality of amplitude phase characteristic adjusting means for adjusting the amplitude frequency characteristic and the phase frequency characteristic of the inputted acoustic signal to a characteristic of the corresponding speaker such that the acoustic image is localized at the predetermined position, and for outputting, to the corresponding speaker, the acoustic signal whose amplitude frequency characteristic and the phase frequency characteristic have been adjusted.

12. The acoustic image localization apparatus according to claim 11, wherein, a transfer function of each of the amplitude phase characteristic adjusting means is calculated by dividing a transfer function set for each of the amplitude phase characteristic adjusting means which are provided so as to correspond to the speakers except for the predetermined speaker when it is assumed that the amplitude phase characteristic adjusting means are provided so as to correspond to all of the plurality of speakers by a transfer function set for the amplitude phase characteristic adjusting means provided so as to correspond to the predetermined speaker under the above assumption.

13. The acoustic image localization apparatus according to claim 12, further comprising:

amplitude characteristic correcting means for correcting the amplitude frequency characteristic of the acoustic signal to an amplitude frequency characteristic indicated by the transfer function set for the amplitude phase characteristic adjusting means provided so as to correspond to the predetermined speaker under the above assumption, and for outputting the corrected amplitude frequency characteristic to each of the amplitude phase characteristic means.

14. The acoustic image localization apparatus according to claim 13, further comprising an auxiliary speaker which is disposed at the predetermined position and to which the inputted acoustic signal having a frequency which is not included in the low frequency band or the high frequency band is inputted.

15. An acoustic image localization system for outputting sound from a plurality of speakers so as to localize an acoustic image at a plurality of positions or directions, on a space as viewed from a listener, respectively corresponding to a plurality of channels, the acoustic image localization system comprising:

a plurality of acoustic image localization apparatuses, provided so as to respectively correspond to the plurality of channels, for outputting sound from a plurality of speakers so as to localize the acoustic image at a position or direction, on the space, corresponding to each of the channels, wherein each of the acoustic image localization apparatuses includes:

in a low frequency band, amplitude phase characteristic adjusting means, provided so as to respectively correspond to the plurality of speakers, for adjusting an amplitude phase frequency characteristic such that a first acoustic image is localized at the predetermined position, while performing a crosstalk cancellation process on an inputted acoustic signal corresponding to each of the channels;

in a high frequency band, amplitude characteristic adjusting means for adjusting an amplitude frequency characteristic of the acoustic signal corresponding to each of the channels such that a second acoustic image is localized in a direction rotated by a first angle about a position of a listener toward an upper direction from a facing direction of the listener; and level adjusting means, provided so as to respectively correspond to the plurality of speakers, for adjusting a level of the acoustic signal outputted from the amplitude characteristic adjusting means and for outputting, to a corresponding speaker, the acoustic signal whose level has been adjusted, such that a third acoustic image is localized in a direction rotated by the second angle toward the predetermined direction from the direction rotated by the first angle, wherein the amplitude characteristic adjusting means adjusts the amplitude frequency characteristic of the acoustic signal corresponding to each of the channels such that sound arrived at left and right ears of the listener has an amplitude frequency characteristic obtained based on an acoustic transfer function from the direction rotated by the first angle to either of the left or right ear of the listener.

16. The acoustic image localization system according to claim 15, wherein each of the amplitude phase characteristic adjusting means is constituted by an FIR type filter, and a tap length of the amplitude phase characteristic adjusting means of one of the acoustic image localization apparatuses having the shortest distance between the corresponding position and the speaker is shorter than tap lengths of the amplitude phase characteristic adjusting means of the other acoustic image localization apparatuses.

17. The acoustic image localization system according to claim 15, wherein about any two of the acoustic image localization apparatuses, one of the acoustic image localization apparatus does not include the amplitude phase characteristic adjusting means, and the other acoustic image localization apparatus includes: adding means for adding the acoustic signal corresponding to the one of the channels to the acoustic signal of the other acoustic image localization apparatus corresponding to the one of the channels, and the amplitude phase characteristic adjusting means processes only an output of the adding means.

18. A video apparatus for displaying a video on a screen, comprising:

a plurality of speakers; and the acoustic image localization system, according to claim 15, which is connected to the plurality of speakers.

19. An acoustic image localization method of outputting sound from a plurality of speakers so as to localize an acoustic image at a predetermined position or direction on a space as viewed from a listener, the acoustic image localization method comprising:

in a low frequency band, amplitude phase characteristic adjusting steps, provided so as to respectively correspond to the plurality of speakers, for adjusting an amplitude phase frequency characteristic such that a first acoustic image is localized at the predetermined position, while performing a crosstalk cancellation process on an inputted acoustic signal;

in a high frequency band, amplitude characteristic adjusting means for adjusting an amplitude frequency characteristic of the inputted acoustic signal such that a second acoustic image is localized in a direction rotated by a first angle about a position of a listener toward an upper direction from a facing direction of the listener; and level adjusting steps, provided so as to respectively correspond to the plurality of speakers, of adjusting a level, which has been adjusted in the amplitude characteristic adjusting step, of the acoustic signal to a level of a corresponding speaker, such that a third acoustic image is localized in a direction rotated by the second angle toward the predetermined direction from the direction rotated by the first angle, wherein the low frequency band at least includes a frequency lower than or equal to approximately 1 kHz, and the high frequency band at least includes a frequency higher than or equal to approximately 4 kHz.

20. An integration circuit that outputs sound from a plurality of speakers so as to localize an acoustic image at a predetermined position or direction on a space as viewed from a listener, the acoustic image localization apparatus comprising:

in a low frequency band, for adjusting an amplitude phase frequency characteristic such that a first acoustic image is localized at the predetermined position, while performing a crosstalk cancellation process on an inputted acoustic signal;

in a high frequency band, amplitude characteristic adjusting means for adjusting an amplitude frequency characteristic of the inputted acoustic signal such that a second acoustic image is localized in a direction rotated by a first angle about a position of a listener toward an upper direction from a facing direction of the listener; and level adjusting means, provided so as to respectively correspond to the plurality of speakers, for adjusting a level of the acoustic signal outputted from the amplitude characteristic adjusting means and for outputting, to a corresponding speaker, the acoustic signal whose level has been adjusted, such that a third acoustic image is localized in a direction rotated by the second angle toward the predetermined direction from the direction rotated by the first angle, wherein the low frequency band at least includes a frequency lower than or equal to approximately 1 kHz, and the high frequency band at least includes a frequency higher than or equal to approximately 4 kHz.

21. A program to be executed by a computer of an acoustic image localization apparatus that outputs sound from a plurality of speakers so as to localize an acoustic image at a predetermined position or direction on a space as viewed from a listener, the program causing the computer to execute:

in a low frequency band, amplitude phase characteristic adjusting steps, provided so as to respectively correspond to the plurality of speakers, for adjusting an amplitude phase frequency characteristic such that a first acoustic image is localized at the predetermined position, while performing a crosstalk cancellation process on an inputted acoustic signal;

in a high frequency band, an amplitude characteristic adjusting step of adjusting an amplitude frequency characteristic of a second acoustic signal so as to be localized in a direction rotated by a first angle about a position of a listener toward an upper direction from a facing direction of the listener; and level adjusting steps, provided so as to respectively correspond to the plurality of speakers, of adjusting a level, which has been adjusted in the amplitude characteristic adjusting step, of the acoustic signal to a level of a corresponding speaker, such that a third acoustic image is localized in a direction rotated by the second angle toward the predetermined direction from the direction rotated by the first angle, wherein the low frequency band at least includes a frequency lower than or equal to approximately 1 kHz, and the high frequency band at least includes a frequency higher than or equal to approximately 4 kHz.

22. A computer readable recording medium that records the program according to claim 21.

* * * * *